US007800564B2

(12) United States Patent
Numao

(10) Patent No.: US 7,800,564 B2
(45) Date of Patent: Sep. 21, 2010

(54) DISPLAY APPARATUS AND DRIVING METHOD THEREOF

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 672 days.

(21) Appl. No.: 10/550,950

(22) PCT Filed: Oct. 31, 2003

(86) PCT No.: PCT/JP03/14042

§ 371 (c)(1),
(2), (4) Date: Sep. 28, 2005

(87) PCT Pub. No.: WO2004/088623

PCT Pub. Date: Oct. 14, 2004

(65) Prior Publication Data

US 2006/0245121 A1 Nov. 2, 2006

(30) Foreign Application Priority Data

Mar. 28, 2003 (JP) ..... 2003-092534
Jul. 30, 2003 (JP) ..... 2003-204018
Oct. 27, 2003 (JP) ..... 2003-366130

(51) Int. Cl.
*G09G 3/32* (2006.01)

(52) U.S. Cl. ..... 345/82; 345/76; 315/169.3

(58) Field of Classification Search ..... 345/76–83; 315/169.3

See application file for complete search history.

(56) References Cited

U.S. PATENT DOCUMENTS 5,952,789 A 9/1999 Stewart et al.
6,229,506 B1 * 5/2001 Dawson et al. ..... 345/82

(Continued)

FOREIGN PATENT DOCUMENTS

JP 10-319908 A 12/1998

(Continued)

OTHER PUBLICATIONS

International Search Report and International Preliminary Examination Report.

(Continued)

*Primary Examiner*—Alexander Eisen
*Assistant Examiner*—Stuart McCommas
(74) *Attorney, Agent, or Firm*—Harness, Dickey & Pierce, P.L.C.

(57) ABSTRACT

A switching transistor 3 is provided between a gate terminal of a driving TFT 1 and a drain terminal thereof. A first capacitor 2 is provided between the gate terminal of the driving TFT 1 and a source terminal thereof. The current control terminal of the driving TFT 1 is connected to a first terminal of a second capacitor 7. A second terminal of the second capacitor 7 is connected to the drain terminal of the driving TFT 1 via a switching transistor 9, and to a predetermined voltage line Va via a switching transistor 8. This allows restraint of variation of a current flowing, during a non-selection period, through a current driving light emitting element of a display apparatus, the current variation being caused by threshold voltage variation and mobility variation of the driving TFT. A specific example of the display apparatus including such a current driving light emitting element is an organic EL display apparatus.

20 Claims, 45 Drawing Sheets

U.S. PATENT DOCUMENTS

| | | | | |
|---|---|---|---|---|
| 6,859,193 | B1 * | 2/2005 | Yumoto | 345/82 |
| 2003/0043131 | A1 | 3/2003 | Iguchi | |
| 2003/0112208 | A1 | 6/2003 | Okabe et al. | |
| 2003/0117352 | A1 | 6/2003 | Kimura | |
| 2003/0201729 | A1 | 10/2003 | Kimura et al. | |
| 2003/0214469 | A1 | 11/2003 | Kageyama et al. | |
| 2003/0227262 | A1 | 12/2003 | Kwon | |
| 2004/0066358 | A1 | 4/2004 | Numao | |
| 2004/0080474 | A1 * | 4/2004 | Kimura | 345/82 |

FOREIGN PATENT DOCUMENTS

| | | | |
|---|---|---|---|
| JP | 2002-517806 | | 6/2002 |
| JP | 2002-351401 | A | 12/2002 |
| JP | 2003-58108 | A | 2/2003 |
| JP | 2003-76327 | A | 3/2003 |
| JP | 2003-323153 | | 11/2003 |
| JP | 2003-330415 | | 11/2003 |
| JP | 2004-029791 | | 1/2004 |
| JP | 2004-177926 | | 6/2004 |
| WO | WO 98/48403 | A1 | 10/1998 |
| WO | WO 99/65011 | | 12/1999 |
| WO | WO 99/65011 | A2 | 12/1999 |
| WO | WO 01/06484 | | 1/2001 |

OTHER PUBLICATIONS

M.T. Johnson et al., "Active Matrix PolyLED Displays," *IDW '00*, pp. 235-238.

Simon W-B. Tam et al., "Polysilicon TFT Drivers for Light Emitting Polymer Displays," *IDW '99*, pp. 175-178.

R.H. Friend, "Polymer Light-Emitting Diodes for use in Flat Panel Displays," *AM-LCD '01*, pp. 211-214.

Kazutaka Inukai et al., "36.4L: *Late-News Paper*. 4.0-in. TFT-OLED Displays and a Novel Digital Driving Method," *SID 00 Digest*, pp. 924-927.

Toru Takayama et al., "Continuous Grain Silicon Technology and Its Applications for Active Matrix Display," *AM-LCD '00*, pp. 25-28.

European Patent Office Search Report dated Mar. 27, 2009 for counterpart European Patent Application 03770115.8.

* cited by examiner

DISPLAY APPARATUS AND DRIVING METHOD THEREOF

TECHNICAL FIELD

The present invention relates to (i) a display apparatus using a current driving element, such as an organic EL (Electro Luminescence) display and an FED (Field Emission Display); and (ii) a method for driving the display apparatus.

BACKGROUND ART

What have been actively carried out in recent years are researches and developments for a current driving light-emitting element such as an organic EL display and an FED. Especially, the organic EL display is such a display that can emit light by a low voltage and less power consumption, so that the organic EL display has drawn attention as a display for a mobile device such as a mobile phone or a PDA (Personal Digital Assistants).

As a structure example of a current driving pixel circuit of such an organic EL display, FIG. 22 illustrates a circuit structure described in "Active Matrix PolyLED Displays" (M. T. Johnson et al., IDW '00, 2000, pp. 235-238) and WO 99/65011 (published Dec. 16, 1999).

In the circuit structure shown in FIG. 22, a driving TFT (Thin Film Transistor) 101 has a source terminal connected to a power source wire Vs, and has a gate terminal connected to the power source wire Vs via a capacitor 104. Moreover, a switching TFT 102 is provided between a drain terminal of the driving TFT 101 and an anode of an organic EL element 103. A cathode of the organic EL element 103 is connected to a common wire Vcom.

Further, a selection TFT 106 and a switching TFT 105 are provided at a node of the driving TFT 101 and the switching TFT 102. The selection TFT 106 has a source terminal connected to a source wire Sj. The switching TFT 105 has a source terminal connected to the gate terminal of the driving TFT 101.

In the structure, when a signal indicative of Low is supplied to a scan wire Gi (selection period), the switching TFT 102 becomes OFF, and the selection TFT 106 and the switching TFT element 105 becomes ON. In this case, a current can flow from the power source wire Vs to the source wire Sj via the driving TFT 101 and the selection TFT 106. In cases where the current thus flowing is controlled by a power source of a source driver circuit (not shown) connected to the source wire Sj, a gate voltage of the driving TFT element 101 is set such that a current specified by the source driver circuit flows into the driving TFT 101.

On the other hand, when the scan wire Gi receives a signal indicative of High (non-selection period), the selection TFT 106 and the switching TFT 105 become OFF, and the switching TFT 102 becomes ON. During this non-selection period, the capacitor 104 retains the gate potential, determined during the selection period, of the driving TFT element 101. With this, during the non-selection period, the driving TFT 101 allows the determined current to flow into the organic EL element 103.

As an example of a current driving pixel circuit structure similar to the above structure, FIG. 23 illustrates a pixel circuit structure described in "Polysilicon TFT Drivers for Light Emitting Polymer Displays" (Simon W-B. Tam et al., IDW '99, 1999, pp. 175-178) and WO 98/48403 (published on Oct. 29, 1998).

In the circuit structure shown in FIG. 23, a capacitor 111 is provided between a source terminal of a driving TFT 108 and a gate terminal thereof. Between the gate terminal of the driving TFT 108 and a drain terminal thereof, a switching TFT 112 is provided. The drain terminal of the driving TFT 108 is connected to an anode of an organic EL element 109. Further, a switching TFT 107 is provided between the source terminal of the driving TFT 108 and a power source wire Vs. Moreover, a selection TFT 110 is provided between the source terminal of the driving TFT 108 and a source wire Sj.

The selection TFT 110 has a gate terminal connected to a control wire Wi, and the switching TFT 107 has a gate terminal connected to a control wire Ri, and the switching TFT 112 has a gate terminal connected to a scan wire Gi.

The following explains an operation of the pixel circuit structure with reference to a timing chart shown in FIG. 24. The timing chart illustrates respective timings of supplying signals to the control wires Wi and Ri, the scan wire Gi, and the source wire Sj.

In FIG. 24, the selection period corresponds to a period of time from 0 to **3*t*1. During the selection period, the control wire Ri has a High (GH) potential, so that the switching TFT 107 is OFF. On this occasion, the control wire Wi has a Low (GL) potential, so that the selection TFT 110 is ON. With this, during the selection period, a current flows from the source wire Sj to the organic EL element 109 via the selection TFT 110 and the driving TFT 108**.

During a period of time from 0 to **2*t*1 within the selection period, the scan wire Gi has a High potential, so that the switching TFT 112 is ON. Accordingly, a current flows from (i) a source driver circuit (not shown) connected to the source wire Sj, to (ii) the organic EL element 109. This determines a gate potential of the driving TFT 108 such that a current specified by the source driver circuit flows into the organic EL element 109. During a period of time from 2*t*1 to 3*t*1, the switching TFT 112 is OFF; however, the gate potential of the driving TFT 108 is retained by the capacitor 111. This allows a current to flow from the source wire Sj to the organic EL element 109** during this period, too.

After the time **3*t*1 (non-selection period), the switching TFT 110 is OFF, and the switching TFT 107 is ON. With this, during the non-selection period, a determined current is controlled to flow from the power source wire Vs to the organic EL element 109**.

However, the following problem arises in the pixel circuit structure described in "Polysilicon TFT Drivers for Light Emitting Polymer Displays" (IDW '99, pp. 175-178). That is, variation in a threshold voltage of the driving TFT 108, and variation in mobility thereof cause variation in the current flowing into the organic EL element 109 during the non-selection period.

For the purpose of clarifying an adverse effect of such variation of the current, a simulation was carried out under the following five conditions shown in Table 1 below. The simulation found respective values of currents flowing to the organic EL element 109. The simulation result is shown in FIG. 25.

TABLE 1

| | Ioled(1) | Ioled(2) | Ioled(3) | Ioled(4) | Ioled(5) |
|---|---|---|---|---|---|
| Threshold voltage | Average value | Lower limit value | Upper limit value | Upper limit value | Lower limit value |
| Mobility | Average value | Lower limit value | Upper limit value | Lower limit value | Upper limit value |

In the simulation shown in FIG. 25, the selection period came every 0.24 ms. During an initial period of time from 0.27 ms to 0.51 ms, a current of 0.1 μA flowed to the source wire Sj. Thereafter, the current was increased by 0.1 μA every 0.24 ms until the current had a value of 0.9 μA. Then, the current was set at 0. After that, the current was increased again by 0.1 μA.

Specifically, a first selection period corresponds to a period of time from 0.27 ms to 0.30 ms. The current, which had a value of 0.1 μA and which was flowing to the source wire Sj during the selection period, determined the potential of the gate terminal of the driving TFT 108. This determined that the current of 0.1 μA flowed to the organic EL element 109 only during the selection period. Note that the gate potential on this occasion was retained during a following non-selection period continuing from 0.31 ms to 0.51 ms; however, the current flowing to the organic EL element 109 during the non-selection period varied in a range from 0.12 μA to 0.13 μA.

The variation found by the simulation is illustrated in FIG. 26 whose horizontal axis plots the respective currents (the respective ten currents of 0 to 0.9 μA) which flowed to the source wire Sj, and whose vertical axis plots respective currents which flowed to the organic EL element 109 during the non-selection periods, each of which came after each current supply to the source wire Sj. In FIG. 26, during the non-selection period coming after the supply of the current of 0.9 μA to the source wire Sj, the current that flowed through the organic EL element 109 varied in a range of about 0.95 μA to about 1.12 μA (increases by 5% to 24%).

Such variation is caused by a difference between (i) a source-drain voltage Vsd of the driving TFT 108 during the selection period (period of time from approximately 270 μs to approximately 300 μs), and (ii) a source-voltage Vsd during the non-selection period (period other than the selection period), as shown in FIG. 27. Note that FIG. 27 illustrates a result of a simulation carried out under the five conditions (see Table 2) of the threshold voltage and the mobility of the driving TFT 108. Note also that voltage values Vsg (1) through Vsg (5) respectively correspond to the conditions Ioled (1) through Ioled (5) (see Table 2), and that voltage values Vsd (1) through Vsg (5) respectively correspond to the conditions Ioled (1) through Ioled (5).

Namely, in the circuit structure shown in FIG. 23, the switching TFT 112 was ON upon the current writing (period of time from 0 to 2*t*1 in FIG. 24; period of time from about 270 μs to about 290 μs in FIG. 27) carried out during the selection period, so that each source-drain voltage Vsd coincided with each source-gate voltage Vsg, as shown in FIG. 27.

The source-gate potential Vsg that the driving TFT 108 had on this occasion was determined according to the threshold voltage of the driving TFT 108 and the mobility thereof. Specifically, comparing (i) a case where the threshold voltage is 1 V with (ii) a case where the threshold voltage is 2V, the source-gate voltages Vsg varies by on the order of 1V. In fact, the above simulation result shows that the source-gate voltage Vsg varied in a range from about 1.4 V to about 3.6 V when the current of 0.1 μA was supplied to the source wire Sj.

Thereafter, when the switching TFT 112 was turned OFF (at about 290 μs), the source-gate potential of the driving TFT 108 was retained; however, the source-drain voltage Vsd thereof was changed.

Especially after the pixel circuit was brought into the non-selection period (at about 300 μs), the source-drain voltage Vsd was changed to be approximately 6 V. The voltage Vsd is determined according to "applied-voltage/current property" of the organic EL element 109. The wording "applied-voltage/current property" refers to a property indicating a relation between the applied voltage and the current. In other words, the voltage Vsd is determined according to a voltage Voled required for the supply of the current of 0.1 μA to the organic EL element 109. In the simulation, the voltage Voled had such a property as to satisfy:

$$Voled = Vs - 6V$$

Further, the applied-voltage/current property of the organic EL element 109 is similar to a property of a diode (the current exponentially increases in response to the applied voltage). For this reason, even when the current flowing through the organic EL element 109 varies by several ten percent, the source-drain voltage of the driving TFT 108 does not vary greatly.

If the driving TFT 108 were an ideal TFT, the change of the source-drain voltage would never cause the change of the current flowing from the source terminal of the driving TFT 108 to the drain terminal thereof, in cases where the gate-source potential Vsg is constant, and where the source-drain voltage Vsd is larger than the gate-source potential Vsg. However, in an actual TFT, even in cases where a gate-source potential Vsg is constant, a current flowing from a source terminal of the TFT to a drain terminal thereof increases as a source-drain voltage Vsd increases, as shown in FIG. 28. Note that FIG. 28 illustrates a result of a simulation carried out under the five conditions (see Table 2) of the threshold and the mobility of the driving TFT 108. Note also that current values Itft (1) through Itft (5) respectively correspond to the conditions Ioled (1) through Ioled (5) (see Table 2).

The result shown in FIG. 28 indicates that the variation of the source-drain voltage Vsd upon the current writing causes the variation of the current flowing from the source to the drain during the non-selection period. This changes the current flowing through the organic EL element 109.

So, an examination was carried out in order to find such current variation between the source terminal of the driving TFT 108 and the drain terminal thereof, with the use of a circuit in which the driving TFT 108 and the organic EL element 109 are provided in series as shown in FIG. 29. The examination is carried out by simulating a current flowing through the organic EL element 109, in the following manner under the aforesaid five conditions of the threshold voltage and the mobility of the driving TFT 108. That is, the simulation is carried out by (i) applying, to the gate terminal of the driving TFT 108, the gate-source potential Vgd, obtained upon the current writing (see FIG. 27), of the driving TFT 108; and (ii) changing a power source voltage Vs−Vcom. A result of the simulation is shown in FIG. 30.

FIG. 30 shows a case of the gate-source potential Vgd upon the supply of a current of 0.5 μA to the source wire Sj. In this case, the potential of the source wire Sj upon the current writing (See FIG. 27) was changed according to each of the conditions of the threshold voltage of the driving TFT 108 and the mobility thereof. This determined that the current of 0.5 μA was supplied to the organic EL element 109. Therefore, the current flowing through the organic EL element 109 was changed, on condition that the potential of the power wire Vs is constant (16V).

In this way, the threshold voltage variation of the driving TFT, and the mobility variation thereof cause the variation of the source-drain voltage Vsd upon the current writing, with the result that the current flowing through the organic EL element varies during the non-selection period. Such a phenomenon occurs also in the pixel circuit structure shown in FIG. 22. As such, the conventional circuit structure suffers from such a problem that the threshold voltage variation of the driving TFT and the mobility variation thereof cause the variation of the current flowing through the organic EL element during the non-selection period.

The present invention is made to solve the problem, and its object is to provide a display apparatus that is able to restrain the variation of the current flowing through the organic EL element during the non-selection period, the variation of the current being caused by the threshold voltage variation of the driving TFT, and the mobility variation thereof.

DISCLOSURE OF INVENTION

As described above, a first display apparatus of the present invention includes: (1) a first switching transistor, provided between (i) a current control terminal of the driving transistor and (ii) a current output terminal of the driving transistor; (2) a first capacitor, connected to the current control terminal of the driving transistor; and (3) a second capacitor, having a first terminal and a second terminal, the first terminal being connected to the current control terminal of the driving transistor, the second terminal being connected to (i) the current output terminal of the driving transistor via a second switching transistor, and (ii) a predetermined voltage line via a third transistor.

A pixel circuit structure and a source driver circuit structure each using the above structure allows the following effect. That is, during an output current setting period of the driving transistor of the circuit, the first switching transistor is ON, and a predetermined current is supplied to the driving transistor, with the result that the driving transistor is caused to have a current control terminal potential (potential Vx) accommodating to threshold voltage variation of the driving transistor and mobility variation thereof. The current control terminal potential is retained by the first capacitor.

Also on this occasion, the first terminal of the first capacitor is electrically connected to the first terminal of the second capacitor. Therefore, by turning OFF the second switching transistor and turning ON the third switching transistor, the second terminal of the second capacitor is electrically connected to the predetermined voltage line (which has a constant potential Va allowing supply of the predetermined current). Moreover, this causes the second capacitor to retain a potential Va−Vx. These operations are carried out during a first period.

Next, the second switching transistor is turned ON, and the third switching transistor is turned OFF, with the result that the second terminal of the second capacitor is electrically connected to the current output terminal (a drain terminal or a source terminal of a TFT) of the driving transistor. In cases where the driving transistor has a default current output terminal potential Va, the driving transistor is caused to have the current control terminal potential (a gate potential of a TFT) Vx.

Thereafter, a desired current is supplied to the driving transistor, thereby changing the potential of the current control terminal (a gate terminal of a TFT) of the driving transistor. This determines the potential of the current control terminal (a gate terminal of a TFT), while the potential of the current input terminal of the driving transistor and the potential of the current output terminal thereof are substantially equal to each other irrespective of the threshold voltage variation and the mobility variation of the driving transistor.

Further, in a pixel circuit including the driving transistor, a supply of the predetermined current to the current driving light emitting element causes potential drops of the current driving light emitting element in the same manner. With this, while the potential of the current input terminal of the driving transistor is substantially equal to the potential of the current output terminal thereof, the potential of the current control terminal (a gate terminal of a TFT) of the driving transistor can be set such that the driving transistor outputs the predetermined current.

In the case of disconnecting the connection between the first capacitor and the second capacitor, the current control terminal potential of the driving transistor is retained by the first capacitor. On the other hand, in the case of maintaining the connection therebetween, the current control terminal potential of the driving transistor is retained by the first capacitor and the second capacitor. These operations are carried out during a second period.

Thereafter, during a non-selection period of the pixel circuit, the current input terminal-current output terminal potential of the driving transistor is changed; however, the changed potential is constant irrespective of the threshold voltage variation and the mobility variation of the driving transistor. This allows restraint of variation of a current flowing from the current input terminal of the driving transistor to the current output terminal thereof. As described above, a second display apparatus of the present invention includes: (1) a first switching transistor, provided between (i) a current control terminal of the driving transistor and (ii) a current input terminal of the driving transistor; (2) a first capacitor, connected to the current control terminal of the driving transistor; and (3) a second capacitor, having a first terminal and a second terminal, the first terminal being connected to the current control terminal of the driving transistor, the second terminal being connected to (i) the current input terminal of the driving transistor via a second switching transistor, and (ii) a predetermined voltage line via a third switching transistor.

A pixel circuit structure and a source driver circuit structure each using the above structure allows the following effect. That is, during an output current setting period of the driving transistor of the circuit, the first switching transistor is ON, and a predetermined current is supplied to the driving transistor, with the result that the driving transistor is caused to have a current control terminal potential (potential Vx) accommodating to threshold voltage variation of the driving transistor and mobility variation thereof. The current control terminal potential is retained by the first capacitor.

On this occasion, the first terminal of the first capacitor is electrically connected to the first terminal of the second capacitor. Therefore, by turning OFF the second switching transistor and turning ON the third switching transistor, the second terminal of the second capacitor is electrically connected to the predetermined voltage line (which has a constant potential Va allowing supply of the predetermined current). Moreover, this causes the second capacitor to retain a potential Va−Vx. These operations are carried out during a first period.

Next, the second switching transistor is turned ON, and the third switching transistor is turned OFF, with the result that the second terminal of the second capacitor is electrically connected to the current input terminal (a drain terminal or a source terminal of a TFT) of the driving transistor. In cases where the driving transistor has a default current input terminal potential Va, the driving transistor is caused to have the current control terminal potential (a gate potential of a TFT) Vx.

Thereafter, a desired current is supplied to the driving transistor, thereby changing the potential of the current control terminal (a gate terminal of a TFT) of the driving transistor. This determines the potential of the current control terminal (a gate terminal of a TFT), while the potential of the current input terminal of the driving transistor and the potential of the current output terminal thereof are substantially equal to each other irrespective of the threshold voltage variation and the mobility variation of the driving transistor.

Further, in a pixel circuit including the driving transistor, a supply of the predetermined current to the current driving light emitting element causes potential drops of the current driving light emitting element in the same manner. With this, while the potential of the current input terminal of the driving transistor is substantially equal to the potential of the current output terminal thereof, the potential of the current control terminal (a gate terminal of a TFT) of the driving transistor can be set such that the driving transistor outputs the predetermined current.

In the case of disconnecting the connection between the first capacitor and the second capacitor, the current control terminal potential of the driving transistor is retained by the first capacitor. On the other hand, in the case of maintaining the connection therebetween, the current control terminal potential of the driving transistor is retained by the first capacitor and the second capacitor. These operations are carried out during a second period.

Thereafter, during a non-selection period of the pixel circuit, the current input terminal-current output terminal potential of the driving transistor is changed; however, the changed potential is constant irrespective of the threshold voltage variation and the mobility variation of the driving transistor. This allows restraint of variation of a current flowing from the current input terminal of the driving transistor to the current output terminal thereof.

The aforementioned driving circuit structure is applicable to a pixel circuit structure for driving directly the current driving light emitting element, but may be applied to a source driver circuit for setting an output current of a driving transistor provided in a pixel circuit.

In cases where the driver circuit structure is used as the source driver circuit structure, the display apparatus may be arranged such that the first capacitor, the second capacitor, the first switching transistor, the second switching transistor, and the third switching transistor are provided in each source driver circuit.

In the case where the driver circuit structure is used as the source driver circuit structure, it is particularly preferable to provide, in a pixel circuit, another transistor for controlling a current that is to be supplied to a current driving light emitting element provided in the pixel circuit. An output current of the transistor in the pixel circuit is controlled by the driving transistor, a component of the source driver circuit.

On the other hand, in the case where the driver circuit structure is used as the pixel circuit structure, the display apparatus may be arranged such that the first capacitor, the second capacitor, the first switching transistor, the second switching transistor, and the third switching transistor are provided in each pixel circuit.

In the pixel circuit structure, the components, i.e., the first capacitor, the second capacitor, the first switching transistor, the second switching transistor, and the third switching transistor are all provided in the pixel circuit. With this, a conventional source driver circuit can be used as the source driver circuit for driving the pixel circuit.

This allows reduction of a stray capacitance between the first capacitor and the second capacitor, and the current writing period of the driving transistor can be accordingly shorter.

The display apparatus may be arranged such that: one or more of the first capacitor, the second capacitor, the first switching transistor, the second switching transistor, and the third switching transistor are provided in a pixel circuit, and the others are provided in a portion outside the pixel circuit, which portion includes a source driver circuit.

The structure allows restraint of an increase in the number of capacitors and transistors required for each pixel circuit, as compared with a pixel circuit in which all the components are provided. This is because one or more of the first capacitor, the second capacitor, and the first switching transistor, and the second switching transistor, and the third switching transistor are provided in the source driver circuit or the portion outside the pixel circuit. This makes it possible to obtain desired luminance in each unit area without greater emission of each organic EL element of a display apparatus employing the bottom emission structure (such a structure that light is emitted toward a transparent substrate having TFT elements), as compared with the conventional technique. On this account, the organic EL element can have a longer luminance half-life. In contrast, see a case of a display apparatus employing a top emission structure (such a structure that light is emitted toward a side opposite to a transparent substrate having TFT elements). In this case, the number of elements provided in a pixel never increases, so that each pixel size can be as small as a pixel size in the conventional technique.

Further, the display apparatus may be arranged such that: the current driving light emitting element, the driving transistor, and the first capacitor are provided in the pixel circuit; and the second capacitor, the first switching transistor, the second switching transistor, and the third switching transistor are provided in the source driver circuit or the portion outside the pixel circuit, the display apparatus further includes a connecting wire for connecting the current control terminal of the driving transistor to the first terminal of the second capacitor.

The above structure makes it possible to provide a specific structure of a display apparatus in which one or more of the first capacitor, the second capacitor, the first switching transistor, the second switching transistor, and the third switching transistor are provided in the source driver circuit or the portion outside the pixel circuit. Note that a stray capacitance tends to exist in the connecting wire for connecting the current control terminal of the driving transistor to the first terminal of the second capacitor. Therefore, the first capacitor is caused to have a capacitance equal to a total of the stray capacitance and the capacitance of the capacitor provided in the pixel.

For this reason, when the second capacitor has a small capacitance, the potential of the second terminal of the second capacitor is required to be increased. However, the great change in the potential of the second terminal of the second capacitor causes great variation of the source-drain potential of the driving transistor, so that this is not preferable. Therefore, the second capacitor is required to have a larger capacitance. This causes the current writing period of the driving transistor to be long.

In consideration of this, a circuit made up of the second capacitor and the first switching transistor is provided adjacent to the pixel so as to be shared with a plurality of pixel, even though this structure suffers from such a problem that: acquirement of desired luminance in each unit area requires more emission of the organic EL element due to the decrease of the pixel area.

For example, one structure made up of the second capacitor and the first switching transistor is provided for every two pixels. This makes it possible to shorten a length of the connecting wire for connecting the current control terminal of the driving transistor to the first terminal of the second capacitor.

As the result, the stray capacitance of the connecting wire can be restrained, so that the source-drain potential of the driving transistor does not vary greatly even when the second capacitor has a small capacitance. With this, the current writing period of the driving transistor can be shortened.

Further, the display apparatus may be arranged such that: the current driving light emitting element, the driving transistor, the first switching transistor, the first capacitor, and the second capacitor are provided in the pixel circuit; the second switching transistor and the third switching transistor are provided in the source driver circuit or the portion outside the pixel circuit; and the display apparatus further includes a connecting wire for connecting the second terminal of the second capacitor to (i) the current output terminal of the driving transistor, or (ii) the current input terminal of the driving transistor.

The above structure makes it possible to provide a specific structure of a display apparatus in which one or more of the first capacitor, the second capacitor, the first switching transistor, the second switching transistor, and the third switching transistor are provided in the source driver circuit or the portion outside the pixel circuit. Further, the display apparatus further includes:

an OFF potential line for supplying an OFF potential; wherein: the connecting wire is connected to the OFF potential line via a fourth switching transistor.

The above structure makes it possible to supply an OFF potential from the OFF potential line, via the fourth switching transistor and the connecting wire or the source wire, to a current control terminal of a driving transistor of a pixel to be brought into a dark state. The OFF potential surely turns OFF the driving transistor. This allows acquirement of sufficiently low luminance in the pixel in the dark state, thereby improving a contrast in the display apparatus.

Further, as described above, a first driving method of the present invention includes the steps of: (1) electrically connecting a current control terminal of the driving transistor to a first terminal of a first capacitor; (2) electrically connecting, during a current writing period of the driving transistor, the first terminal of the first capacitor to a first terminal of a second capacitor; (3) during a first period, (i) electrically connecting a second terminal of the second capacitor to a predetermined voltage line, and (ii) electrically connecting the current control terminal of the driving transistor to a current output terminal of the driving transistor, and (iii) causing the first capacitor and the second capacitor to retain a current control terminal potential that the driving transistor has on this occasion; (4) during a second period, (i) correcting the current control terminal potential by disconnecting the current control terminal of the driving transistor from the current output terminal of the driving transistor, and by changing electric connection of the second terminal of the second capacitor from the predetermined voltage line to the current output terminal of the driving transistor, and (ii) causing, during the second period, the first capacitor to retain the current control terminal potential that the driving transistor has on this occasion; and (5) controlling, during a current readout period of the driving transistor, an output current of the driving transistor with the use of the current control terminal potential, retained by the first capacitor, of the driving transistor.

The driving method allows the following effect. That is, during a first period within the output current setting period of the driving transistor of the pixel circuit and the source driver circuit, a predetermined current is supplied to the driving transistor, with the result that the driving transistor is caused to have a current control terminal potential (potential Vx) accommodating to threshold voltage variation of the driving transistor and mobility variation thereof. The current control terminal potential is retained by the first capacitor and the second capacitor. On this occasion, the first terminal of the first capacitor is electrically connected to the first terminal of the second capacitor. Therefore, the second terminal of the second capacitor is electrically connected to the predetermined voltage line (which has a constant potential Va allowing supply of the predetermined current). This causes the second capacitor to retain a potential Va−Vx.

Next, the second terminal of the second capacitor is electrically connected to the current output terminal (a drain terminal or a source terminal of a TFT) of the driving transistor. In cases where the driving transistor has a current output terminal potential Va on this occasion, the driving transistor is caused to have the current control terminal potential (a gate potential of a TFT) Vx.

Thereafter, a desired current is supplied to the driving transistor, thereby changing the potential of the current control terminal (a gate terminal of a TFT) of the driving transistor. This determines the potential of the current control terminal (a gate terminal of a TFT), while the potential of the current input terminal of the driving transistor and the potential of the current output terminal thereof are substantially equal to each other irrespective of the threshold voltage variation and the mobility variation of the driving transistor. Further, a supply of the predetermined current to the current driving light emitting element causes potential drops of the current driving light emitting element in the same manner. With this, while the potential of the current input terminal of the driving transistor is substantially equal to the potential of the current output terminal thereof, the potential of the current control terminal (a gate terminal of a TFT) of the driving transistor can be set such that the driving transistor outputs the predetermined current.

In the case of disconnecting the connection between the first capacitor and the second capacitor, the current control terminal potential that the driving transistor has on this occasion is retained by the first capacitor. On the other hand, in the case of maintaining the connection therebetween, the current terminal potential of the driving transistor is retained by the first capacitor and the second capacitor.

Thereafter, during the current readout period of the driving transistor, the current input terminal-current output terminal potential of the driving transistor is changed; however, the changed potential is constant irrespective of the threshold voltage variation and the mobility variation of the driving transistor. This allows restraint of variation of a current flowing from the current input terminal of the driving transistor to the current output terminal thereof.

Further, a second driving method of the present invention includes the steps of: (1) electrically connecting a current control terminal of the driving transistor to a first terminal of a first capacitor; (2) electrically connecting, during a current writing period of the driving transistor, the first terminal of the first capacitor to a first terminal of a second capacitor; (3) during a first period, (i) electrically connecting a second terminal of the second capacitor to a predetermined voltage line, and (ii) electrically connecting the current control terminal of the driving transistor to a current input terminal of the driving transistor, and (iii) causing the first capacitor and the second capacitor to retain a current control terminal potential that the driving transistor has on this occasion; (4) during a second period, (i) correcting the current control terminal potential by disconnecting the current control terminal of the driving transistor from the current input terminal of the driving transistor, and by changing electric connection of the second terminal of the second capacitor from the predetermined voltage line to the current input terminal of the driving transistor, and (ii) causing the first capacitor to retain the current control terminal potential that the driving transistor has on this occasion; and (5) controlling, during a current readout period of the driving transistor, an output current of the driving transistor with the use of the current control terminal potential, retained by the first capacitor, of the driving transistor.

The driving method allows the following effect. That is, during a first period within the output current setting period of the driving transistor of the pixel circuit and the source driver circuit, a predetermined current is supplied to the driving transistor, with the result that the driving transistor is caused to have a current control terminal potential (potential Vx) accommodating to threshold voltage variation of the driving transistor and mobility variation thereof. The current control terminal potential is retained by the first capacitor and the second capacitor. On this occasion, the first terminal of the first capacitor is electrically connected to the first terminal of the second capacitor. Therefore, the second terminal of the second capacitor is electrically connected to the predetermined voltage line (which has a constant potential Va allowing supply of the predetermined current). This causes the second capacitor to retain a potential Va−Vx.

Next, the second terminal of the second capacitor is electrically connected to the current input terminal (a drain terminal or a source terminal of a TFT) of the driving transistor. In cases where the driving transistor has a current input terminal potential Va on this occasion, the driving transistor is caused to have the current control terminal potential (a gate potential of a TFT) Vx.

Thereafter, a desired current is supplied to the driving transistor, thereby changing the potential of the current control terminal (a gate terminal of a TFT) of the driving transistor. This determines the potential of the current control terminal (a gate terminal of a TFT), while the potential of the current input terminal of the driving transistor and the potential of the current output terminal thereof are equal to each other irrespective of the threshold voltage variation and the mobility variation of the driving transistor.

Further, in cases where the driving transistor is provided in the pixel circuit, the supply of the predetermined current to the current driving light emitting element causes potential drops of the current driving light emitting element in the same manner. With this, while the potential of the current input terminal of the driving transistor is substantially equal to the potential of the current output terminal thereof, the potential of the current control terminal (a gate terminal of a TFT) of the driving transistor can be set such that the driving transistor outputs the predetermined current.

In the case of disconnecting the connection between the first capacitor and the second capacitor, the current control terminal potential of the driving transistor is retained by the first capacitor. On the other hand, in the case of maintaining the connection therebetween, the current terminal potential of the driving transistor is retained by the first capacitor and the second capacitor.

Thereafter, during the non-selection period of the pixel circuit, the current input terminal-current output terminal potential of the driving transistor is changed; however, the changed potential is constant irrespective of the threshold voltage variation and the mobility variation of the driving transistor. This allows restraint of variation of a current flowing from the current input terminal of the driving transistor to the current output terminal thereof.

As such, the first and second driving methods of the present invention are beneficial in reducing the difference between (i) the current flowing during the current writing period of the driving transistor constituting the pixel circuit, and (ii) the current flowing during the current readout period of thereof. Moreover, the methods are beneficial in reducing the difference between (i) the current flowing during the current writing period of the driving transistor constituting the source driver, and (ii) the current flowing during the current readout period of thereof.

In the latter case, a display by the current driving light emitting element can be uniformly carried out by supplying, to the current driving light emitting element, an output current of each transistor (each transistor, other than the driving transistor, for controlling current supply to the current driving light emitting element of each pixel circuit), which output current is as large as the current flowing through the driving transistor. The transistors and the light emitting element are provided in a matrix manner.

Further, in the first and second driving methods of the present invention, when the second terminal of the second capacitor has the aforesaid potential Va during the second period, the potential of the current control terminal (gate terminal of the TFT) of the driving transistor is caused to have the aforesaid potential Vx. For this reason, it is preferable that: the second terminal of the second capacitor stay electrically connected to the predetermined voltage line even after the start of the second period, and then the electric connection be disconnected. This shortens time taken for the second terminal of the second capacitor to have the final potential. Accordingly, a larger number of gate wires can be driven, with result that a larger number of pixels can be used for a display.

Specifically, the second terminal of the second capacitor will have a final potential as large as the potential Va of the predetermined voltage line. Therefore, the time taken for the acquirement of such a final potential can be shortened by causing the second terminal of the second capacitor to have a potential Va in advance.

This is a preferable driving example of the driving methods of the present invention. See a case where the driving example is applied to the first driving method. That is, the electric connection is disconnected between the current control terminal of the driving transistor and the current output terminal thereof, and then the second terminal of the second capacitor is electrically connected to the current output terminal of the driving transistor while maintaining the electric connection with the predetermined voltage line. The maintained electric connection with the predetermined voltage line causes the second terminal of the second capacitor to have a potential as large as the potential Va of the predetermined voltage line. After this, the second terminal of the second capacitor is electrically disconnected from the predetermined voltage line.

On the other hand, see a case where the driving example is applied to the second driving method. That is, the electric connection is disconnected between the current control terminal of the driving transistor and the current input terminal thereof, and then the second terminal of the second capacitor is electrically connected to the current input terminal of the driving transistor while maintaining the electric connection with the predetermined voltage line. The maintained electric connection with the predetermined voltage line causes the second terminal of the second capacitor to have a potential as large as the potential Va of the predetermined voltage line. After this, the second terminal of the second capacitor is electrically disconnected from the predetermined voltage line.

Additional objects, features, and strengths of the present invention will be made clear by the description below. Further, the advantages of the present invention will be evident from the following explanation in reference to the drawings.

BEST MODE FOR CARRYING OUT THE INVENTION

Embodiments of the present invention will be explained with reference to FIG. 1 through FIG. 21, and FIG. 31 through FIG. 45. Note that the present invention is not limited to these.

Note also that each switching element used in the present invention may be a low temperature polysilicon TFT or a CG (Continuous Grain) silicon TFT; however, Embodiments below uses the CG silicon TFT.

Here, a structure of such a CG silicon TFT is described in, for example, "4.0-in. TFT-OLED Displays and a Novel Digital Driving Method" (SID'00 Digest, pp. 924-927, Semiconductor Energy Laboratory Co., Ltd). Moreover, a manufacturing process of such a CG silicon TFT is described in, for example, "Continuous Grain Silicon Technology and Its Applications for Active Matrix Display" (AM-LCD 2000, pp. 25-28, Semiconductor Energy Laboratory Co., Ltd). That is, the structure and the manufacturing process of the CG silicon TFT are publicly well-know, so that detailed explanation thereof is omitted here.

Further, a structure of each organic EL element, used in Embodiments and serving as an electric optical element, is described in, for example, "Polymer Light-Emitting Diodes for use in Flat panel Display" (AM-LCD '01, pp. 211-214, Semiconductor Energy Laboratory Co., Ltd). Therefore, the structure is publicly well-known, so that detailed explanation thereof is omitted here.

Embodiment 1

Embodiment 1 will explains a case where a first characteristic structure according to the present invention is applied to a pixel circuit.

Figure 1:
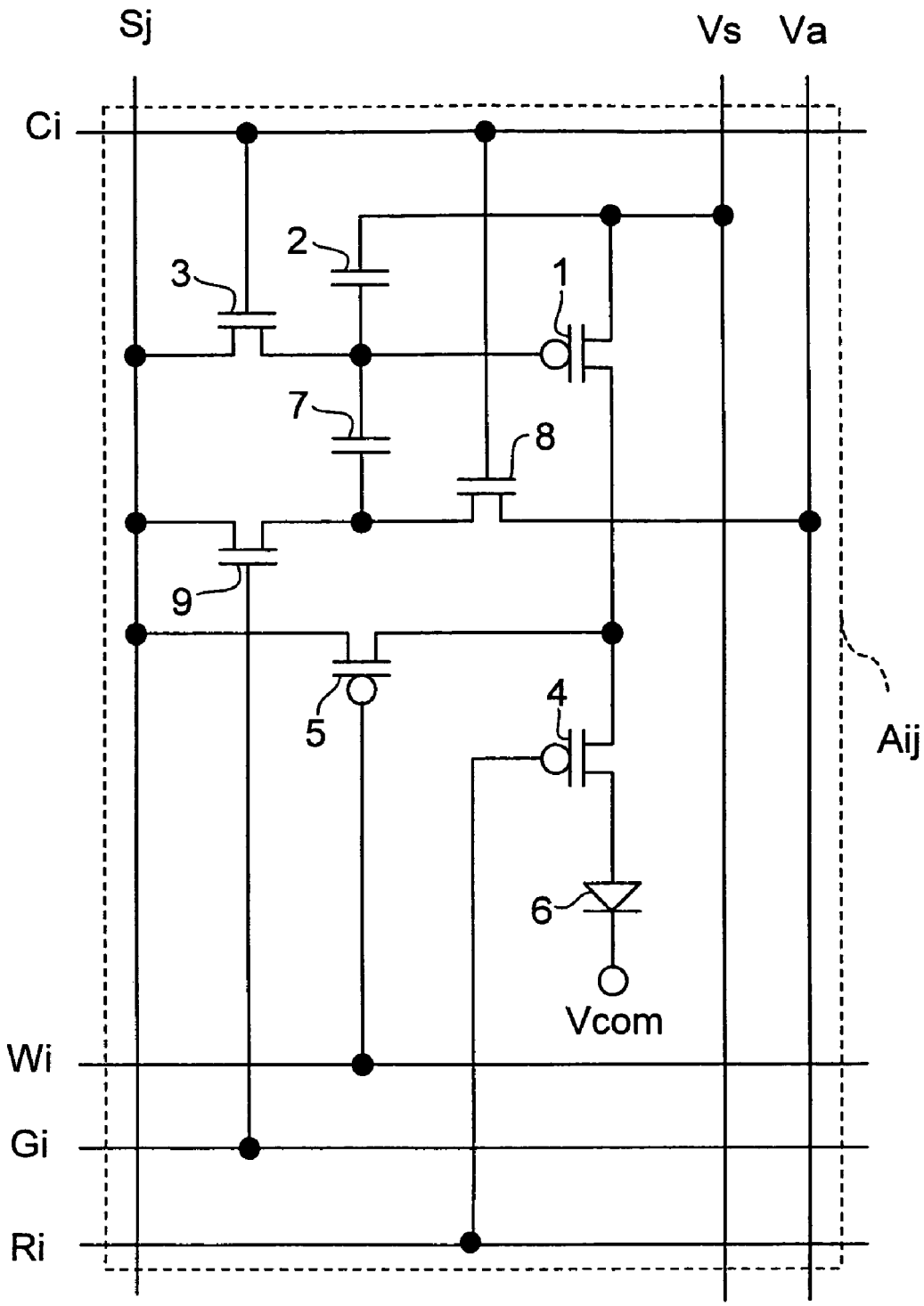
FIG. 1 illustrates one embodiment of the present invention, and is a circuit diagram illustrating a structure of a pixel circuit of a display apparatus according to Embodiment 1.

As shown in FIG. 1, in each of pixel circuits Aij of a display apparatus according to Embodiment 1, a driving TFT 1 is provided in series with a organic EL element (current driving light-emitting element) 6 between a power source wire Vs and a common wire Vcom. The driving TFT 1 serves as a driving TFT, and the organic EL element 6 serves as an electric optical element. The driving TFT 1 controls a current that is to be supplied to the organic EL element 6.

The driving TFT 1 has a gate terminal (current control terminal) connected to a source wire Sj via a switching TFT 3, serving as a first switching transistor. Moreover, the gate terminal (current control terminal) of the driving TFT 1 is connected to one terminal of a first capacitor 2, and to one terminal of a second capacitor 7. The other terminal of the first capacitor 2 is connected to (i) a source terminal (current input terminal) of the driving TFT 1 and (ii) the power source wire Vs. The other terminal of the second capacitor 7 is connected to a predetermined voltage line Va via a switching TFT 8, which serves as a third switching transistor. Moreover, the other terminal of the second capacitor 7 is connected to the source wire Sj via a switching TFT 9, which serves as a second switching transistor. Note that, the following explanation assumes that a first terminal of the first capacitor 2 refers to its terminal connected to the gate terminal of the driving TFT 1, and a second terminal of the first capacitor 2 refers to the other terminal of the first capacitor 2; and that a first terminal of the second capacitor 7 refers to its terminal connected to the gate terminal of the driving TFT 1, and a second terminal of the second capacitor 7 refers to the other terminal of the second capacitor 7.

Respective gate terminals of the switching TFT 3 and the switching TFT 8 are connected to a control wire Ci, and a gate terminal of the switching TFT 9 is connected to a control wire Gi.

A switching TFT 4 is provided between (i) a drain terminal (current output terminal) of the driving TFT 1, and (ii) an anode of the organic EL element 6. The switching TFT 4 has a gate terminal connected to a control wire Ri. A node of the driving TFT 1 and the switching TFT 4 is connected to the source wire SJ via a switching TFT 5. The switching TFT 5 has a gate terminal connected to a control wire Wi.

Any of the control wires Ci, Gi, and Wi may serve as a second wire (gate wire), and any of the switching TFTs 3, 9, and 5 may serve as a selection TFT. Note that, in the present embodiment, the control wire Gi is also referred to as "gate wire Gi".

In the circuit structure, the gate terminal of the driving TFT 1 is connected to the drain terminal thereof via The switching TFT 3, the source wire Sj, and the switching TFT 5. Further, the second terminal of the second capacitor 7 is connected to the drain terminal of the driving TFT 1 via the switching TFT 9, the source wire Sj, and the switching TFT 5.

As such, the means of the present invention encompasses not only a case where the switching TFT 3 serving as the first switching TFT directly connects the current control terminal of the driving TFT to the current output terminal thereof, but also a case where the switching TFT 3 indirectly connects the current control terminal of the driving TFT to the current output terminal thereof via the source wire Sj and the switching TFT 5.

Likewise, the means of the present invention encompasses not only a case where the switching TFT 9 serving as the second switching TFT directly connects the second terminal of the second capacitor to the current output terminal of the driving TFT, but also a case where the switching TFT 9 indirectly connects the second terminal of the second capacitor to the current output terminal of the driving TFT via the source wire Sj and the switching TFT 5.

Figure 2:
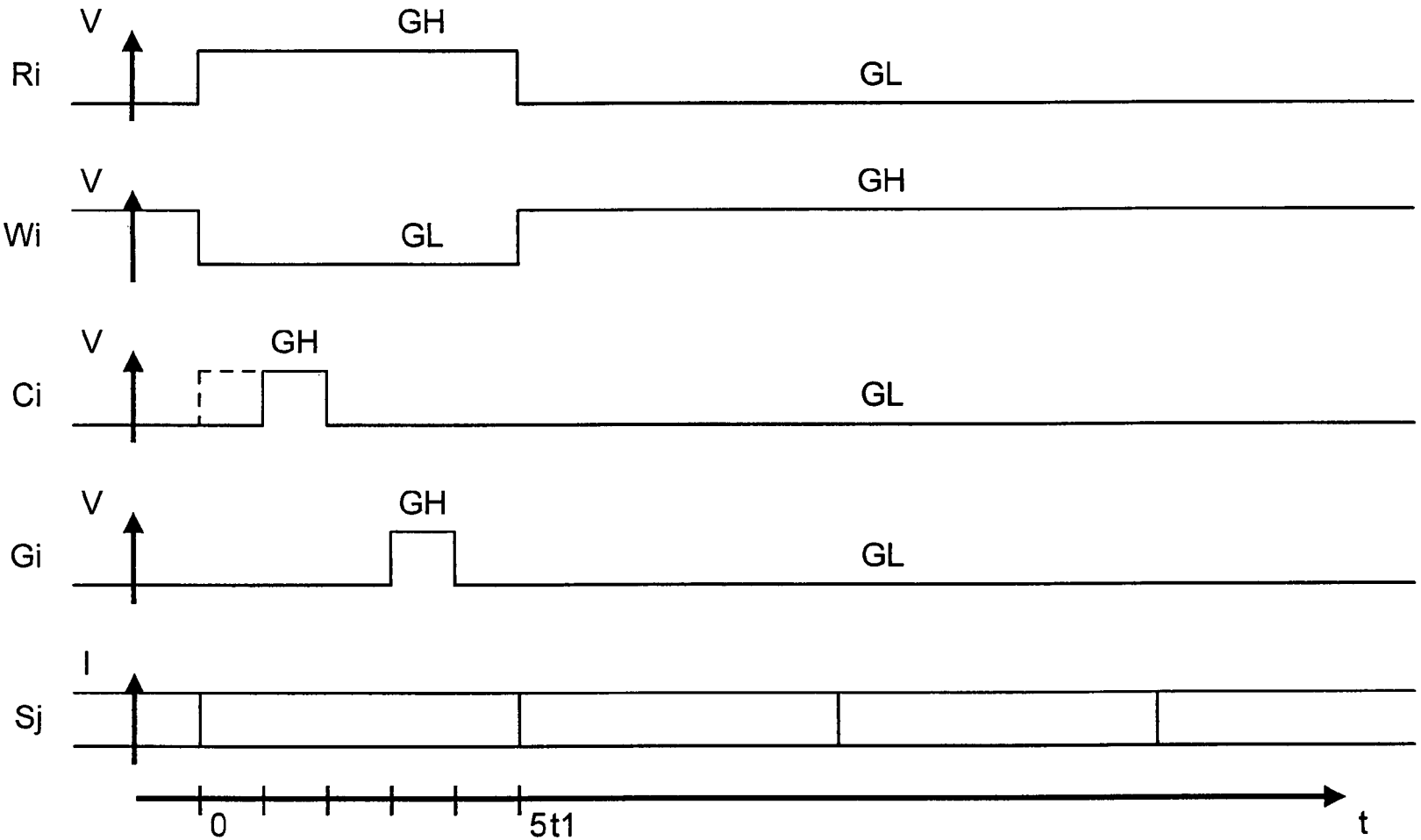
FIG. 2 is a wave form chart illustrating respective operation timings of control wires of the pixel circuit.

The following explains an operation of the pixel circuit Aij of the display apparatus with reference to FIG. 2. FIG. 2 illustrates respective operation timings of the control wires Ri, Wi, Ci, and Gi, and the source wire Sj.

In a driving method according to Embodiment 1 (first driving method of the present invention), during a selection period (i.e., a current writing period of the driving transistor) corresponding to a period of time from 0 to **5*t*1, a potential of the control wire Ri is set at High (GH) such that the switching TFT 4 is OFF, and a potential of the control wire Wi is set at Low (GL) such that the switching TFT 5** is ON.

During a first period (time t1 to time **2*t*1), a potential of the control wire Ci is set at High such that the switching TFTs 3 and 8 are ON. This connects the gate terminal (current control terminal) of the driving TFT 1 to the drain terminal (current output terminal) thereof via the switching TFTs 3 and 5. Moreover, this connects the second terminal of the second capacitor 7 to the predetermined voltage line Va via the switching TFT 8. Accordingly, a current is constantly supplied from the power source wire Vs to a source driver circuit (not shown) via the driving TFT 1, the switching TFT 5**, the source wire Sj.

Note that the first period may start from the time 0 as a broken line in FIG. 2 indicates.

Thereafter (at the time 2*t*1), the potential of the control wire Ci is set at Low such that the switching TFTs 3 and 8 become OFF. This is done to prevent the switching TFTs 3 and 9 from becoming ON simultaneously. Such an OFF operation actually requires time shorter than t1. At the moment of the turning OFF, the first capacitor 2 and the second capacitor 7 retains the potential, determined during the first period, of the source wire Sj.

Next, during a second period (time 3*t*1 to time 4*t*1), the potential of the control wire Gi is set at High such that the switching TFT 9 is ON. This connects the second terminal of the second capacitor 7 to the drain terminal of the driving TFT 1 via the switching TFTs 9 and 5. Accordingly, a predetermined current is supplied from the power source wire Vs to the source driver circuit (not shown) via the driving TFT 1, the switching TFT 5, and the source wire Sj.

The source-gate potential of the driving TFT 1 is determined in this way during the second period. Then (at time 4*t*1), the potential of the control wire Gi is set at Low such that the switching TFT 9 becomes OFF. This causes the first capacitor 2 and the second capacitor 7 to retain the source-gate potential of the driving TFT 1. Note that a period of time from 4*t*1 to 5*t*1 after this, i.e., a period of time until the control wire Ri becomes Low and the control wire Wi becomes High is secured such that the selection period is finished after the switching TFT 9 surely becomes OFF. For this reason, this period may be shorter than t1.

Figure 3:
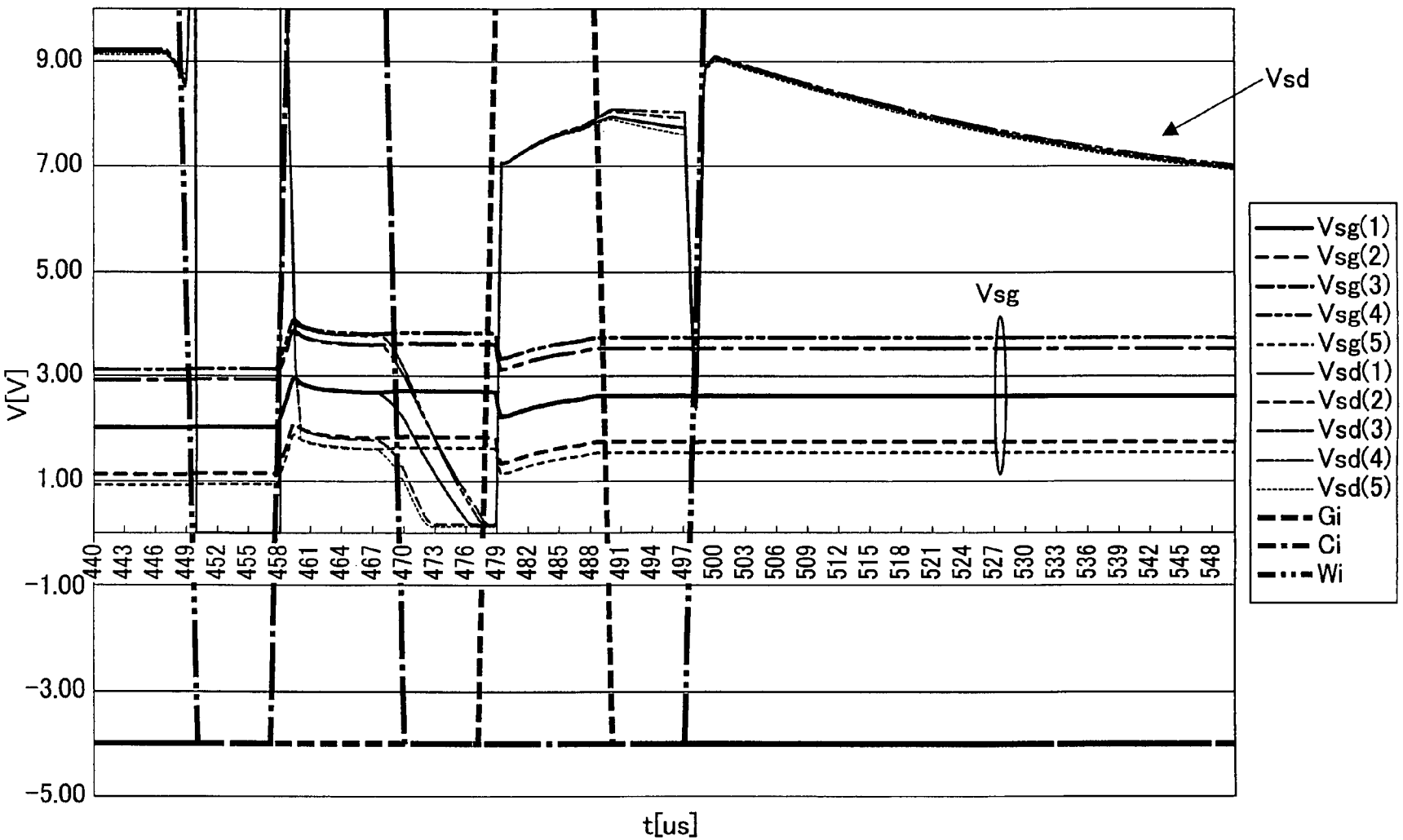
FIG. 3 is a graph illustrating a result of a simulation of respective changes of (i) a source-gate potential and (ii) a source-drain potential of a driving TFT of the pixel circuit.

Now, the selection period of the pixel circuit Aij is over, and then a following pixel circuit A(i+1)j is selected. Here, FIG. 3 illustrates a result of simulating respective changes in (i) the source-gate potential Vsg of the driving TFT 1 of the pixel circuit Aij, and (ii) the source-drain potential Vsd thereof. Note that source-drain potentials Vsd (1) through Vsd (5), and source-gate potentials Vsg (1) through Vsg (5) respectively correspond to the following conditions (see Table 2 below) of the threshold voltage of the driving TFT 1, and of the mobility property thereof.

TABLE 2

| | Ioled(1) Vsg(1) Vsd(1) | Ioled(2) Vsg(2) Vsd(2) | Ioled(3) Vsg(3) Vsd(3) | Ioled(4) Vsg(4) Vsd(4) | Ioled(5) Vsg(5) Vsd(5) |
|---|---|---|---|---|---|
| Threshold voltage | Average value | Lower limit value | Upper limit value | Upper limit value | Lower limit value |
| Mobility | Average value | Lower limit value | Upper limit value | Lower limit value | Upper limit value |

In FIG. 3, a period of time from 460 μs to 470 μs corresponds to the aforesaid first period. As shown in FIG. 3, the source-drain potentials Vsd (1) through Vsd (5) coincided with the source-gate potential Vsg (1) through Vsg (5), respectively.

Further, a period of time from 480 μs to 490 μs in FIG. 3 corresponds to the aforesaid second period. As shown in FIG. 3, the source-drain potentials Vsd had almost the same value during the period, irrespective of the differences in the conditions of the threshold voltage and the mobility of the driving TFT 1.

The reason of this is as follows. That is, during the foregoing first period, the second terminal of the second capacitor 7 was connected to the predetermined voltage line Va having a constant potential Va, and then the second terminal was connected to the drain terminal of the driving TFT 1. This caused the first capacitor and the second capacitor to store a charge allowing the driving TFT 1 to have, when the source-drain potential of the TFT 1 was Vs−Va, a source-gate potential equal to the source-gate potential (see FIG. 12) that the driving TFT 1 had during the first period.

This made it possible to cause the driving TFT 1 to have, when the source-drain potential of the driving TFT 1 was the potential Vs−Va, a source-gate potential equal to the source-gate potential that the driving TFT 1 had during the first period, irrespective of the threshold voltage variation and the mobility variation of the driving TFT 1. With the driving TFT 1 thus set, a predetermined current was supplied from the power wire Vs to the source driver circuit (not shown) via the driving TFT 1, the switching TFT 5, and the source wire Sj. A source-gate potential Vsg resulting from the current supply allowed a current to constantly flow through the driving TFT 1, irrespective of the threshold voltage variation and the mobility variation of the driving TFT 1, as long as the source-drain potential of the driving TFT 1 was constant.

Thereafter, during a non-selection period (i.e., current readout of the driving transistor; time at and after approximately 500 μs), the source-drain potentials of the driving TFT 1 were changed as shown in FIG. 3. Although the current values were different to some extent, the potential drops occurred in substantially the same manner. This is because the organic EL element 6, which is a load of the driving TFT 1, has a diode-like property. With this, the potential of the drain terminal of the driving TFT 1 was substantially constant irrespective of the threshold voltage variation and the mobility variation of the driving TFT 1. Accordingly, the source-drain voltage of the driving TFT 1 became constant. This allowed a restraint of the variation of the current flowing through the organic EL element, irrespective of the threshold voltage and the mobility of the driving TFT 1.

Note that, it is preferable that the constant potential Va is set at a value (an anode potential, which corresponds to the current, of the organic EL) predictable from an applied-voltage/current property of the organic EL element 6. With this, the source-drain voltage of the driving TFT 1 upon the current writing therein becomes substantially equal to the source-drain voltage upon the current readout therefrom.

A simulation was carried out to find the current flowing through the organic EL element 6. A result of the simulation is shown in FIG. 4 and FIG. 5.

Figure 4:
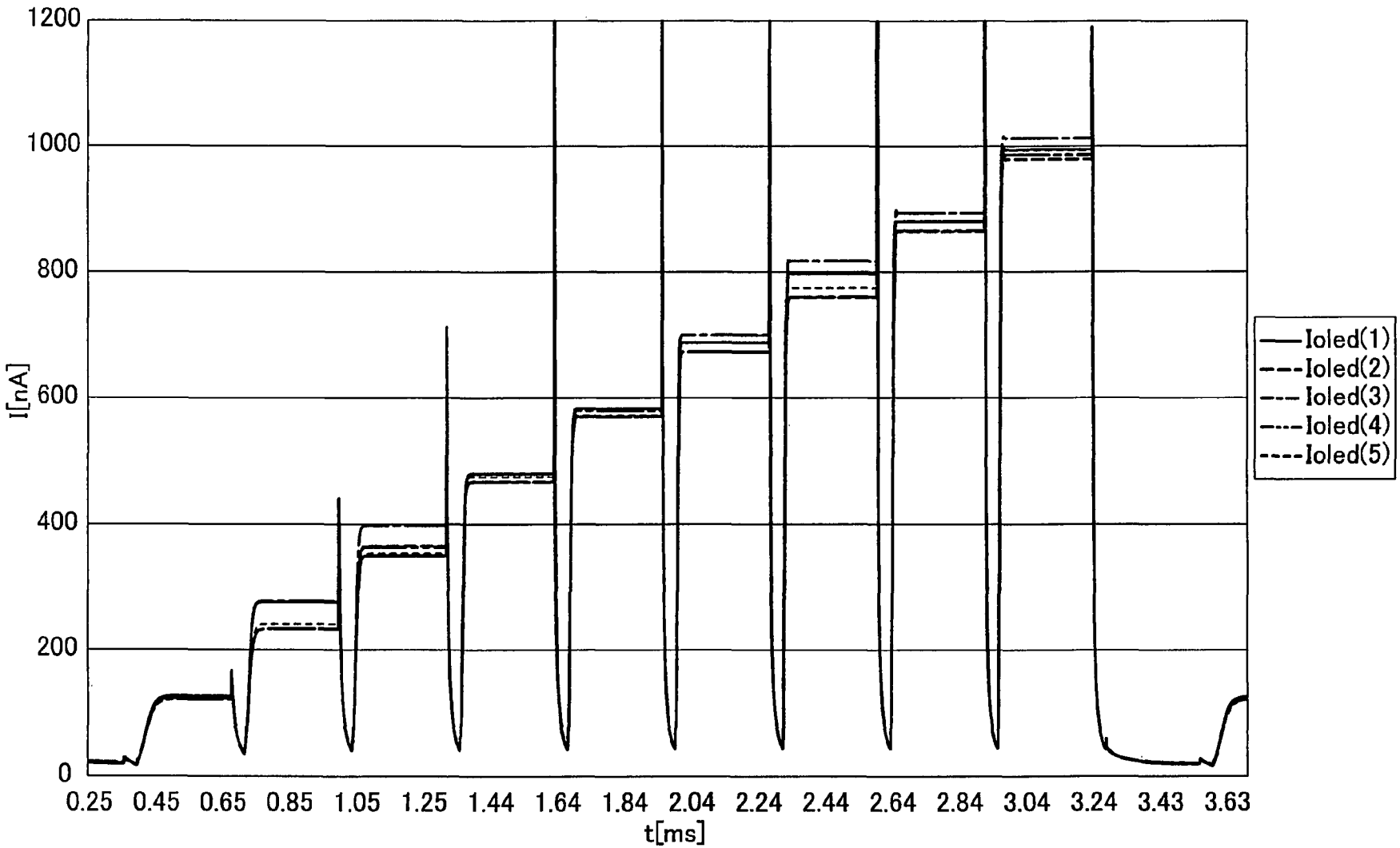
FIG. 4 is a graph illustrating a result of simulating a current flowing through an organic EL element in the pixel circuit.

In the simulation shown in FIG. 4, the selection period came every 0.32 ms. During an initial period of time from 0.35 ms to 0.67 ms, a current of 0.1 μA was set to flow into the source wire Sj. Thereafter, the current was increased by 0.1 μA every 0.32 ms until the current had a value of 0.9 μA. Then, the current was set at 0. After that, the current was increased again by 0.1 μA.

Figure 5:
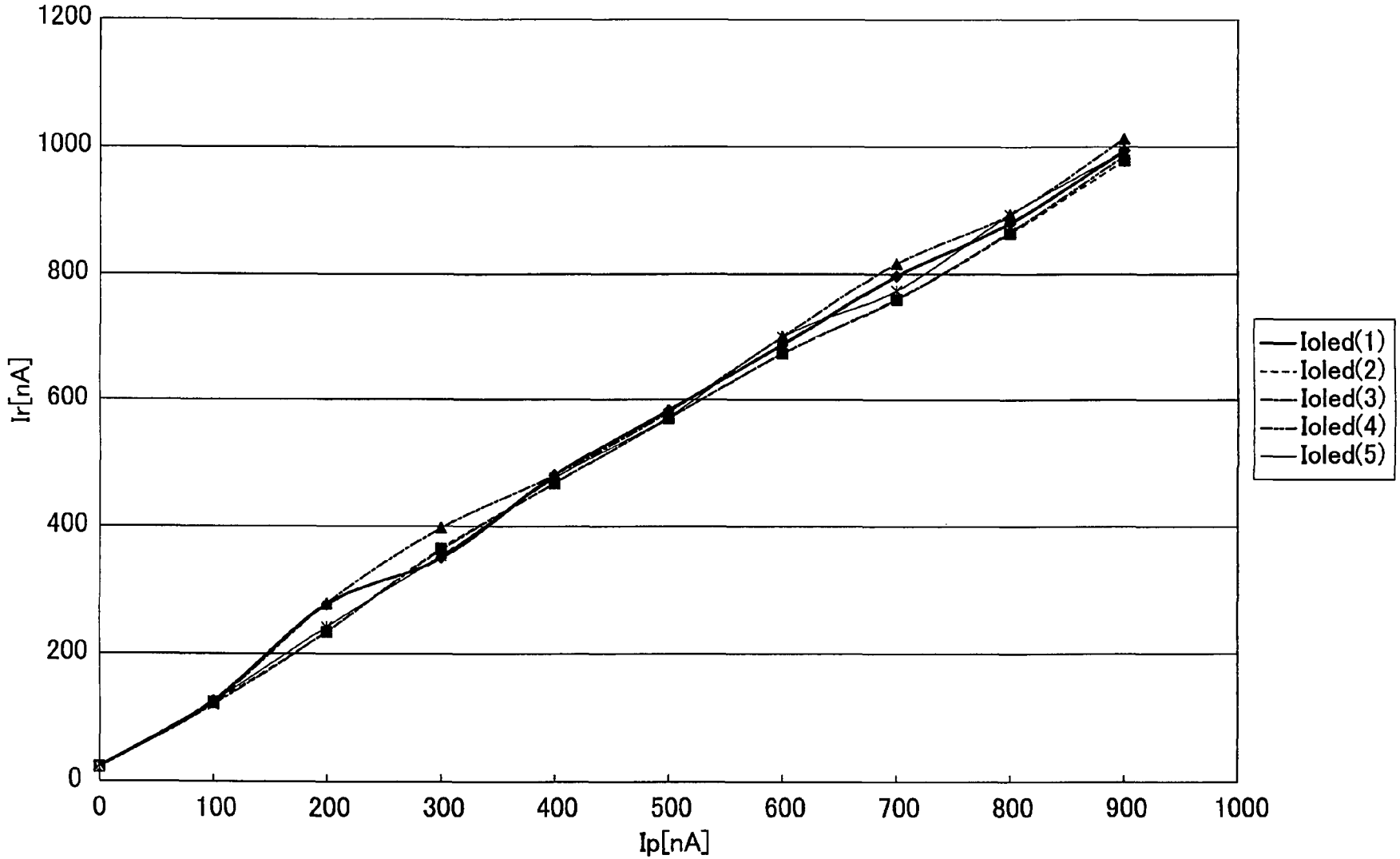
FIG. 5 is a graph illustrating a result of simulating a current flowing through an organic EL element in the pixel circuit.

The current variation found by the simulation is illustrated in FIG. 5 whose horizontal axis plots the respective currents (the respective ten currents of 0 μA to 0.9 μA) that flowed to the source wire Sj, and whose vertical axis plots respective currents that flowed to the organic EL element 6 during each non-selection period, which came after each current supply to the source wire Sj. In FIG. 5, during the non-selection period coming after the supply of the current of 0.9 μA to the source wire Sj, the current that flowed through the organic EL element varies in a range of about 0.97 μA to about 1.01 μA (increased by 8% to 13%).

Figure 26:
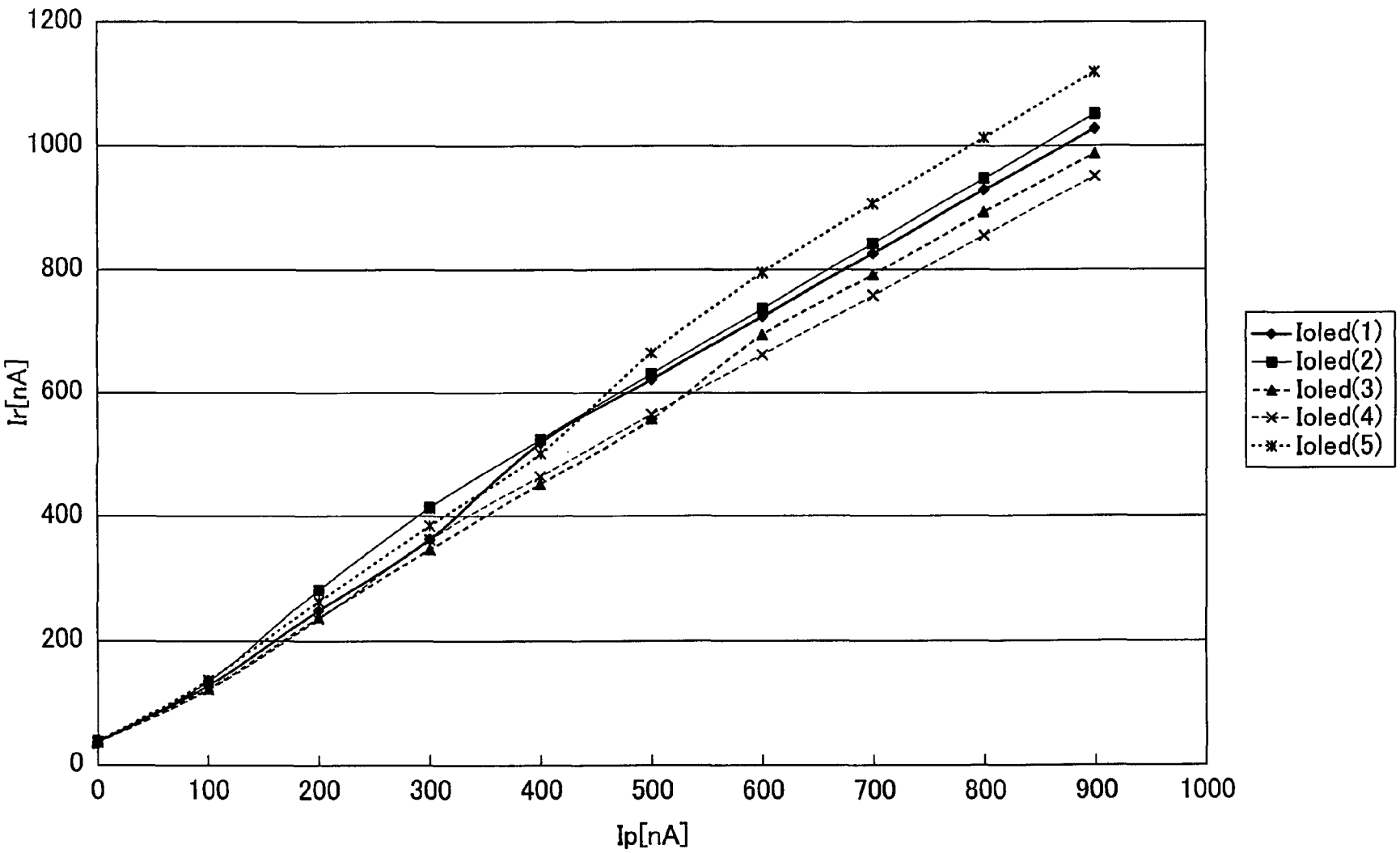
FIG. 26 is a graph illustrating a result of simulating a current flowing through an organic EL element in the conventional pixel circuit.
Figure 27:
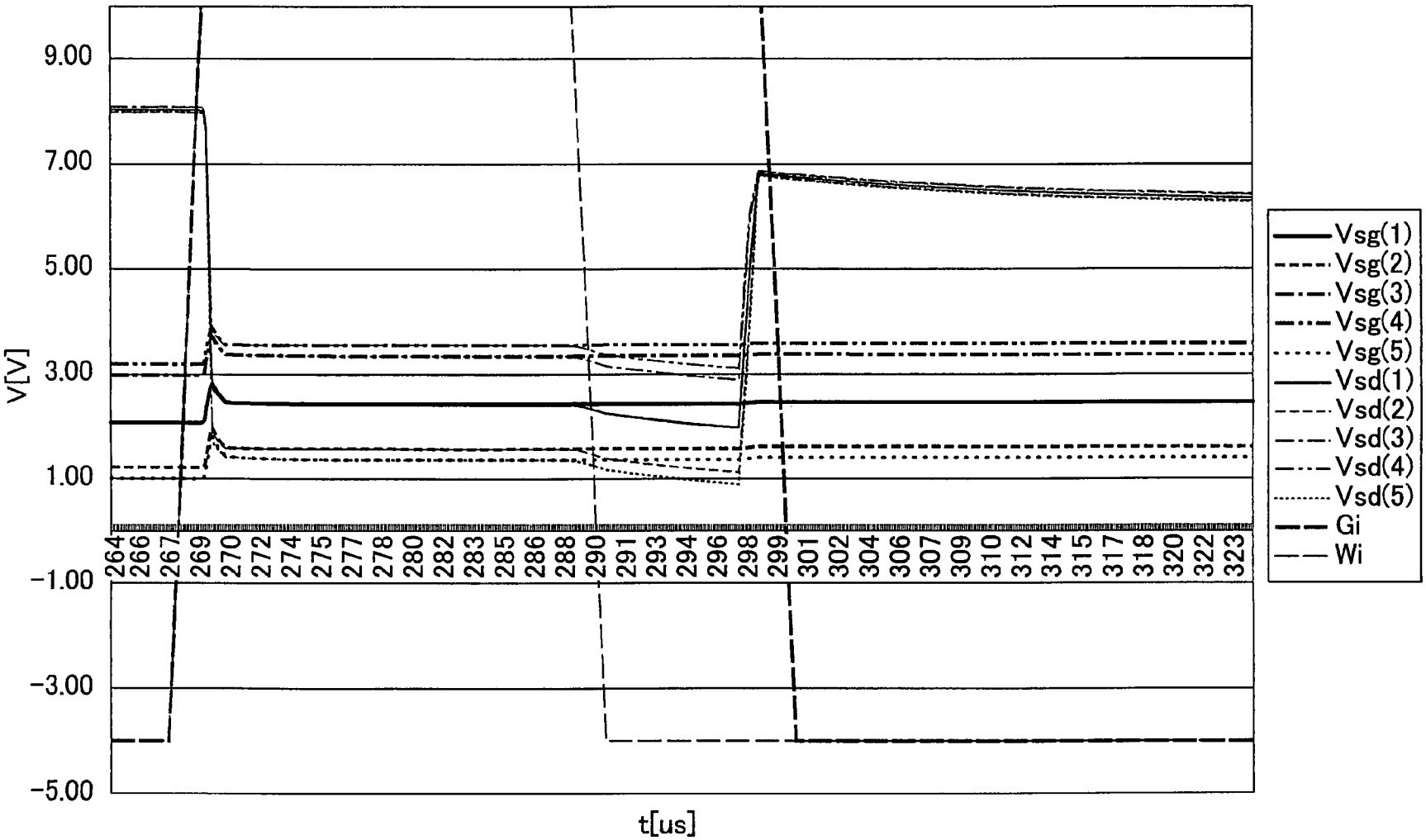
FIG. 27 is a graph illustrating a result of simulating respective changes in a source-gate potential and a source-drain potential of a driving TFT in the conventional pixel circuit.
Figure 28:
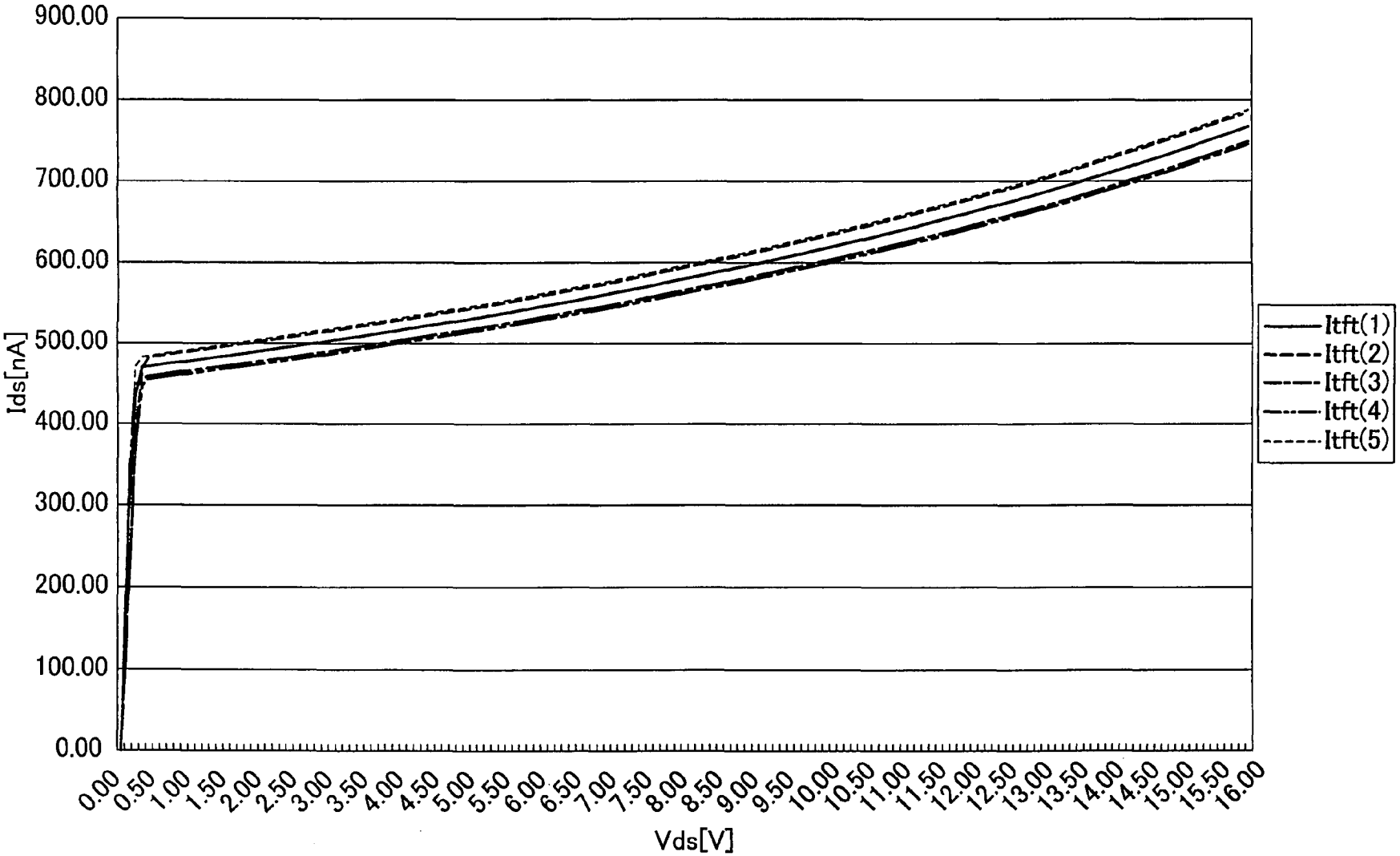
FIG. 28 is a graph illustrating a relation between (i) a source-drain potential Vsd of the driving TFT, and (ii) a current flowing from a source of the driving TFT to a drain thereof.
Figure 29:
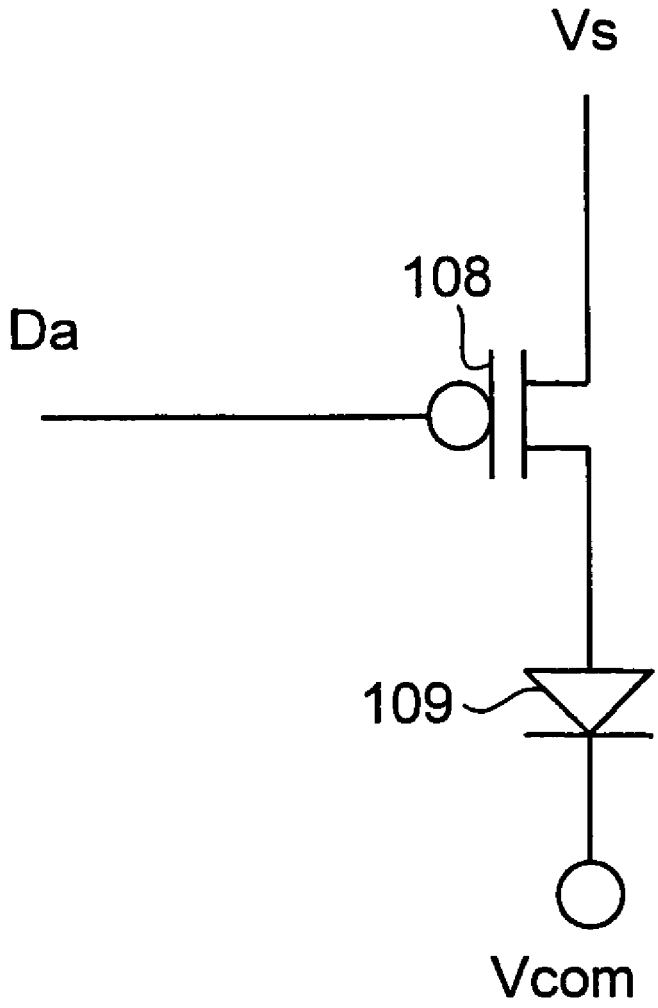
FIG. 29 is a circuit diagram illustrating a circuit structure in which a driving TFT is provided in series with an organic EL element.
Figure 30:
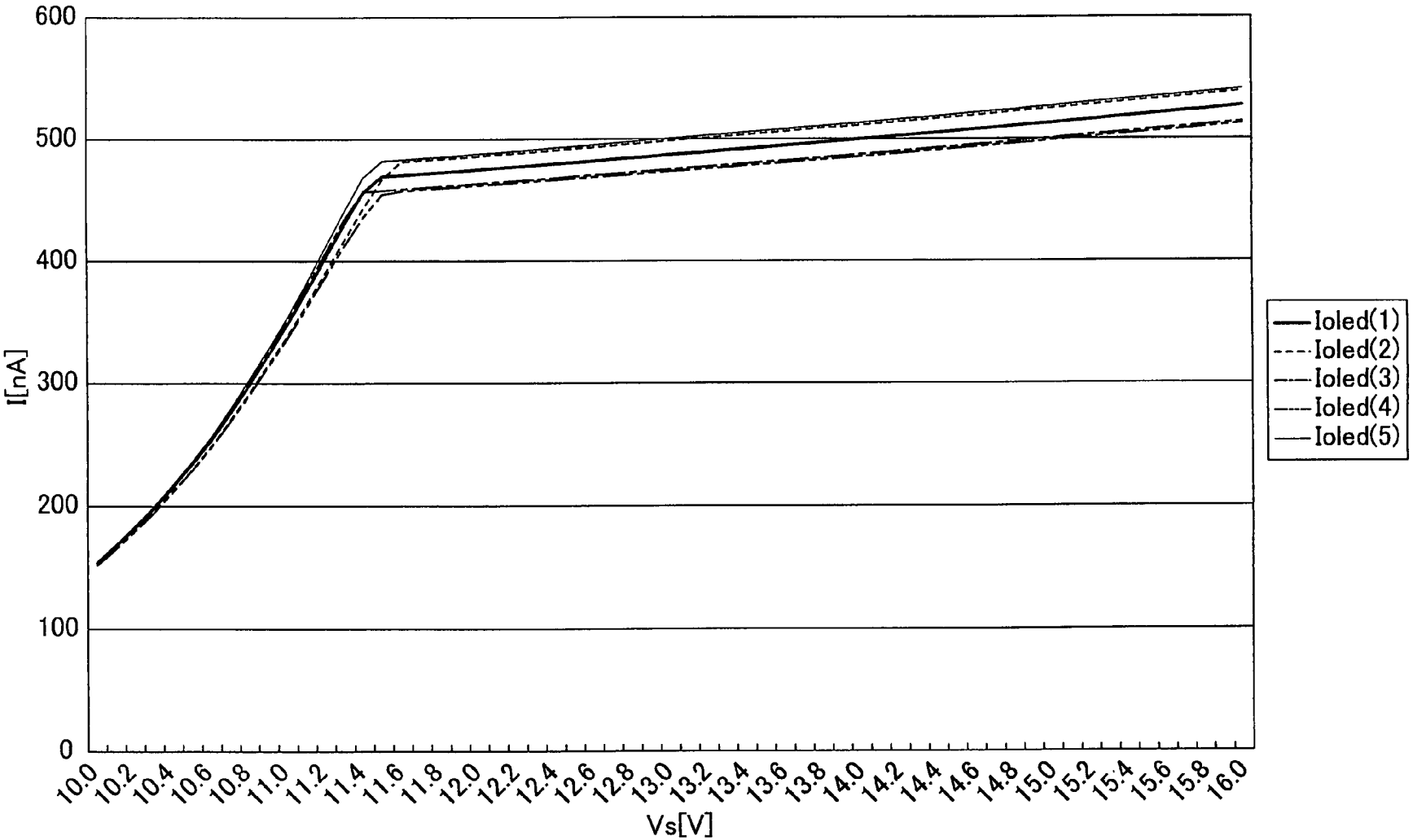
FIG. 30 is a graph illustrating a result of a simulation for examining variation, during the non-selection period, in a current flowing from (i) a source of the driving TFT of the circuit shown in FIG. 29, to (ii) a drain thereof.

The variation is sufficiently reduced as compared with the result (the current was increased by 5% to 24%; in other words, was varied in a range of 19%) of the simulation using the conventional technique shown in FIG. 26. This proves that the means of the present invention is efficient (the current was increased by 8% to 13%; in other words, was varied in a range of 5%).

Note that an effective way of further restraining the variation in the pixel circuit structure according to the present invention is to optimize (i) respective absolute capacitances of the first capacitor 2 and the second capacitor 7, (ii) a relative ratio of the absolute capacitances, (iii) the constant potential Va, (iv) a gate width of the driving TFT 1, and the like.

For example, the variation of the source-drain potential required for the change of the source-gate potential Vsg during the second period can be restrained better as a ratio (C2/C1) of capacitance C2 of the second capacitor 7 to capacitance C1 of the first capacitor 2 is larger. This allows restraint of (i) the variation of the source-drain potential depending on the threshold voltage of the driving TFT 1 and the mobility thereof, and (ii) the variation of the current flowing to the organic EL element 6 during the non-selection period. This is preferable.

When the respective absolute capacitances of the capacitors are too small, the respective potentials retained by the capacitors are affected by the changes of the potentials of the gate terminals of the switching TFTs 3, 8, and 9, each of which is connected to the capacitors. This causes the variation of the current flowing to the organic EL element 6 during the non-selection period. For this reason, this is not preferable.

Further, it is preferable that the constant potential Va supplied during the first period be set such that the potential value difference Vs−Va between the predetermined voltage line Va and the power source wire Vs is slightly larger than or substantially equal to the source-drain potential Vsd that is to be expected during the non-selection period. That is, too large a potential difference Vs−Va causes too large a difference between (i) the source-drain potential Vsd during the current writing period, and (ii) the source-drain potential Vsd during the non-selection period. Accordingly, the current actually flowing to the organic EL element 6 becomes too small as compared with the current supplied from the source wire Sj. This is not preferable.

Further, a driving TFT 1 having a too large gate width W causes the driving TFT 1 to have a too small source-gate potential, with the result that the change in the gate potential causes the variation of the current flowing into the organic EL element 6 during the non-selection period. This is not preferable. On the other hand, a driving TFT having a too small gate width W requires a too large source-drain potential for the acquirement of the required current. This is not preferable, either.

The variation of the current flowing to the organic EL is the least (approximately 1%) in the organic EL element used in Embodiment 1 when C1 is 1000 fF, C2 is 500 fF, Vs is 16V, Va is 10 V, and W is 12 μm in the pixel circuit Aij shown in FIG. 1. This is suitable.

Note that the absolute capacitance C1 of the first capacitor 2, the absolute capacitance C2 of the second capacitor 7, the relative ratio of the absolute capacitances, the constant potential Va, and the gate width W of the driving TFT 1 are dependent on (i) the property of the organic EL element to be driven, (ii) a required luminescence, and (iii) the property of the driving TFT 1 to be used. For this reason, such a simulation is required to be carried out several times again upon actually designing a panel.

Note also that, in the pixel circuit structure shown in FIG. 1, the switching TFT 3 is connected to the source wire Sj so as to connect the gate terminal of the driving TFT 1 to the drain terminal thereof; however, the switching TFT 3 may be directly connected to the drain terminal of the driving TFT 1. This is also true of the switching TFT 9 for connecting the second terminal of the second capacitor 7 to the drain terminal of the driving TFT 1. That is, the switching TFTs 3 and 9 may be directly connected to the drain terminal of the driving TFT 1.

Figure 6:
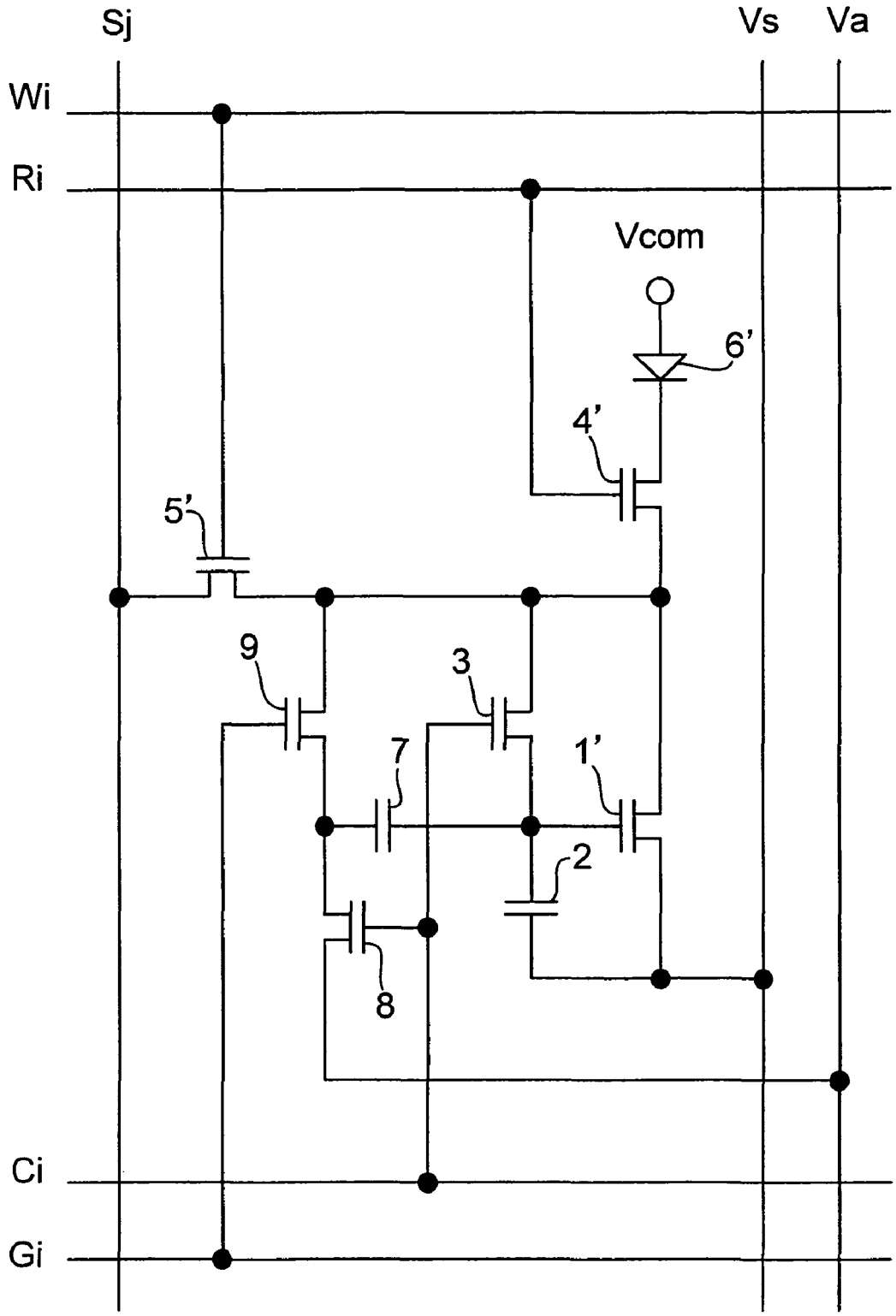
FIG. 6 is a circuit diagram illustrating a structure of the display apparatus according to Embodiment 1, which structure is different from the pixel circuit shown in FIG. 1.
Figure 7:
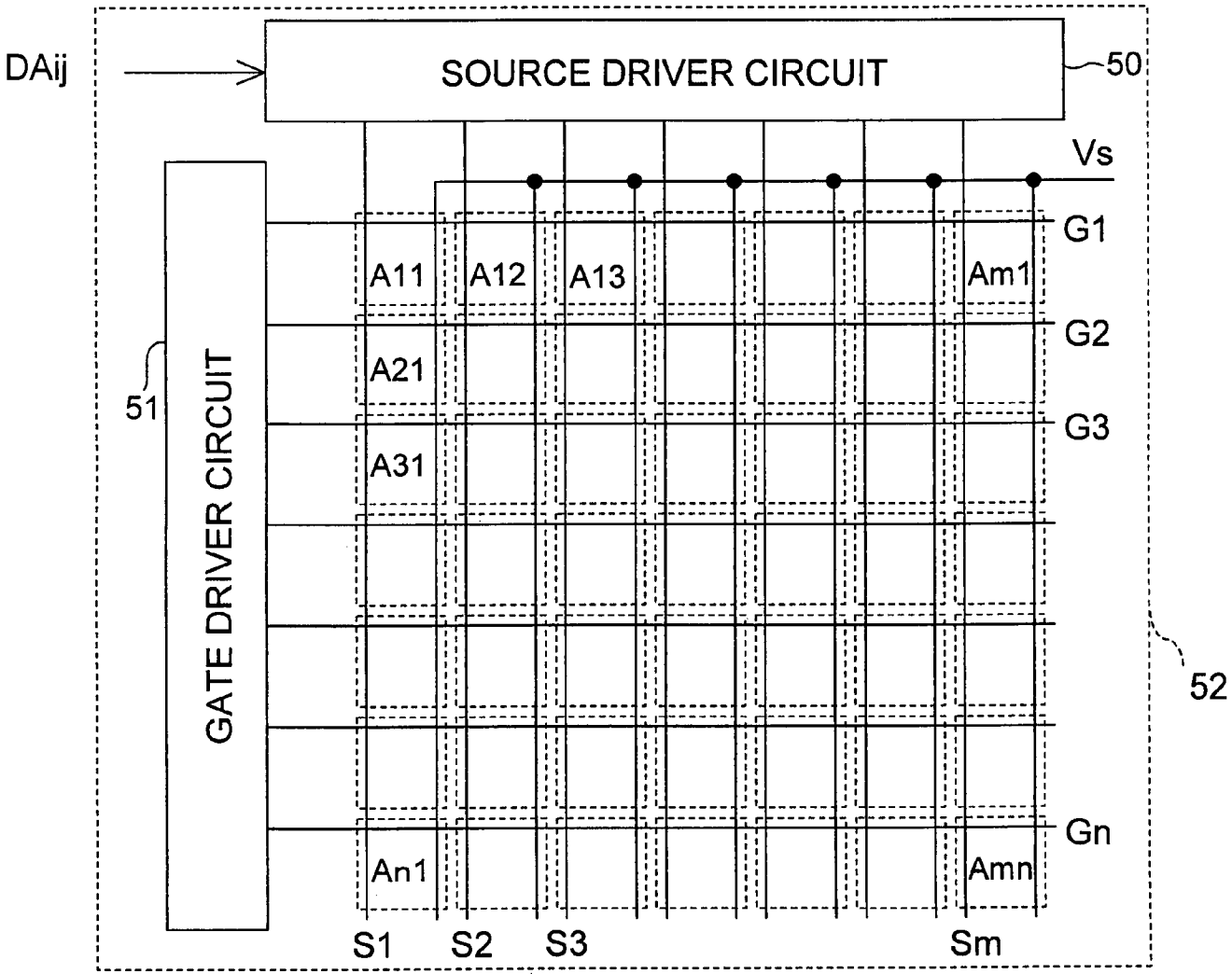
FIG. 7 is a circuit diagram illustrating a structure of a display apparatus according to Embodiment 2.

Further, the organic EL element may be so provided as to be associated with the source terminal of the driving TFT. In such a structure, a driving TFT 1' is an n-type TFT, and has a source terminal connected to a cathode of an organic EL element 6', as shown in FIG. 6. Moreover, in the structure shown in FIG. 6, switching TFTs 4' and 5' are n-type TFTs unlike those in the pixel circuit structure shown in FIG. 1.

Further, the switching TFTs 3 and 9 are connected to a drain terminal of the driving TFT 1'.

The other wires and operations in the pixel circuit structure shown in FIG. 6 are the same as those in the structure shown in FIG. 1. Therefore, structures equivalent to those shown in FIG. 1 are given the same reference symbols, and explanation thereof is omitted here.

Embodiment 2

Embodiment 2 will explain a first example in which the first characteristic structure according to the present invention is applied to a pixel circuit and a source driver circuit.

A display apparatus according to Embodiment 2 is so arranged that components of the characteristic structure of the present invention are provided separately in the pixel circuit and the source driver circuit. See FIG. 7. In the structure of the display apparatus, pixel circuits Aij are provided in regions in which source wires Sj (j is an integer falling within a range from 1 to m) intersect with gate wires Gi (i is an integer falling within a range from 1 to n), respectively. The source wires Sj are connected to a source driver circuit 50, and the gate wires Gi are connected to a gate driver circuit 51. Each of the source wires Sj serves as the first wire, and each of the gate wires Gi serves as the second wire.

Figure 8:
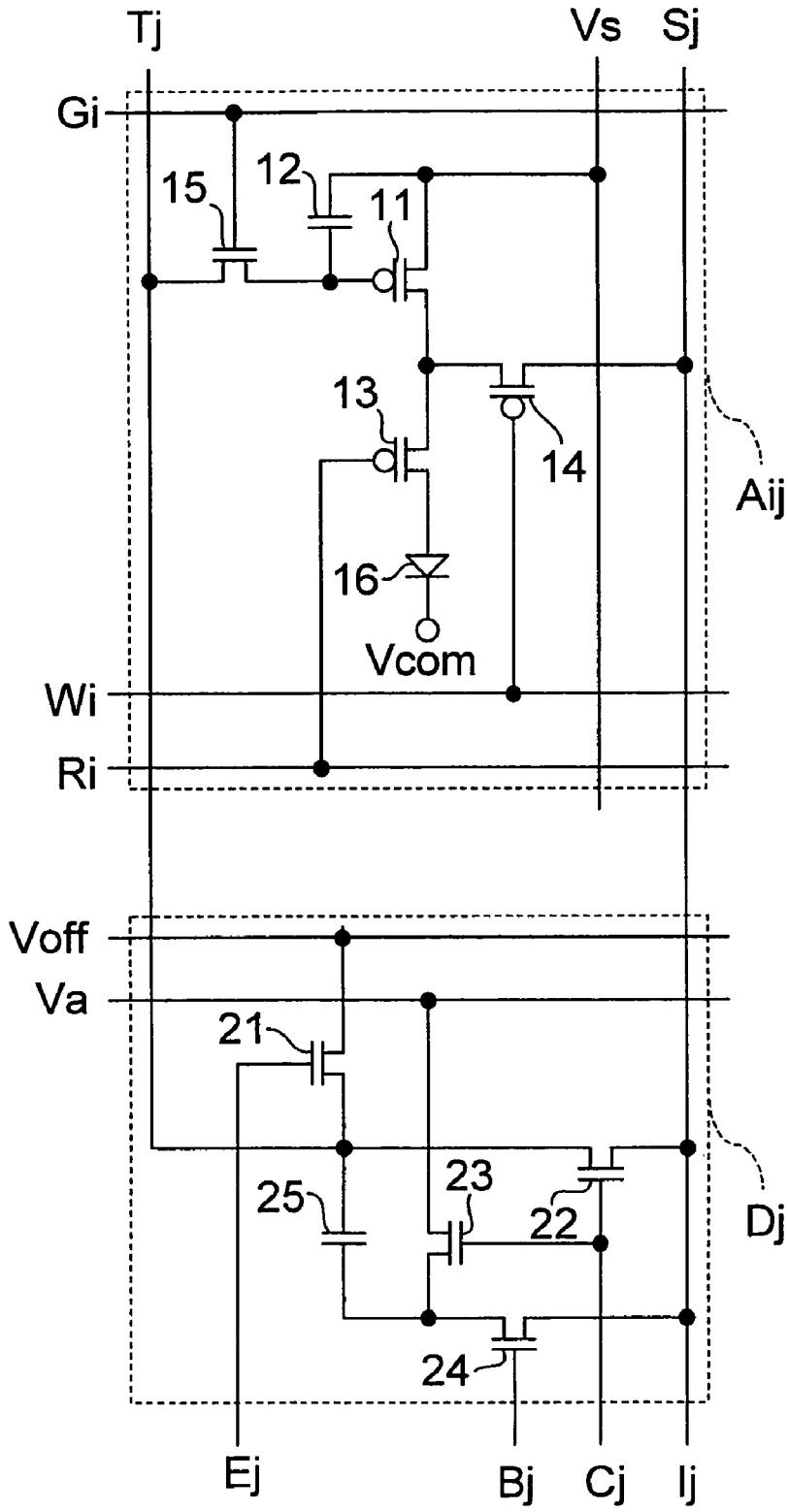
FIG. 8 is a circuit diagram illustrating respective structures of a pixel circuit and a source driver circuit in the display apparatus according to Embodiment 2.

FIG. 8 illustrates respective structures of each pixel circuit Aij and a source driver output terminal circuit Dj, serving as an output stage of the source driver circuit 50. Each of the pixel circuit Aij and the source driver output terminal circuit Dj includes the characteristic structure of the present invention.

As shown in FIG. 8, in the display apparatus according to Embodiment 2, the pixel circuit Aij is provided in the region in which the source wire Sj and the gate wire Gi intersect with each other. Provided in the pixel circuit Aij are: (i) a driving TFT 11, which serves as an active element; (ii) an organic EL element 16, which serves as an electric optical element; and (iii) a first capacitor 12. The driving TFT 11 and the organic EL element 16 are provided in series between a power source wire Vs and a common wire Vcom.

The driving TFT 11 has a gate terminal (current control terminal) connected to one terminal (hereinafter, referred to as "first terminal") of the first capacitor 12. The other terminal (hereinafter, referred to as "second terminal") of the first capacitor 12 is connected to a source terminal (current input terminal) of the driving TFT 11, and to the power source wire Vs.

Further, in the pixel circuit structure, a signal line Tj, serving as a third wire, is provided in parallel with the source wire Sj. The signal line Tj is connected to the gate terminal of the driving TFT 11 via a switching TFT 15.

Further, a switching TFT 13 is provided between a drain terminal (current output terminal) of the driving TFT 11 and an anode of the organic EL element 16. A node of the driving TFT 11 and the switching TFT 13 is connected to the source wire Sj via a switching TFT 14.

The components of the pixel circuit Aij, i.e., the switching TFTs 15, 14, and 13 have gate terminals connected to control wires Gi, Wi, and Ri, respectively.

In the source driver circuit 50, one output terminal circuit Dj is provided for a plurality of pixel circuits A1*j* through Anj. As shown in FIG. 8, in the output terminal circuit Dj, one terminal (hereinafter, referred to as "first terminal") of a second capacitor 25 is connected to the signal wire Tj. A switching TFT 22, which serves as the first switching transistor, is provided between the signal line Tj and the source wire Sj. Further, a switching transistor TFT 23, serving as the third switching transistor, is provided between (i) the other terminal (hereinafter, referred to as "second terminal") of the second capacitor 25, and (ii) a predetermined voltage line Va. Moreover, the switching TFT 24, serving as the second switching transistor, is provided between the second terminal of the second capacitor 25 and the source wire Sj. Further, a switching TFT 21, serving as a fourth transistor, is provided between the signal wire Tj and an OFF potential wire Voff.

In the output terminal circuit Dj, the switching TFT 21 has a gate terminal connected to a control wire Ej, and each of the switching TFTs 22 and 23 has a gate terminal connected to a control wire Cj, and the switching TFT 24 has a gate terminal connected to a control wire Bj.

Figure 9:
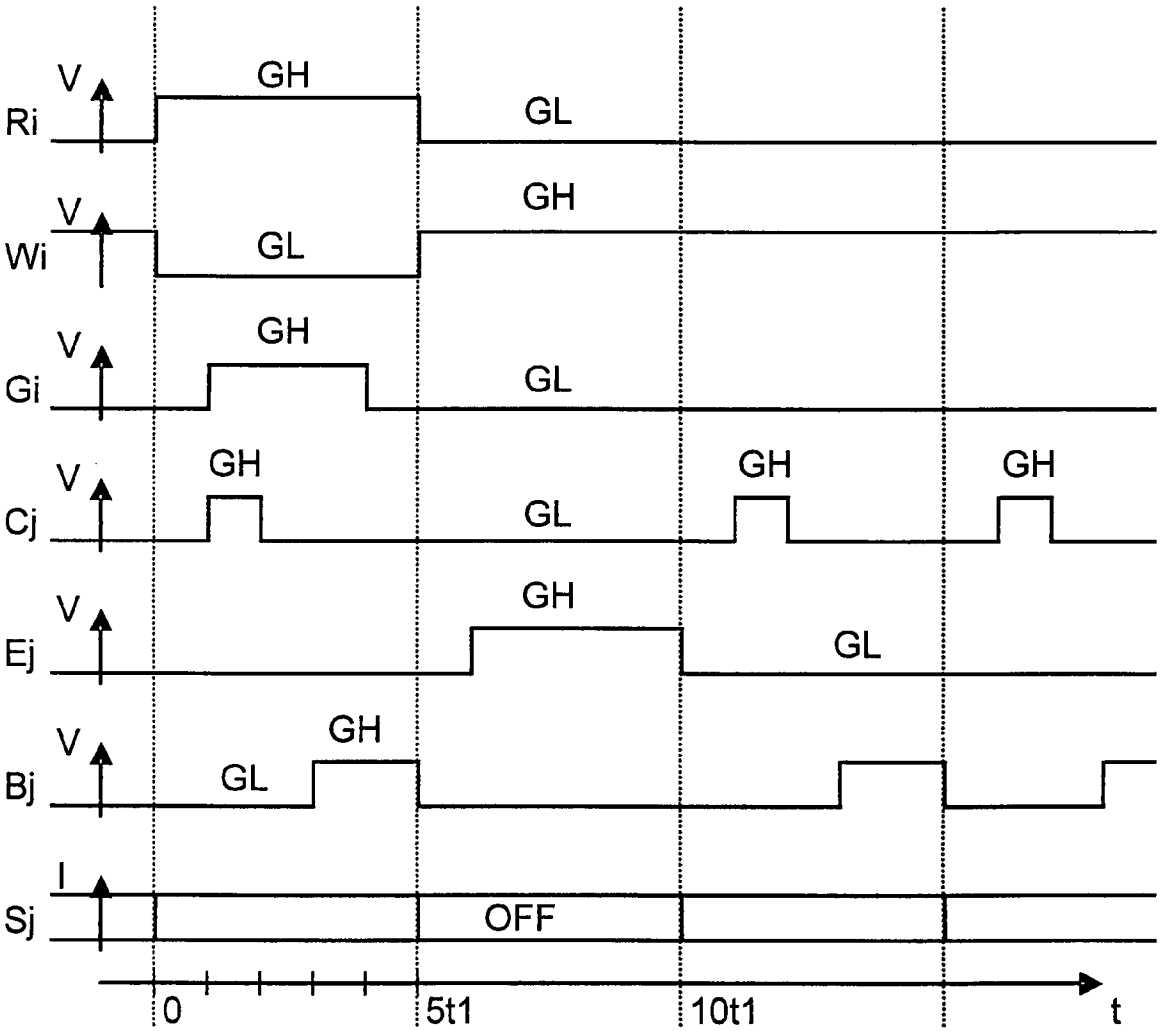
FIG. 9 is a wave form chart illustrating respective operation timings of control wires of the pixel circuit and the source driver circuit.

The following explains respective operations of the pixel circuit Aij and the output terminal circuit Dj in the display apparatus with reference to FIG. 9. FIG. 9 illustrates respective operation timings of the control wires Ri, Wi, Gi, Cj, Ej, and Bj, and the source wire Sj.

In a driving method (first driving method of the present invention) according to Embodiment 2, the selection period of the pixel circuit Aij corresponds to a period of time from 0 to 5*t*1. During the period, a potential of the control wire Ri is set at High (GH) such that the switching TFT 13 is OFF, and a potential of the control wire Wi is set at Low (GL) such that the switching TFT 14 is ON.

In the pixel circuit Aij, during the first period (time t1 to 2*t*1), a potential of the control wire Gi is set at High such that the switching TFT 15 is ON. This electrically connects the gate terminal of the driving TFT 11 to the signal line Tj. With this, the gate terminal of the driving TFT 11 is connected to the first capacitor 12 and the second capacitor 25.

Meanwhile, during the period, in the output terminal circuit Dj, a potential of the control wire Cj is set at High such that the switching TFTs 22 and 23 are ON. This electrically connects the gate terminal of the driving TFT 11 to the drain terminal thereof via the switching TFTs 15, 22, and 14. This also connects the second terminal of the second capacitor 25 to the predetermined voltage line Va via the switching TFT 23. With this, a current flows constantly from the power source wire Vs to a current output terminal Ij via the driving TFT 11, the switching TFT 14, and the source wire Sj.

Thereafter, the potential of the control wire Cj is set at Low such that the switching TFTs 22 and 23 become OFF. This causes the first capacitor 12 and the second capacitor 25 to retain the potential that the source wire Sj has on this occasion.

The first capacitor 12 and the second capacitor 25 thus retaining the potential on this occasion causes the driving TFT 11 to have a gate potential allowing a current to flow constantly as above (as the aforesaid current supply, during the first period, from the source terminal of the driving TFT 11 to the drain terminal thereof) while the second terminal of the second capacitor 25 has a potential Va, irrespective of the threshold voltage of the driving TFT 11 and the mobility thereof.

Next, during the second period (time 3*t*1 to time 4*t*1), the potential of the control wire Bj is set at High such that the switching TFT 24 is ON. This connects the second terminal of the second capacitor 25 to the drain terminal of the driving TFT 11 via the switching TFTs 24 and 14. With this, a desired current flows from the power source wire Vs to the current output terminal Ij via the driving TFT 11, the switching TFT 14, and the source wire Sj.

With this, a current is set to flow through the driving TFT 11 as above even during the second period, irrespective of the threshold voltage and the mobility of the driving TFT 11, as long as the source-drain potential of the driving TFT 11 is the potential Vs−Va. In other words, the supply of the desired current to the driving TFT 11 can determine the gate-source potential of the driving TFT 11 on condition that the source-drain potential of the driving TFT 11 is substantially constant.

At the time 4*t*1 after this, the potential of the control wire Gi is set at Low such that the switching TFT 15 becomes OFF. This causes the first capacitor 12 to retain the source-gate potential that the driving TFT 11 has during the second period.

At the time 5*t*1 after this, the following operations are carried out. That is, the potential of the control wire Bj is set at Low such that the switching TFT 24 becomes OFF. This disconnects the electric connection between the second capacitor 25 and the source wire Sj. The potential of the control wire Wi is set at High such that the switching TFT 14 becomes OFF. This disconnects the electric connection between the drain terminal of the driving TFT 11 and the source wire Sj. Moreover, the potential of the control wire Ri is set at Low such that the switching TFT 13 becomes ON. With this, a current is supplied from the driving TFT 11 to the organic EL element 16.

Now, the selection period of the pixel circuit Aij is over, and then a following pixel circuit A(i+1)j is selected.

A simulation was carried out to find values of a current flowing through the organic EL element 16, with the use of the pixel circuit structure (see FIG. 8) and the output terminal circuit structure (see FIG. 8) of the source driver circuit. A result of the simulation is shown in FIG. 10.

Figure 10:
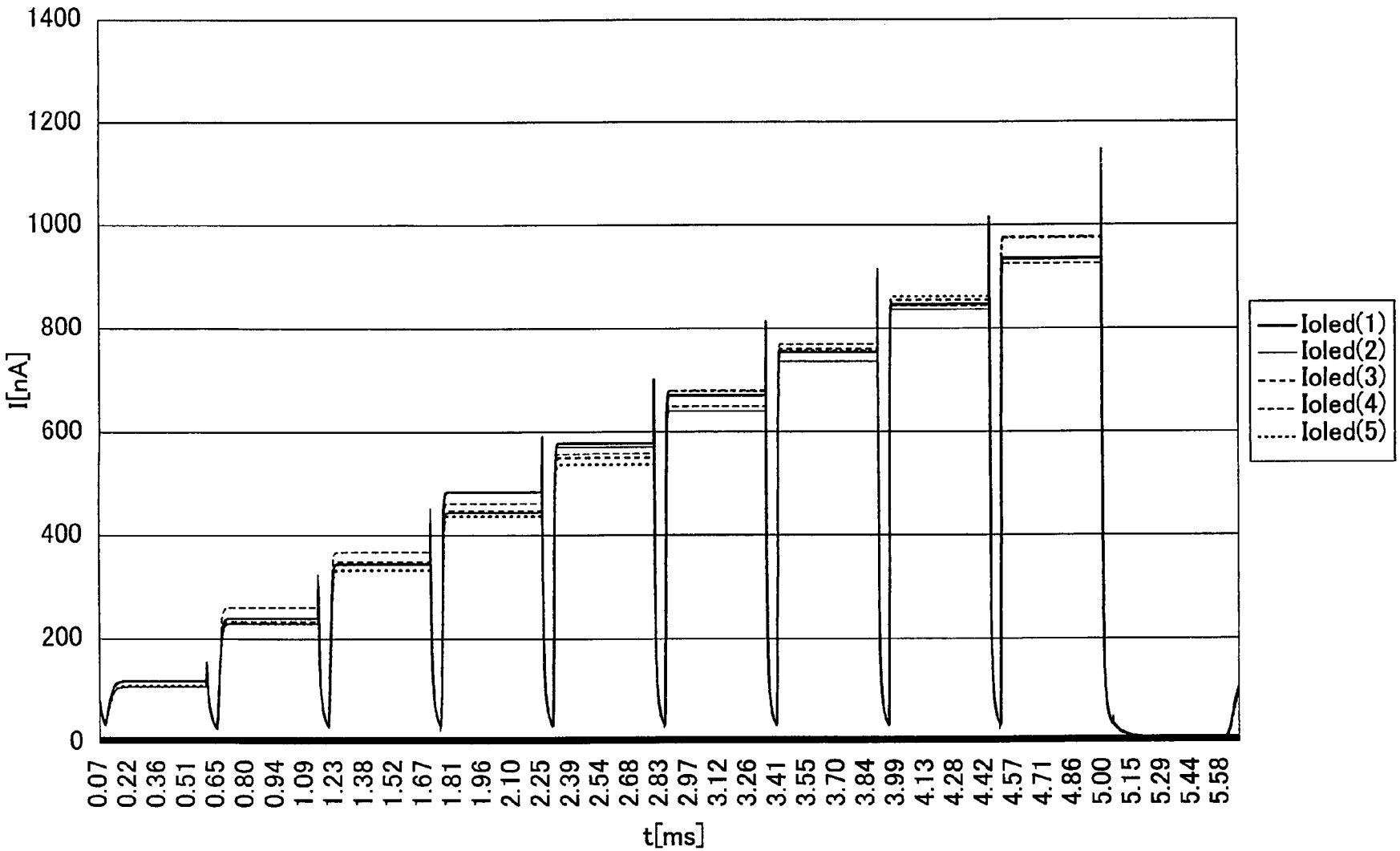
FIG. 10 is a graph illustrating a result of simulating a current flowing through an organic EL element in the pixel circuit.

In the simulation shown in FIG. 10, the selection period came every 0.55 ms. During an initial period of time 0.06 ms to 0.61 ms, a current of 0.1 μA was set to flow into the source wire Sj. Thereafter, the current was increased by 0.1 μA every 0.55 ms until the current had a value of 0.9 μA. Then, the current was set at 0. After that, the current was increased again by 0.1 μA.

Here, a comparison is made between (i) Embodiment 2 (see FIG. 10) employing such a structure that some components of the characteristic structure of the present invention are provided in the source driver circuit, and (ii) Embodiment 1 (see FIG. 4) employing such a structure that all the components are provided in the pixel circuit. The comparison clarifies that: as is the case with the structure of Embodiment 1, the structure of Embodiment 2 also makes it possible to reduce the adverse effect of the threshold voltage variation and the mobility variation of the driving TFT 11, and therefore makes it possible to restrain the variation of the current flowing to the organic EL element 16 during the non-selection period.

Further, in the structure according to Embodiment 2, the switching TFTs and the capacitor are not provided in the pixel circuit, but are provided in the source driver circuit as shown in FIG. 8, unlike the pixel circuit of Embodiment 1 (see FIG. 1). This makes it possible to provide a large area for organic EL elements in each pixel of a display apparatus employing a bottom emission structure (such a structure that light is emitted toward a transparent substrate having TFT elements).

This makes it possible to obtain desired luminance in each unit area with less emission of each organic EL element, so that the organic EL element can have a longer luminance half-life.

In contrast, see a case of a display apparatus employing a top emission structure (such a structure that light is emitted toward a side opposite to a transparent substrate having TFT elements). In this case, the number of elements provided in a pixel never increases, so that each pixel size can be as small as a pixel size in the conventional technique.

Further, when supplying no current to the organic EL element 16 during the non-selection period, the following operation may be carried out. That is, the potential of the control wire Ej is set at High such that the switching TFT 21 is ON, as shown in FIG. 9 (a period of time 6*t*1 to 10*t*1). With this, an OFF potential Voff is supplied to the signal line Tj. Note that, during the period, the respective potentials of the control wire Cj and the control wire Bj are Low.

With this, the signal line Tj has the OFF potential during the period (6*t*1 to 10*t*1), so that substantially no current flows through the organic EL element 16 during a period of time from 5.01 ms to 5.56 ms (see FIG. 10).

Figure 25:
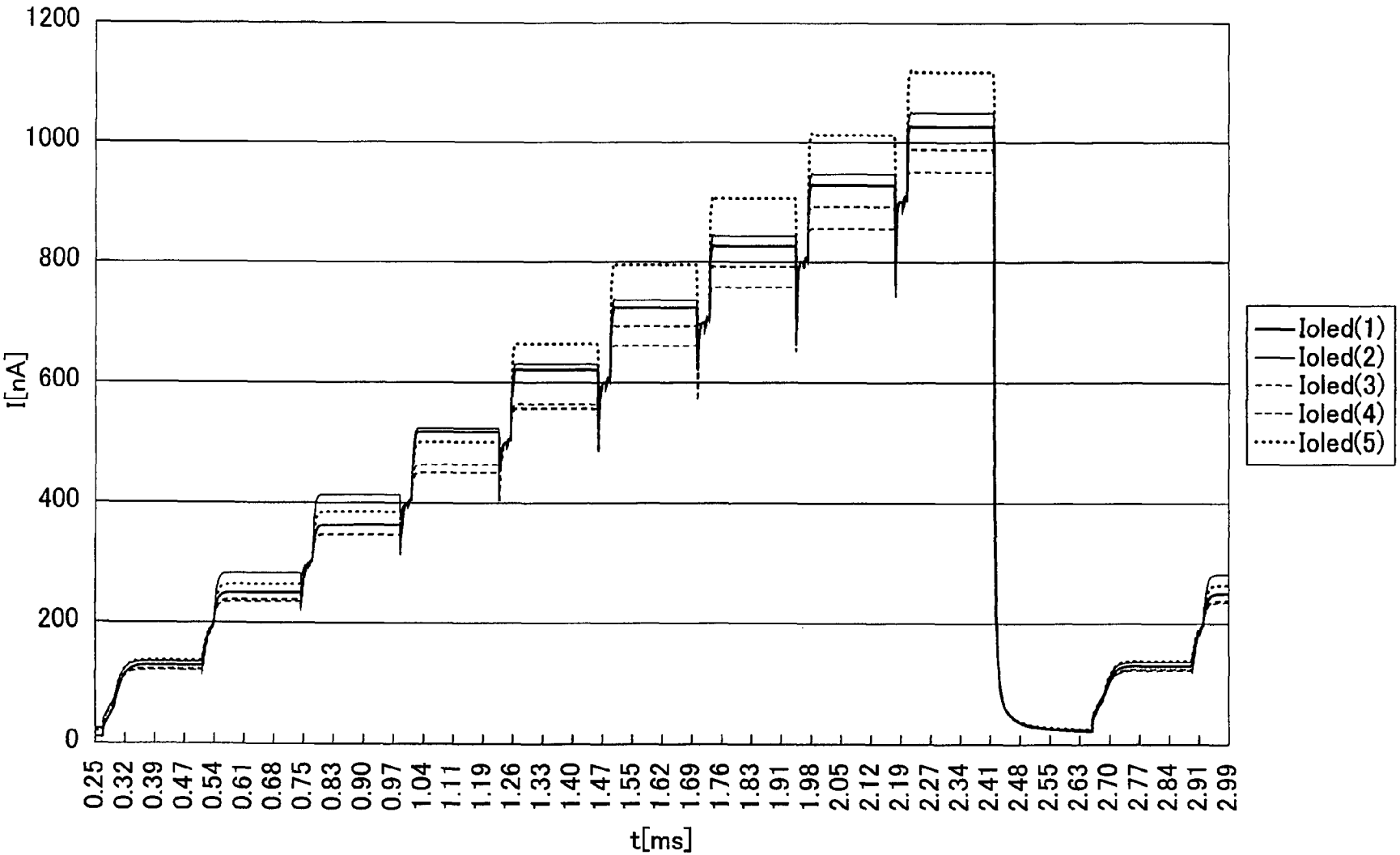
FIG. 25 is a graph illustrating a result of simulating a current flowing through an organic EL element in the conventional pixel circuit.

A comparison between this simulation result and the simulation result of the conventional technique (see FIG. 25) clarifies that: the use of the switching TFT 21 of the circuit structure shown in FIG. 8 makes it possible that substantially no current flows through the organic EL element 16. This allows an improvement in contrast of the display apparatus, so that this is preferable.

Embodiment 3

Embodiment 3 will explain a second example in which the first characteristic structure according to the present invention is applied to a pixel circuit and a source driver circuit.

A display apparatus according to Embodiment 3 is arranged such that the components of the characteristic structure of the present invention are provided separately in the pixel circuit and the source driver circuit. Therefore, the display apparatus has a structure shown in FIG. 7, as is the case with Embodiment 2. For this reason, explanation thereof is omitted here.

Figure 11:
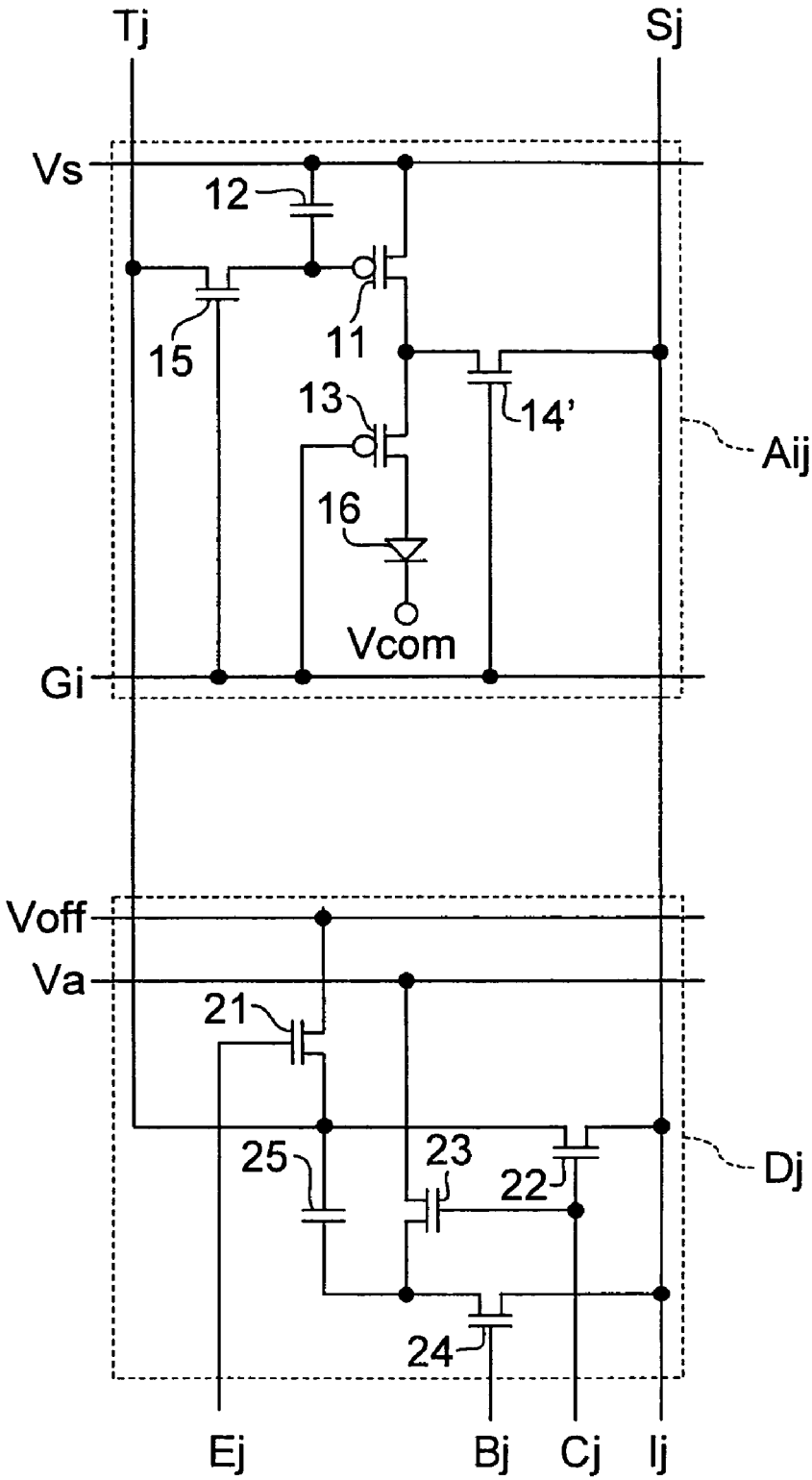
FIG. 11 is a circuit diagram illustrating respective structures of a pixel circuit and a source driver circuit in a display apparatus according to Embodiment 3.

FIG. 11 illustrates respective structures of (i) each pixel circuit Aij and (ii) a source driver output terminal circuit Dj, serving as an output stage of the source driver circuit 50. Each of the pixel circuit Aij and the source driver output terminal circuit Dj includes the components of the characteristic structure of the present invention.

As shown in FIG. 11, in the pixel circuit Aij of the display apparatus according to Embodiment 3, a single gate wire Gi replaces the three control wires Gi, Wi, and Ri in the pixel circuit structure (see FIG. 8) of Embodiment 2, and an n-type switching TFT 14' replaces the p-type switching TFT 14. In other words, the switching TFTs 13, 15, and 14' in the pixel circuit Aij shown in FIG. 11 are driven by the gate wire Gi.

Moreover, the power source wire Vs in FIG. 8 is provided in parallel with the source wire Sj, whereas a power source wire Vs in FIG. 11 is provided in parallel with the gate wire Gi. However, the other components of the circuits shown in FIG. 11 are provided in the same manner as those of the circuits shown in FIG. 8 are provided. For this reason, detailed explanation thereof is omitted here.

Figure 12:
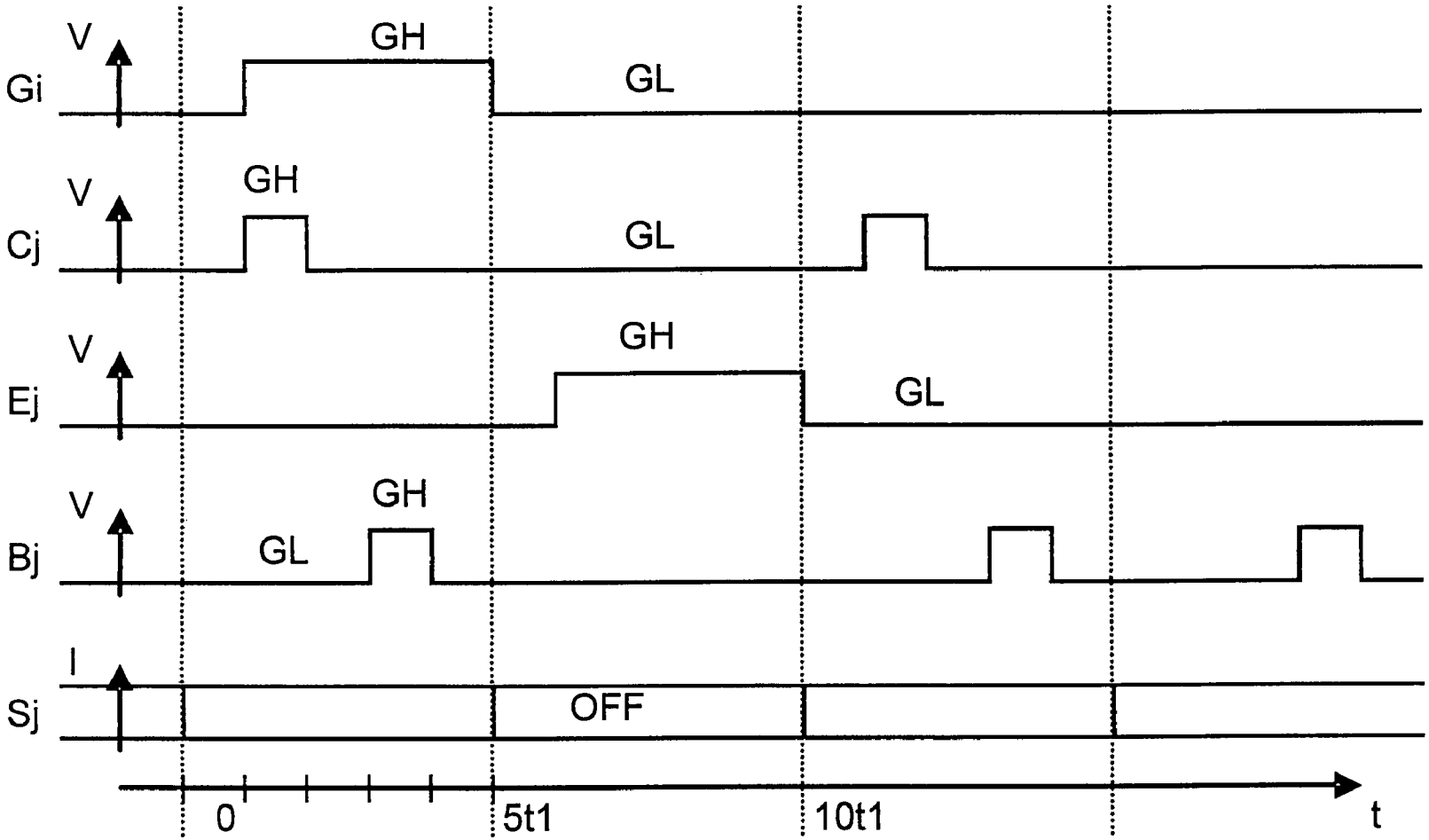
FIG. 12 is a wave form chart illustrating respective operation timings of control wires of the pixel circuit and the source driver circuit.

The following explains respective operations of the pixel circuit Aij and the output terminal circuit Dj in the display apparatus with reference to FIG. 12. FIG. 12 illustrates respective operation timings of the control wires Gi, Cj, Ej, Bj, and the source wire Sj.

In a driving method according to Embodiment 3, during a period of time t1 to 5*t*1 within the selection period of the pixel circuit Aij, the potential of the gate wire Gi is set at High (GH) such that the switching TFT 13 is OFF and that the switching TFTs 14' and 15 are ON.

During the period, the gate terminal of the driving TFT 11 is connected to the signal line Tj, with the result that the gate terminal of the driving TFT 11 is connected to the first capacitor 12 and the second capacitor 25.

Meanwhile, during the first period (t1 to 2*t*1), in the output terminal circuit Dj, the potential of the control wire Cj is set at High such that the switching TFTs 22 and 23 are ON. This connects the gate terminal of the driving TFT 11 to the drain terminal thereof via the switching TFTs 15, 22, and 14'. This also connects the second terminal of the second capacitor 25 to the predetermined voltage line Va.

With this, a current is constantly supplied from the power source wire Vs to the current output terminal Ij via the driving TFT 11, the switching TFT 14', and the source wire Sj. At the time 2*t*1, the potential of the control wire Cj is set at Low such that the switching TFTs 22 and 23 becomes OFF. This causes the first capacitor 12 and the second capacitor 25 to retain the potential that the source wire Sj has on this occasion.

The first capacitor 12 and the second capacitor 25 thus retaining the potential causes the driving TFT 11 to have such a gate potential that compensates the threshold voltage and the mobility of the driving TFT 11, and that allows constant current supply as above (as the aforesaid current supply, during the first period, from the source terminal of the driving TFT 11 to the drain terminal thereof) when the second terminal of the second capacitor 25 has a potential Va.

Next, during the second period (time 3*t*1 to time 4*t*1), the potential of the control wire Bj is set at High such that the switching TFT 24 is ON. This connects the second terminal of the second capacitor 25 to the drain terminal of the driving TFT 11 via the switching TFTs 24 and 14'.

With this, a predetermined current is supplied from the power source wire Vs to the current output terminal Ij via the driving TFT 11, the switching TFT 14', and the source wire Sj. This makes it possible to determine the gate-source potential of the driving TFT 11 such that a current flows through the driving TFT 11 during the second period irrespective of the threshold voltage and the mobility of the driving TFT 11, while the source-drain potential of the driving TFT 11 is substantially constant.

At the time 4*t*1 after this, the potential of the control wire Bj is set at Low such that the switching TFT 24 becomes OFF. This causes the second capacitor 25 to retain the source-gate potential that the driving TFT 11 had during the second period.

At time 5*t*1 after this, the potential of the gate wire Gi is set at Low such that the switching TFT 15 becomes OFF. This disconnects the electric connection between the first capacitor 12 and the signal wire Tj, and causes the first capacitor 12 to retain the potential that the signal wire Tj has on this occasion. Also at the time 5*t*1, the switching TFT 14' is turned OFF so as to disconnect the electric connection between the drain terminal of the driving TFT 11 and the source wire Sj, and the switching TFT 13 is turned ON so as to cause a current to flow from the driving TFT 11 to the organic EL element 16.

Now, the selection period of the pixel circuit Aij is over, and a following pixel circuit A (i+1)j is selected.

A simulation was carried out so as to find values of a current flowing through the organic EL element 16, with the use of the pixel circuit structure (see FIG. 11) and the output terminal circuit structure (see FIG. 11) of the source driver circuit. A result of the simulation is shown in FIG. 13.

Figure 13:
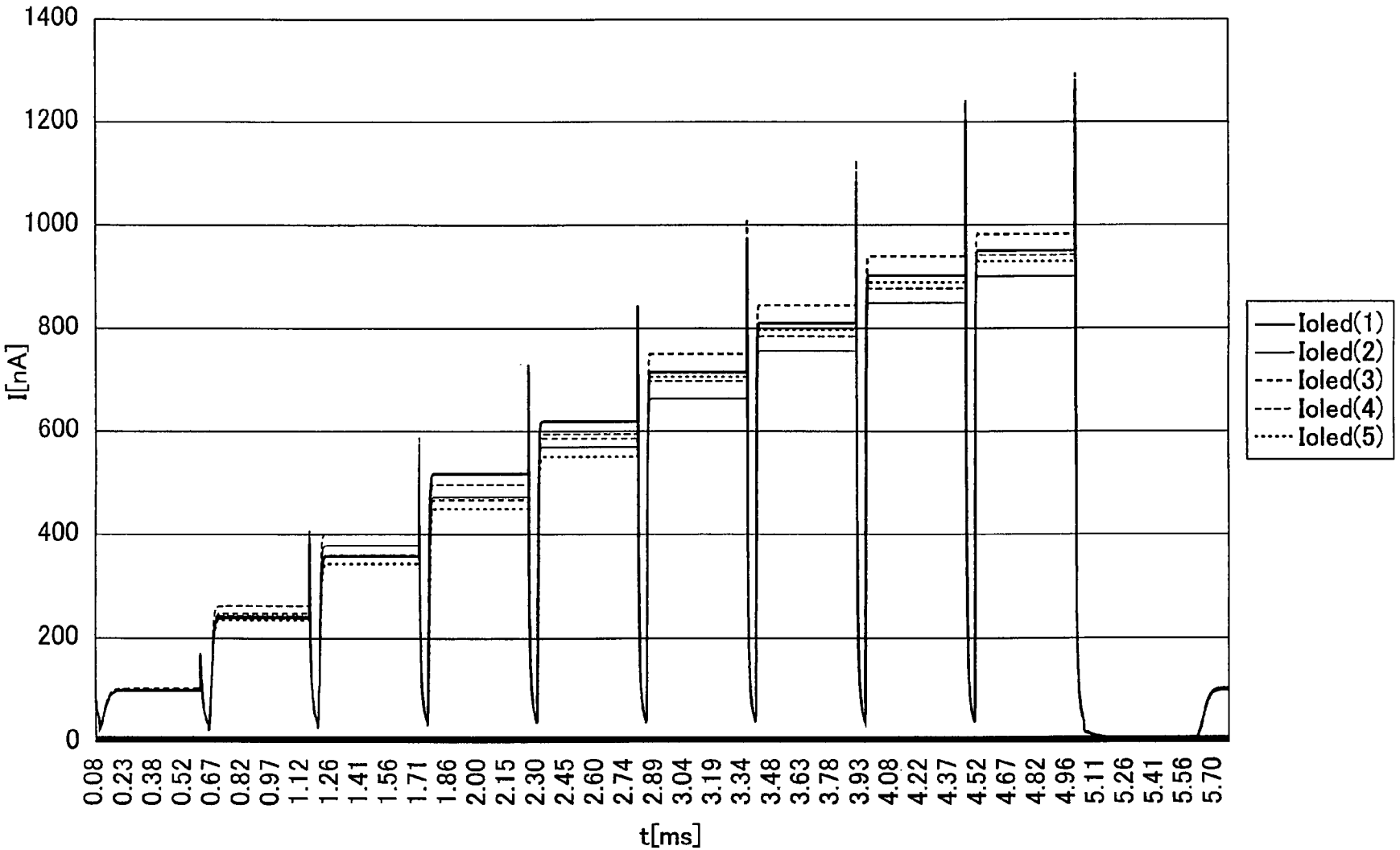
FIG. 13 is a graph illustrating a result of simulating a current flowing through an organic EL element in the pixel circuit.

In the simulation shown in FIG. 13, the selection period came every 0.55 ms. During an initial period of time 0.06 ms to 0.61 ms, a current of 0.1 μA was set to flow to the source wire Sj. Thereafter, the current was increased by 0.1 μA every 0.55 ms until the current had a value of 0.9 μA. Then, the current was set at 0. After that, the current was increased again by 0.1 μA.

Here, a comparison is made between (i) the simulation result according to Embodiment 3, and (ii) the simulation result (see FIG. 25) of the conventional technique. The comparison clarifies that: although Embodiment 3 employs such a structure that the number of the control wires in the pixel circuit Aij is reduced, the structure of Embodiment 3 also makes it possible to reduce the adverse effect of the threshold voltage variation and the mobility variation of the driving TFT 11, and therefore makes it possible to restrain the variation of the current flowing to the organic EL element 16 during the non-selection period.

Further, the pixel circuit structure (see FIG. 11) according to Embodiment 3 adopts the single control wire Gi unlike the pixel circuit structure (see FIG. 8) described in Embodiment 2. This makes it possible to provide a larger area for organic EL elements in each pixel of a display apparatus employing a bottom emission structure (such a structure that light is emitted toward a transparent substrate having TFT elements). Accordingly, each organic EL element can have a longer luminance half-life, so that this is preferable.

Embodiment 4

Embodiment 4 will explain an example in which a second characteristic structure according to the present invention is applied to a source driver circuit.

Figure 14:
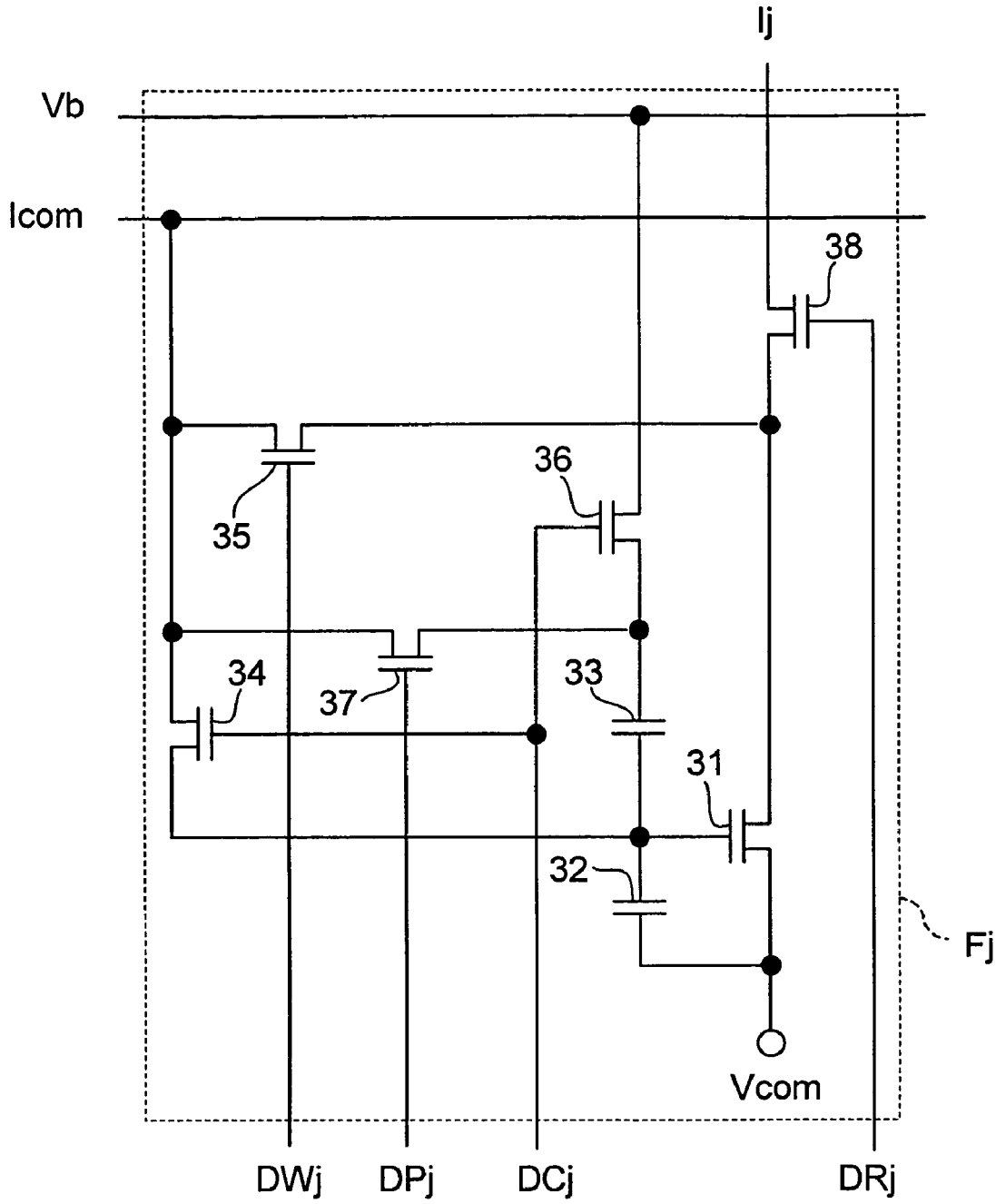
FIG. 14 is a circuit diagram illustrating a structure of a source driver circuit in a display apparatus according to Embodiment 4.

FIG. 14 illustrates a structure of a current output circuit Fj, which serves as an output stage of the source driver circuit of a display apparatus according to Embodiment 3. An output terminal Ij in the current output circuit Fj is, for example, connected to the source wire Sj shown in FIG. 1, or connected to the current output terminal Ij shown in FIG. 8 and FIG. 11.

The current output circuit Fj is arranged such that a gate terminal (current control terminal) of a driving TFT 31, serving as an active element, is connected to one terminal (hereinafter, referred to as a "first terminal") of a first capacitor 32, and to one terminal (hereinafter, referred to as "first terminal") of a second capacitor 33. Further, the other terminal (hereinafter, referred to as "second terminal") of the first capacitor 32, and a drain terminal (current output terminal) of the driving TFT 31 are connected to a common electrode Vcom.

Between the gate terminal of the driving TFT 31 and a source terminal (current input terminal) of the TFT, a switching TFTs 34 and 35 are provided in series.

Further, a switching TFT 36 is provided between the other terminal (hereinafter, referred to as "second terminal") of the second capacitor 33, and a predetermined voltage line Vb. Switching TFTs 37 and 35 are provided in series between the second terminal of the second capacitor 33 and the source terminal of the driving TFT 31.

Further, a switching TFT 38 is provided between the output terminal Ij of the current output circuit Fj and the source terminal of the driving TFT 31.

Each of the switching TFTs 34 and 36 has a gate terminal connected to a control wire DCj. The switching TFTs 37, 35, and 38 have gate terminals connected to control wires DPj, DWj, and DRj, respectively.

Figure 15:
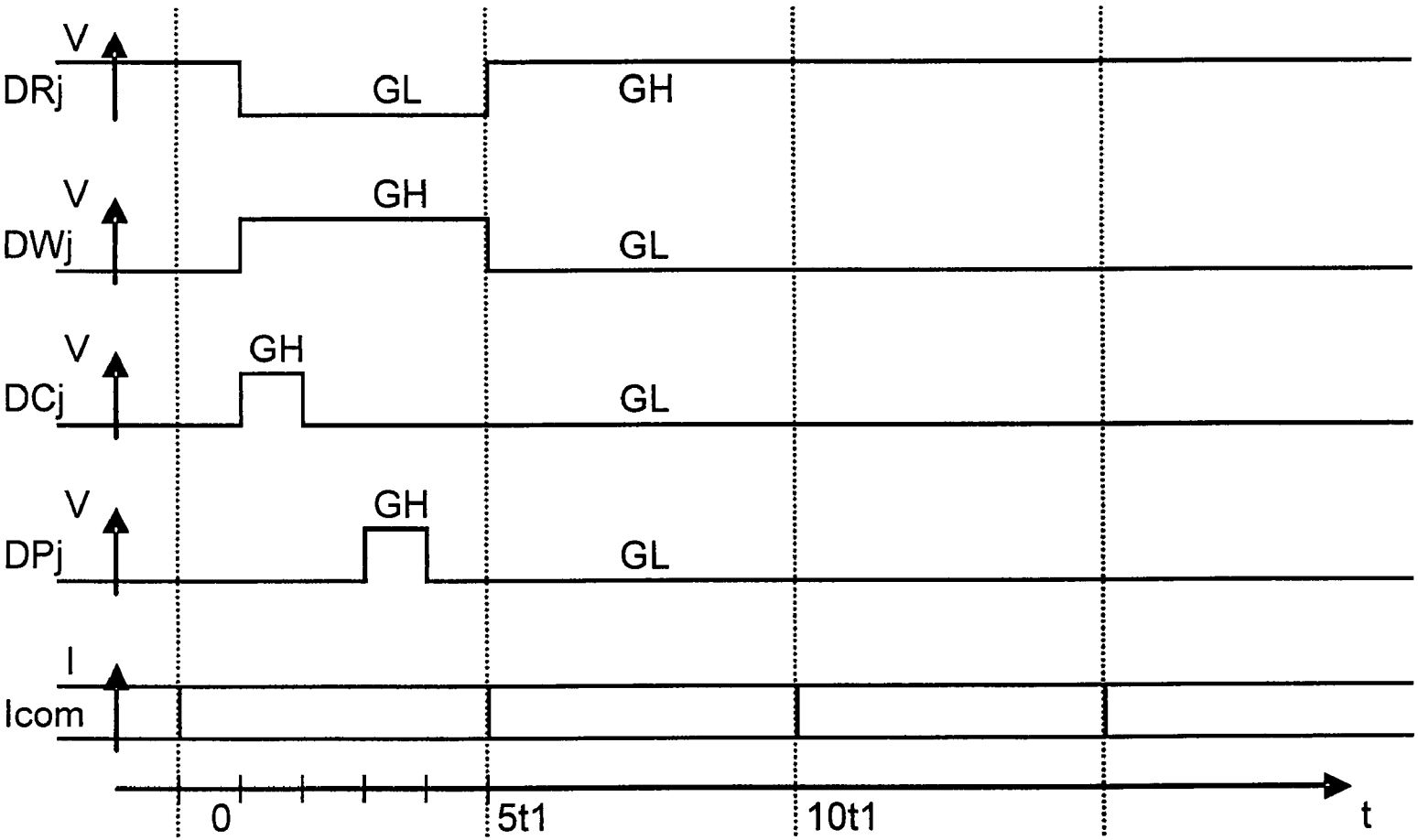
FIG. 15 is a wave form chart illustrating respective operation timings of control wires of the source driver circuit.

The following explains an operation of the current output circuit Fj in the source driver circuit of the display apparatus with reference to FIG. 15. FIG. 15 illustrates respective operation timings of the control wires DRj, DWj, DCj, DPj, and a common current wire Icom.

In a driving method according to Embodiment 4, during the current setting period corresponding to a period of time from t1 to 5*t*1, a potential of the control wire DRj is set at Low such that the switching TFT 38 is OFF, and a potential of the control wire DWj is set at High such that the switching TFT 35 is ON.

During the first period (t1 to 2*t*1), a potential of the control wire DCj is set at High such that the switching TFTs 34 and 36 are ON. This electrically connects the gate terminal of the driving TFT 31 to the source terminal thereof via the switching TFTs 34 and 35. Further, this also connects the second terminal of the second capacitor 33 to the predetermined voltage line Vb via the switching TFT 36. With this, a current is constantly supplied from the common current wire Icom to the common electrode Vcom via the switching TFT 35 and the driving TFT 31.

At the time 2*t*1, the potential of the control wire DCj is set at Low such that the switching TFTs 34 and 36 become OFF. This causes the first capacitor 32 and the second capacitor 33 to retain the potential that the common current wire Icom had during the first period.

The first capacitor 32 and the second capacitor 33 thus retaining the potential causes the driving TFT 31 to have such a gate potential that compensates the threshold voltage and the mobility of the driving TFT 31, and that allows constant current supply as above (as the aforesaid current supply, during the first period, from the source terminal of the driving TFT 31 to the drain terminal thereof) when the second terminal of the second capacitor 33 has a potential Vb.

Next, during the second period (time 3*t*1 to 4*t*1), the potential of the control wire DPj is set at High such that the switching TFT 37 is ON. This connects the second terminal of the second capacitor 33 to the source terminal of the driving TFT 31 via the switching TFTs 37 and 35. With this, a desired current is supplied from the common wire Icom to the common electrode Vcom via the switching TFT 35 and the driving TFT 31.

This determines the gate-drain potential of the driving TFT 31 such that a desired current flows into the driving TFT 31 irrespective of the threshold voltage and mobility of the driving TFT 31, while the source-drain potential of the driving TFT 31 is substantially constant.

At the time 4*t*1, the potential of the control wire DPj is set at Low such that the switching TFT 37 becomes OFF. This causes the first capacitor 32 and the second capacitor 33 to retain the gate-drain potential that the driving TFT 31 had during the second period.

At time 5*t*1 after this, the potential of the control wire DWj is set at Low such that the switching TFT 35 becomes OFF. This disconnects the electric connection between the common current wire Icom and the source terminal of the driving TFT 31. Moreover, the potential of the control wire DRj is set at High such that the switching TFT 38 becomes ON. This causes a desired current to flow from the current output terminal Ij to the driving TFT 31.

Now, the selection period of the current output circuit Fj is over, and a next current output circuit Fj+1 is selected.

A simulation was carried out to find (i) the source-drain voltage Vsd of the driving TFT 31, and (ii) the gate-drain voltage Vgd thereof, by changing the threshold voltage and the mobility of the driving TFT 31 during the selection period of the current output circuit Fj in accordance with conditions described in Table 3 below. A result of the simulation is shown in FIG. 16.

TABLE 3

| | Ioled(1) Vsg(1) Vsd(1) | Ioled(2) Vgd(2) Vsd(2) | Ioled(3) Vgd(3) Vsd(3) | Ioled(4) Vgd(4) Vsd(4) | Ioled(5) Vgd(5) Vsd(5) |
|---|---|---|---|---|---|
| Threshold voltage | Average value | Upper limit value | Lower limit value | Upper limit value | Lower limit value |
| Mobility | Average value value | Lower limit value | Upper limit value | Lower limit value | Upper limit value |

Figure 16:
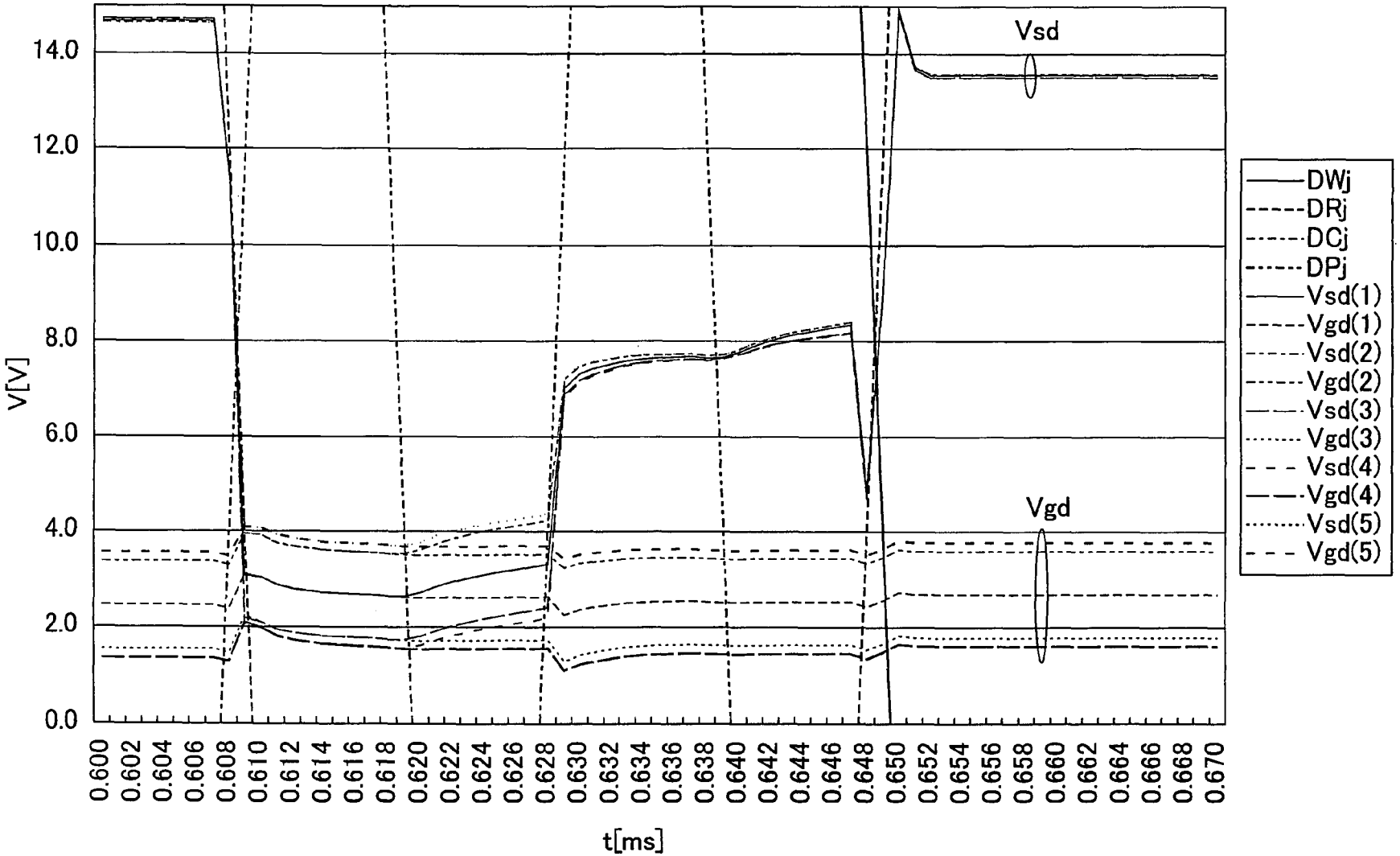
FIG. 16 is a graph illustrating a result of simulating respective changes in (i) a source-gate potential and (ii) a source-drain potential of a driving TFT in the source driver circuit.

In FIG. 16, a period of time from 0.61 ms to 0.62 ms corresponds to the aforesaid first period. As shown in FIG. 16, source-drain potentials Vsd (1) through Vsd (5) coincided with source-gate potentials Vsg (1) through Vsg (5), respectively.

Moreover, a period of time from 0.63 ms to 0.64 ms in FIG. 16 corresponds to the aforesaid second period. As shown in FIG. 16, the source-drain potentials Vsd of the driving TFT 31 were substantially the same during the period, irrespective of the threshold voltage of the driving TFT and the mobility thereof.

In other words, the desired current flowed from the common current wire Icom to the common electrode Vcom via the switching TFT 35 and the driving TFT 31 during the second period, so that each gate-drain potential Vgd could be set, irrespective of the threshold voltage variation and the mobility variation of the driving TFT, on condition that the source-drain potential of the driving TFT 31 is constant.

This makes it possible to realize the current output circuit that allows substantially constant current supply, irrespective of the threshold voltage of the driving TFT 31 and the mobility thereof, while the source-drain potential is constant.

Thereafter, a readout period of the current output circuit Fj started. During the readout period, the substantially constant current output of the driving TFT 31 allows each source-drain potential Vsd of the driving TFT 31 to be substantially constant. Note that, in the simulation, a resistor was provided between the current output terminal Ij and the power source wire Vs, instead of the organic EL element.

A simulation was carried out to find variation of the current supplied from the driving TFT 31 on this occasion, in accordance with the aforesaid five conditions (see Table 3) pertaining to the threshold voltage and the mobility of the driving TFT 31. A result of the simulation is shown in FIG. 17.

Figure 17:
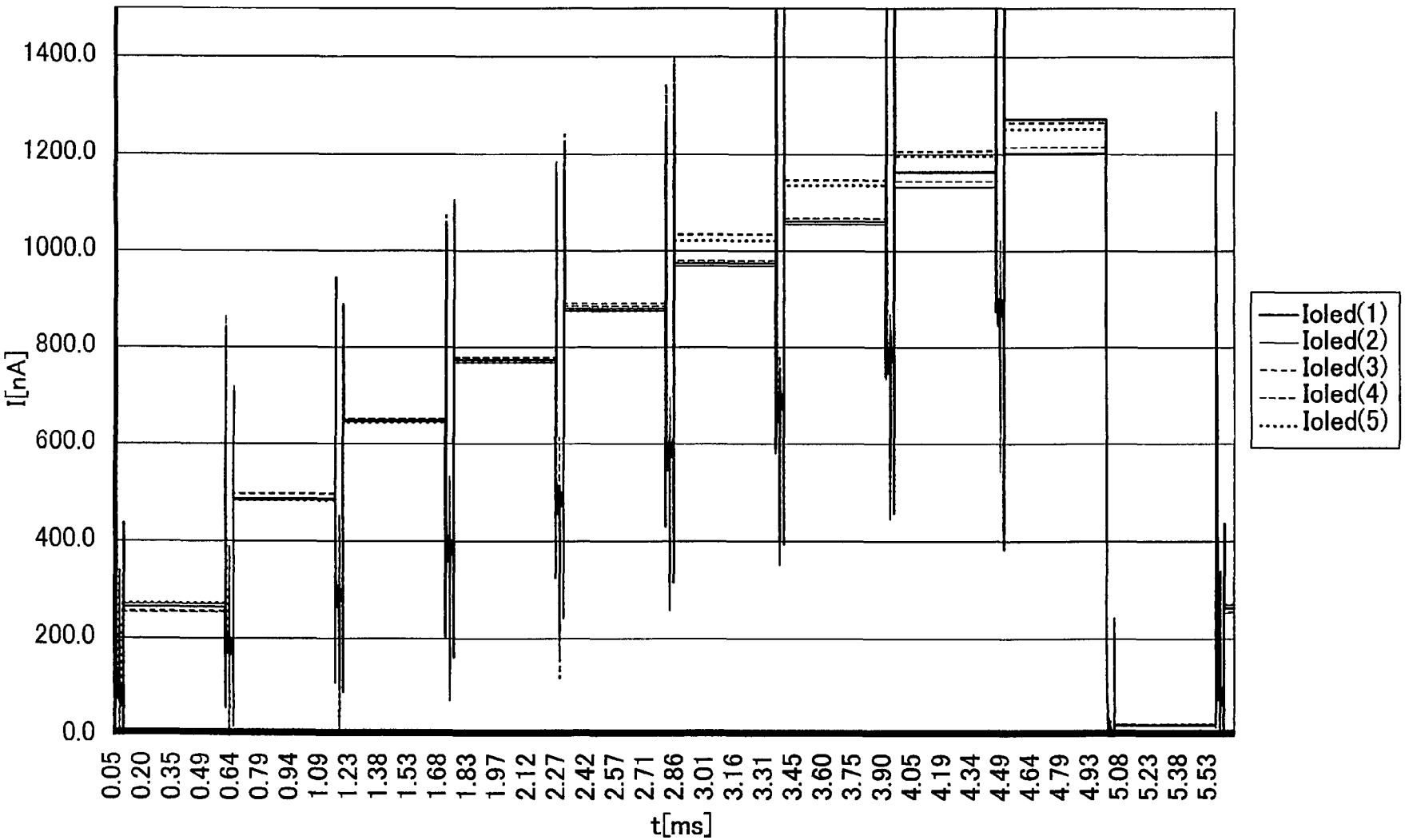
FIG. 17 is a graph illustrating a result of simulating a current flowing from a source terminal of the driving TFT to a drain terminal thereof, in the source driver circuit.

In the simulation shown in FIG. 17, the selection period came every 0.55 ms. During an initial period of time from 0.06 ms to 0.65 ms, a current of 0.1 μA was set to flow to the source wire Sj. Thereafter, the current was increased by 0.1 μA every 0.55 ms until the current had a value of 0.9 μA. Then, the current was set at 0. After that, the current was increased again by 0.1 μA.

The simulation result shown in FIG. 17 clarifies that the use of the source driver circuit according to Embodiment 4 provides an effect of restraining the variation of the current flowing through the driving TFT 31, the current variation being caused by the threshold voltage variation and the mobility variation of the driving TFT 31. (Specifically, the current variation at a time of 3.6 ms in FIG. 17 falls within a range from 1.05 μA to 1.15 μA, i.e., falls within a variation range of 9%.)

Especially, until the output current was 0.8 μA, substantially identical current values were obtained irrespective of the threshold voltage variation and the mobility variation in the driving TFT 31.

Incidentally, in cases where the characteristic structure of the present invention is used as the source driver circuit, it is preferable that the characteristic structure is also used in a pixel circuit. An example of this is explained as follows.

That is, the current output terminal Ij of the source driver circuit shown in FIG. 14 is connected to the pixel circuit described in Embodiment 1. An effect of this was examined by carrying out a simulation.

Figure 18:
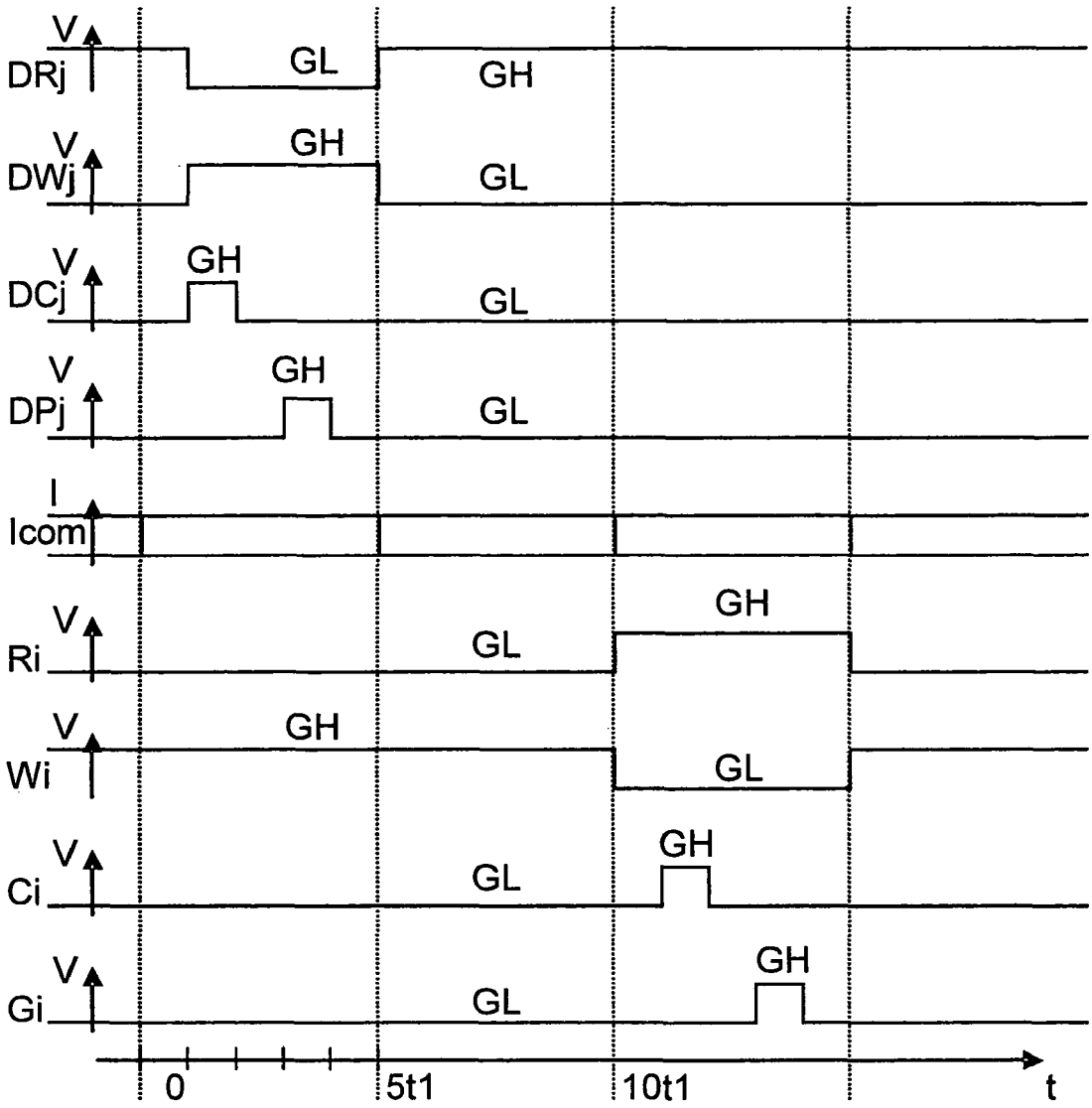
FIG. 18 is a wave form chart illustrating respective operation timings of control wires in a display apparatus in which the source driver circuit shown in FIG. 14 and the pixel circuit shown in FIG. 1 are combined.

Firstly, signals were supplied to the control terminals shown in FIG. 14 and FIG. 1 at timings shown in FIG. 18, respectively.

Figure 19:
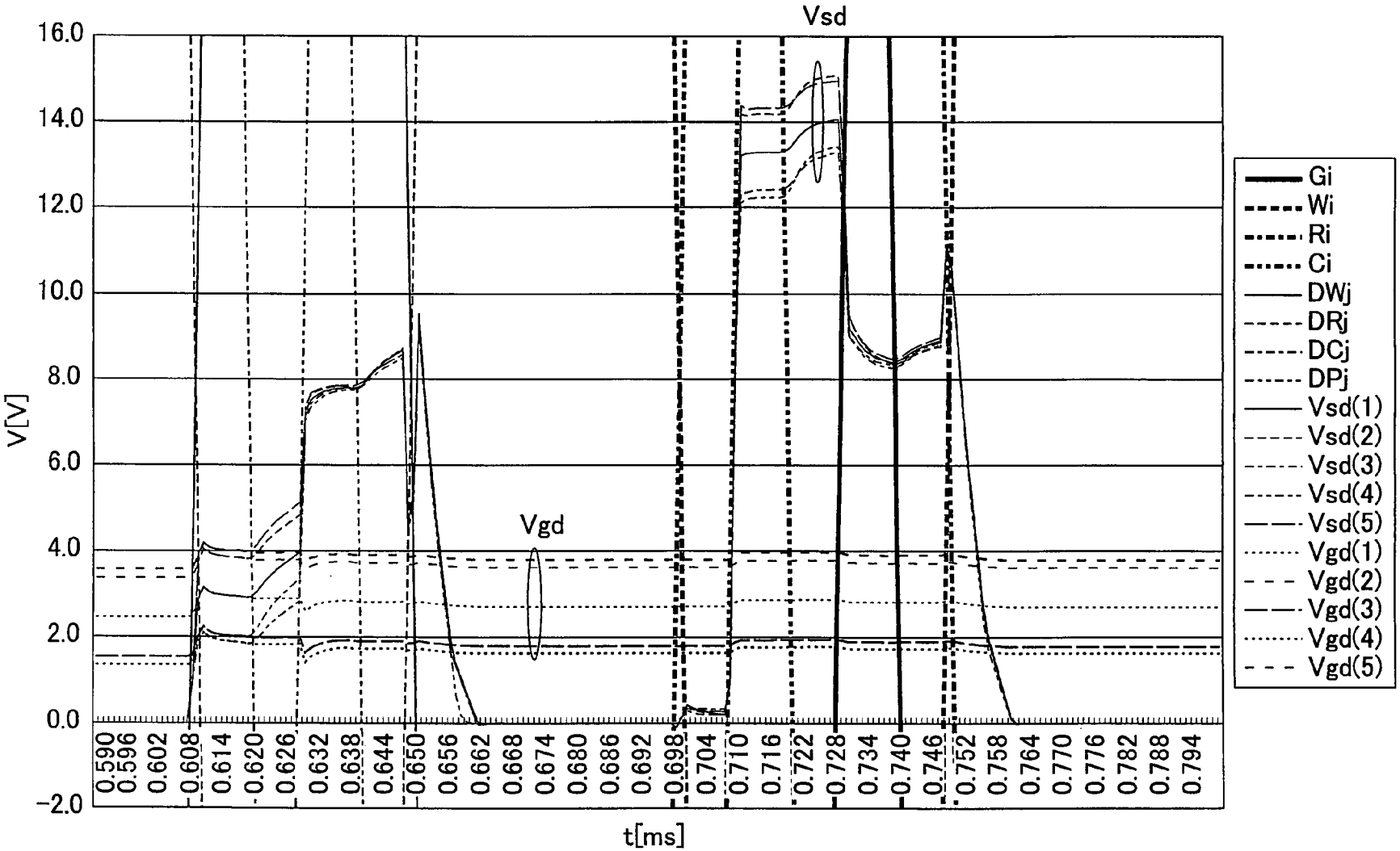
FIG. 19 is a graph illustrating a result of simulating respective changes in a source-gate potential and a source-drain potential of a driving TFT of the source driver circuit of the circuit structure obtained by combining the source driver circuit shown in FIG. 14 with the pixel circuit shown in FIG. 1.
Figure 20:
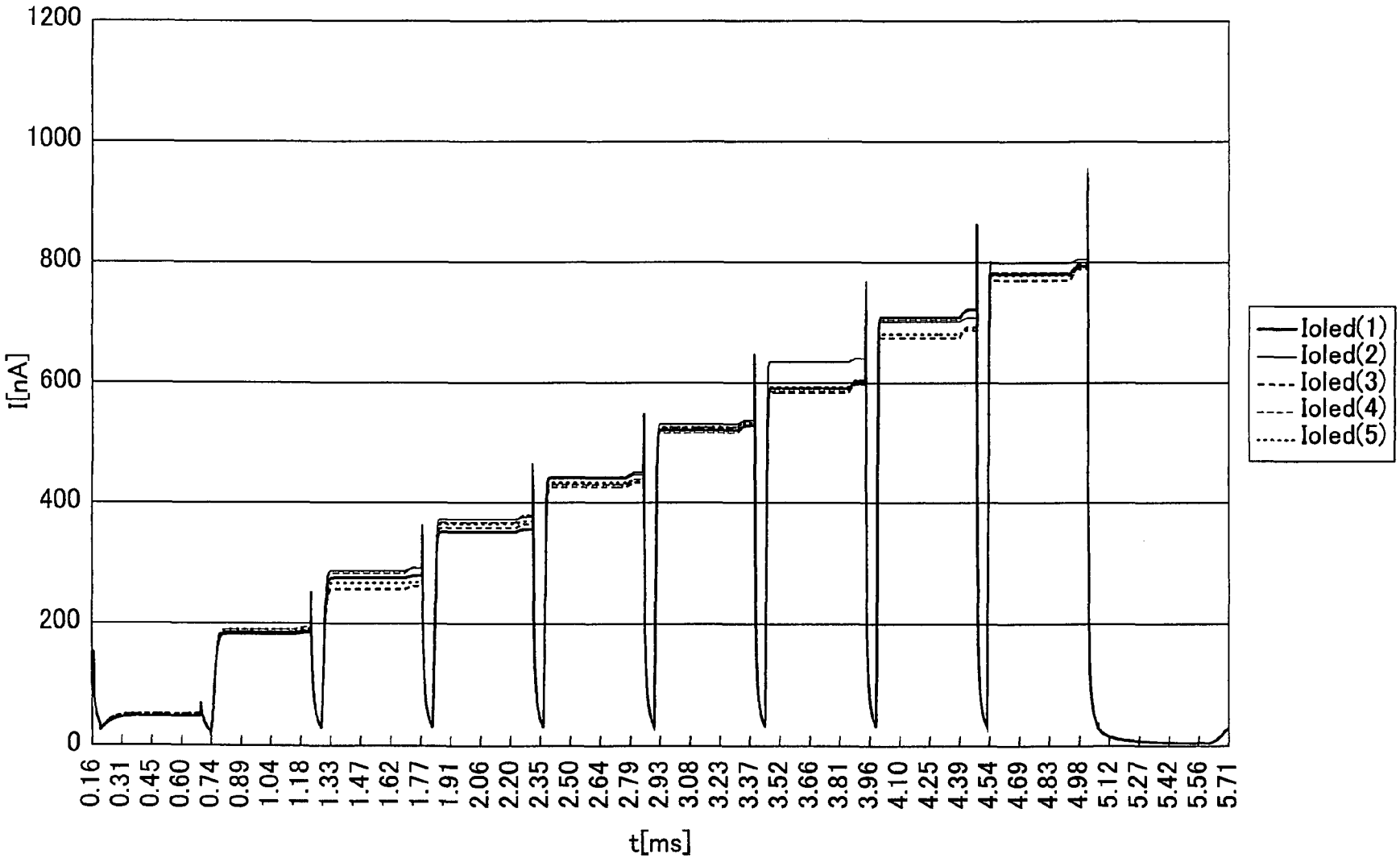
FIG. 20 is a graph illustrating a result of simulating a current flowing through an organic EL element of the pixel circuit of the circuit structure obtained by combining the source driver circuit shown in FIG. 14 with the pixel circuit shown in FIG. 1.

FIG. 19 illustrates a result of the simulation for examining, by way of the driving timings, the source-drain potential Vsd and the source-gate potential Vsg of the driving TFT 31 shown in FIG. 14.

In FIG. 19, a period of time from 0.61 ms to 0.65 ms corresponds to the current setting period of the driving TFT 31 of the source driver circuit shown in FIG. 14. On the other hand, a period of time from 0.70 ms to 0.75 ms corresponds to the selection period of the pixel circuit shown in FIG. 1.

Moreover, a period of time from 0.61 ms to 0.62 ms corresponds to the first period of the driving TFT 31 of the source driver circuit. During the period, the source-drain potentials Vsd of the driving TFT 31 respectively coincided with the gate-drain potentials Vgd thereof, irrespective of the threshold voltage and the mobility in the driving TFT 31.

Next, a period of time from 0.63 ms to 0.64 ms corresponds to the second period of the driving TFT 31 of the source driver circuit. During the period, the source-drain potentials Vsd of the driving TFT 31 respectively coincided with the source-drain potentials Vsd, irrespective of the threshold voltage of the driving TT 31 and the mobility thereof.

Next, a period of time from 0.71 ms to 0.72 ms corresponds to the first period of the pixel circuit. During the period, the source-drain potentials Vsd of the driving TFT 31 of the source driver circuit vary according to the threshold voltage variation and the mobility variation of the driving TFT 1 of the pixel circuit. This causes variation of an output current of the driving TFT 31 of the source driver circuit.

A period of time from 0.73 ms to 0.74 ms corresponds to the second period of the pixel circuit. On the contrary to the first period, during the second period, the source-drain potentials Vsd respectively coincided with the source-drain potentials Vsd, irrespective of the threshold voltage and the mobility of the driving TFT 31 of the pixel circuit. This allows restraint of the variation of a current flowing through the organic EL element 6 provided in the pixel circuit.

Note that, in this case, it is preferable that the source potential of the source driver circuit upon the current readout corresponds to the potential Vb of the predetermined voltage line. In order to obtain such a source potential, the potential Va of the predetermined voltage line in the pixel circuit, and the potential Vb of the predetermined voltage line may be caused to be equal.

As such, the characteristic structure of the present invention can be used as the current output circuit of the source driver circuit, and be used in the pixel circuit. The use of the characteristic structure in any of the circuit structures allows a desired current to flow to the driving TFT irrespective of the threshold voltage of the driving TFT and the mobility thereof.

Figure 23:
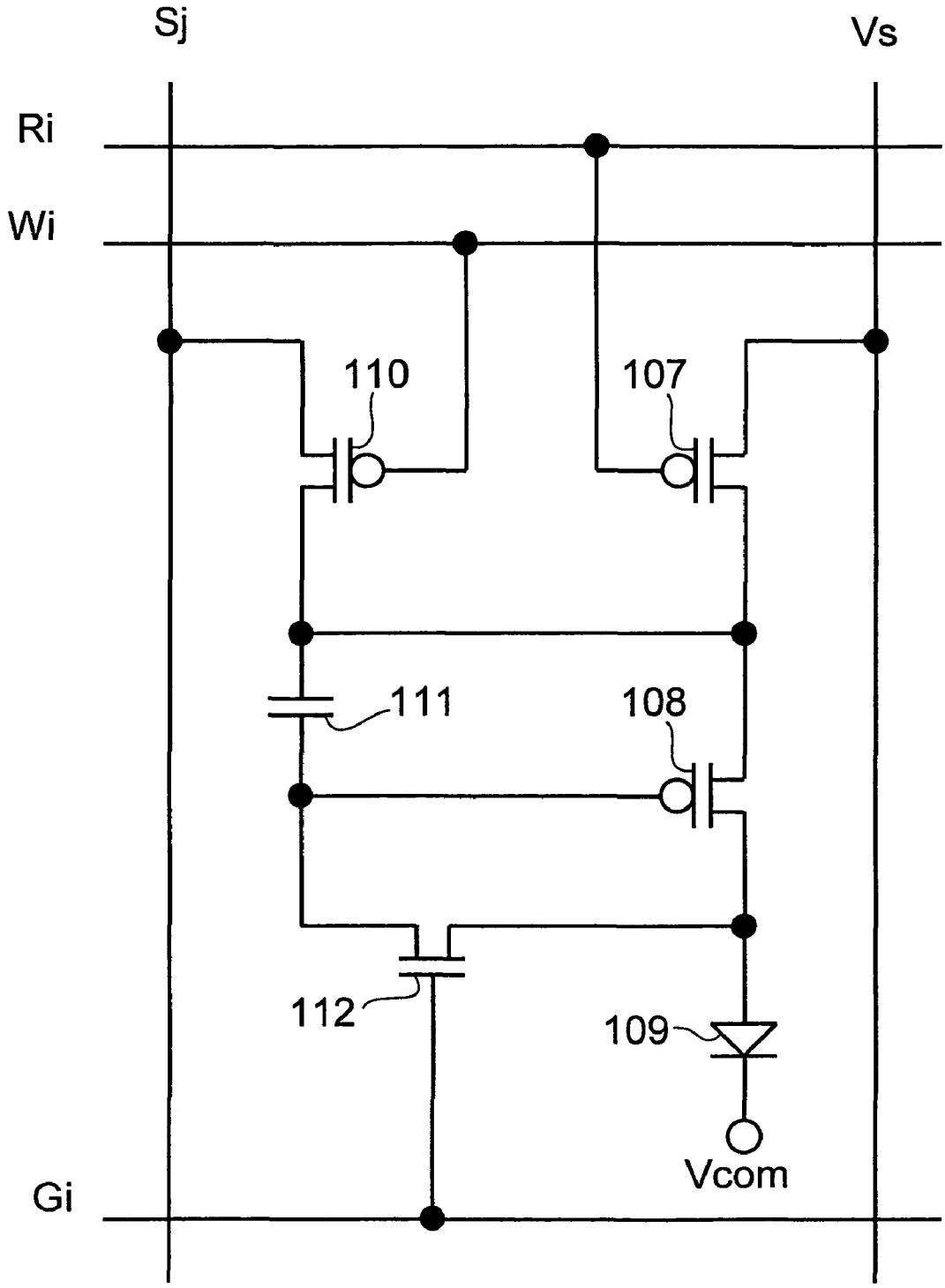
FIG. 23 is another structure example of the pixel circuit of the conventional display apparatus.
Figure 24:
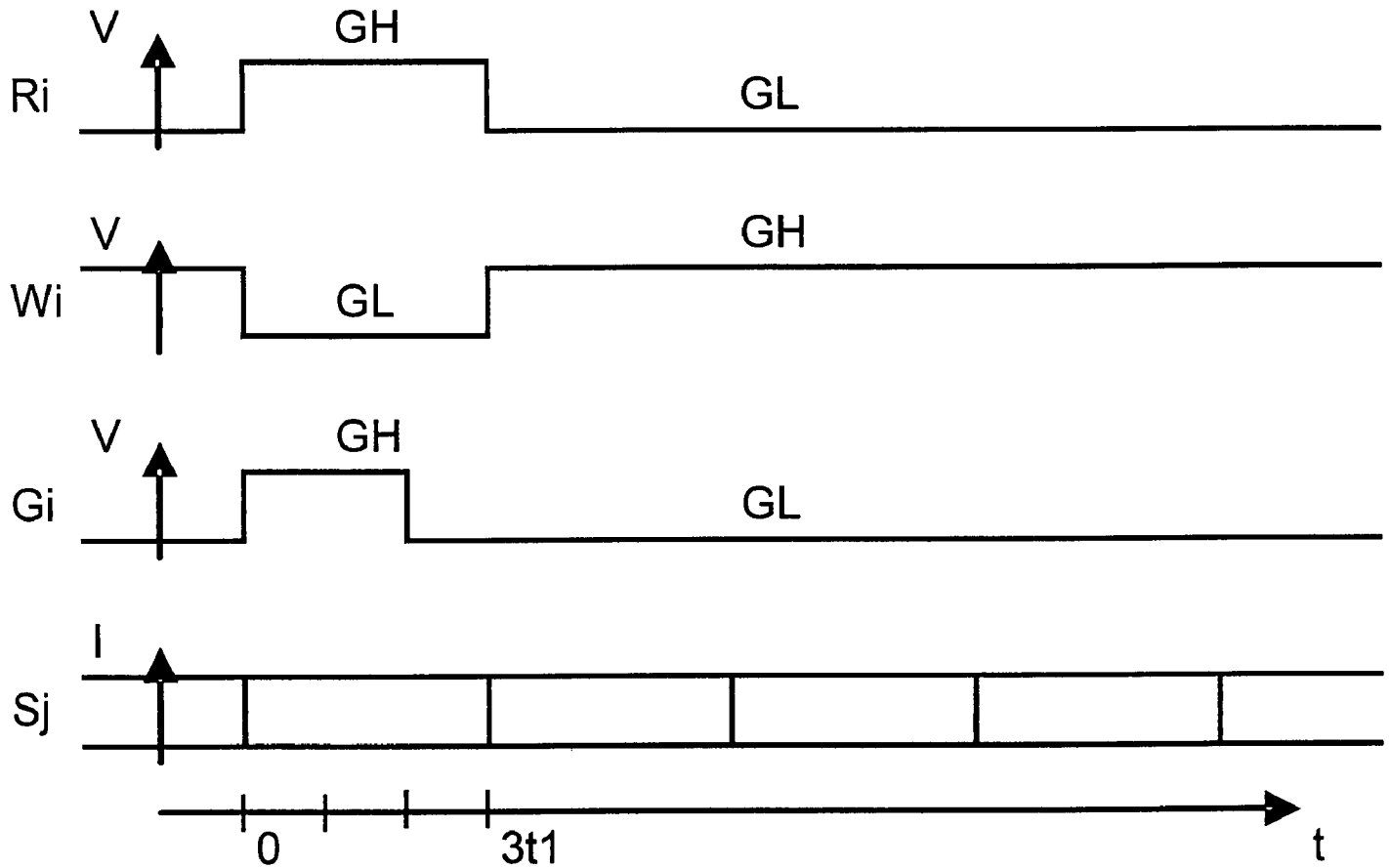
FIG. 24 is a wave form chart illustrating respective operation timings of control wires of the conventional pixel circuit.

Further, in cases where a current is supplied from the source driver circuit as shown in FIG. 23, it is preferable that, in the pixel circuit used together with the source driver circuit, a TFT 31' and TFTs 34' through 38' be p-type transistors.

Figure 21:
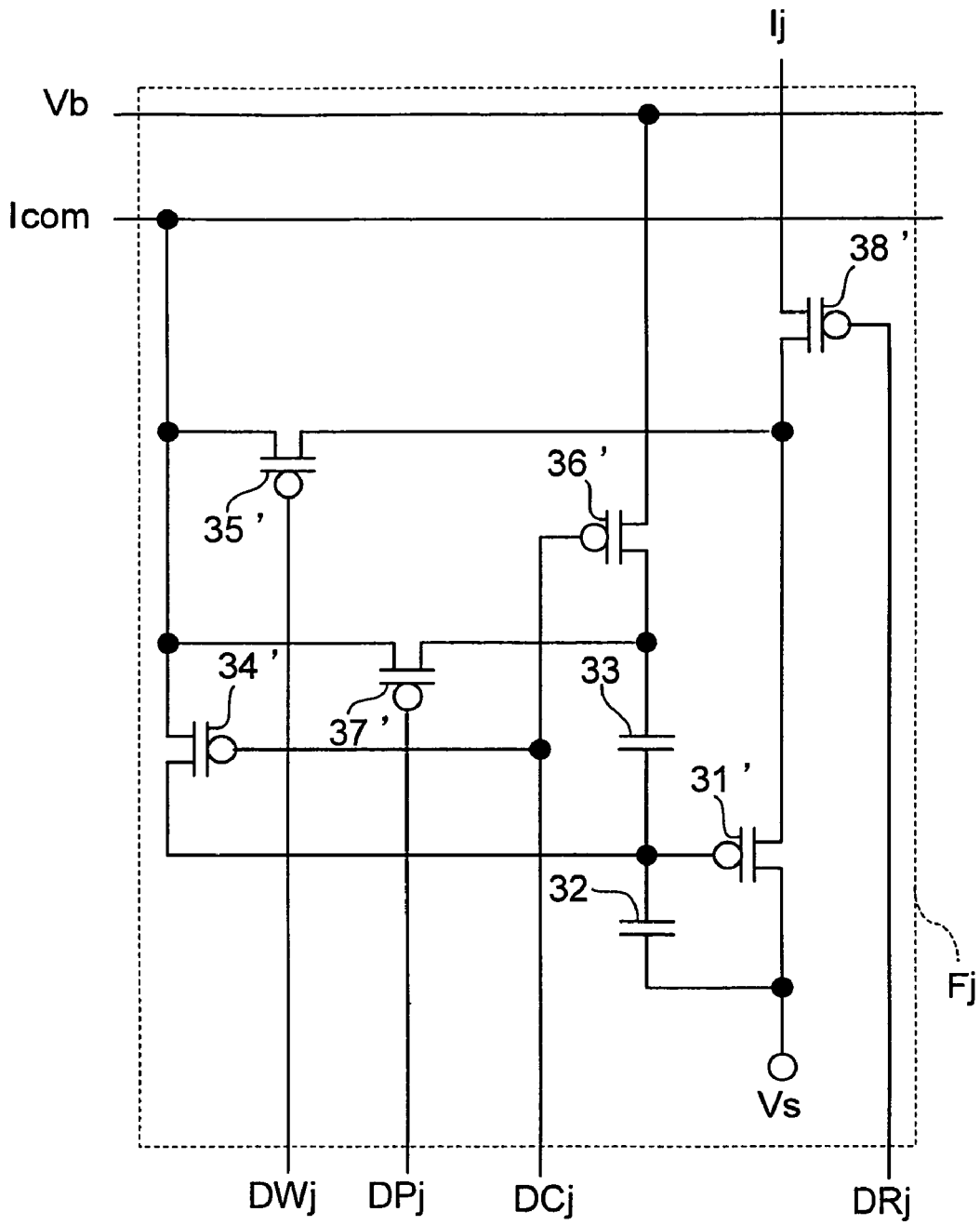
FIG. 21 is a circuit diagram illustrating a structure of the display apparatus according to Embodiment 4, which structure is different from the source driver circuit shown in FIG. 14.

Note that, in the circuit shown FIG. 21, a source terminal of the driving TFT 31' is connected to the power wire Vs, so that this structure is an example to which the first structure of the present invention is applied. The first structure refers to such a structure that the driving TFT 31' outputs a current.

Embodiment 5

Embodiment 5 will explain a third example in which the first characteristic structure according to the present invention is applied to a pixel circuit and a source driver circuit.

A display apparatus according to Embodiment 5 also has such a structure that the components of the characteristic structure of the present invention are separately provided in the pixel circuit and in the source driver circuit. Therefore, the display apparatus have the structure shown in FIG. 7, as is the case with Embodiment 2. For this reason, explanation thereof is omitted here.

Figure 31:
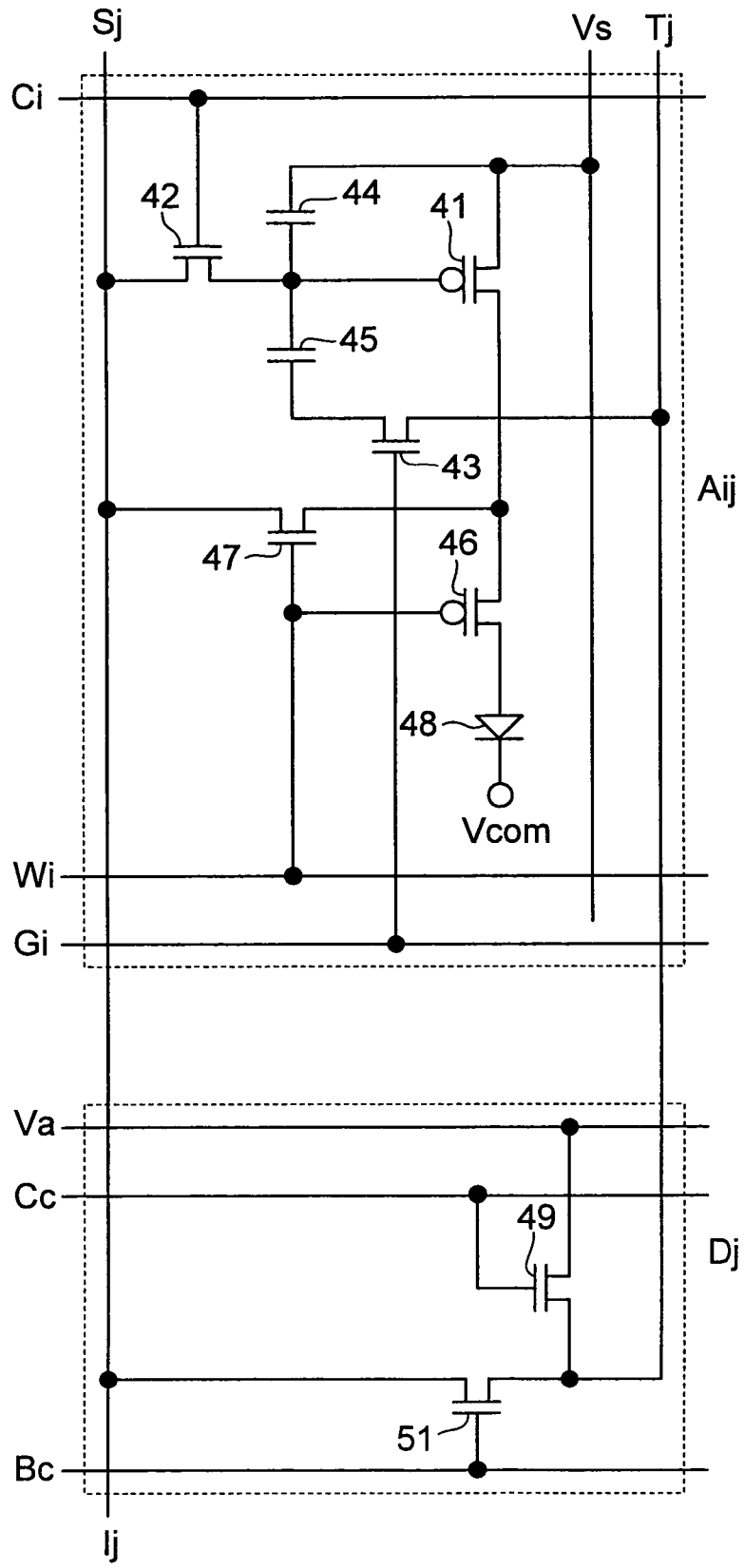
FIG. 31 is a circuit diagram illustrating respective structures of a pixel circuit and a source driver circuit in a display apparatus according to Embodiment 5.

FIG. 31 illustrates respective structures of a pixel circuit Aij and a source driver output terminal circuit Dj serving as an output stage of the source driver circuit 50. Each of the pixel circuit Aij and the source driver output terminal circuit Dj includes the components of characteristic structure of the present invention.

As shown in FIG. 31, in the display apparatus according to Embodiment 5, the pixel circuit Aij is provided in a region in which a source wire Sj and a gate wire Gi intersect with each other. In the pixel circuit Aij, there are provided (i) a driving TFT 41, serving as an active element; (ii) an organic EL element 48, serving as an electric optical element; (iii) a switching TFT 42, serving as a first switching transistor; (iv) a first capacitor 44; and (v) a second capacitor 45. The driving TFT 41 and the organic EL element 48 are provided in series between a power wire Vs and a common wire Vcom.

Further, the driving TFT 41 has a gate terminal (current control terminal) connected to one terminal (hereinafter, referred to as "first terminal") of the first capacitor 44, and to one terminal (hereinafter, referred to as "first terminal") of the second capacitor 45. The other terminal (hereinafter, referred to as "second terminal") of the first capacitor 44 is connected to a source terminal (current input terminal) of the driving TFT 41, and to the power source wire Vs.

Further, the switching TFT 42, which serves as the first switching transistor, is provided between the gate terminal (current control terminal) of the driving TFT 41, and the source wire Sj.

Further, provided in parallel with the source wire Sj is a signal line (connection wire) Tj, which serves as a third wire. The signal line Tj is connected to the other terminal (hereinafter, referred to as "second terminal") of the second capacitor 45 via the switching TFT 43.

Further, a switching TFT 46 is provided between (i) a drain terminal (current output terminal) of the driving TFT 41, and (ii) an anode of the organic EL element 48. A node of the driving TFT 41 and the switching TFT 46 is connected to the source wire Sj via the switching TFT 47.

The switching TFTs 42 and 43, each of which is a component of the pixel circuit Aij, have gate terminals connected to the control wires Ci and Gi, respectively. Moreover, each of the switching TFTs 46 and 47 has a gate terminal connected to the control wire Wi.

In the source driver circuit 50, one output terminal circuit Dj is provided for a plurality of pixel circuits A1*j* through Anj. As shown in FIG. 31, in the output terminal circuit Dj, a switching TFT 51 serving as the second transistor is provided between the signal line Tj and the source wire Sj. Further, a switching TFT 49, serving as the third switching transistor, is provide between the signal line Tj and a predetermined voltage line Va.

In the output terminal circuit Dj, the switching TFT 49 has a gate terminal connected to a control wire Cc. Further, the switching TFT 51 has a gate terminal connected to a control wire Bc.

Figure 32:
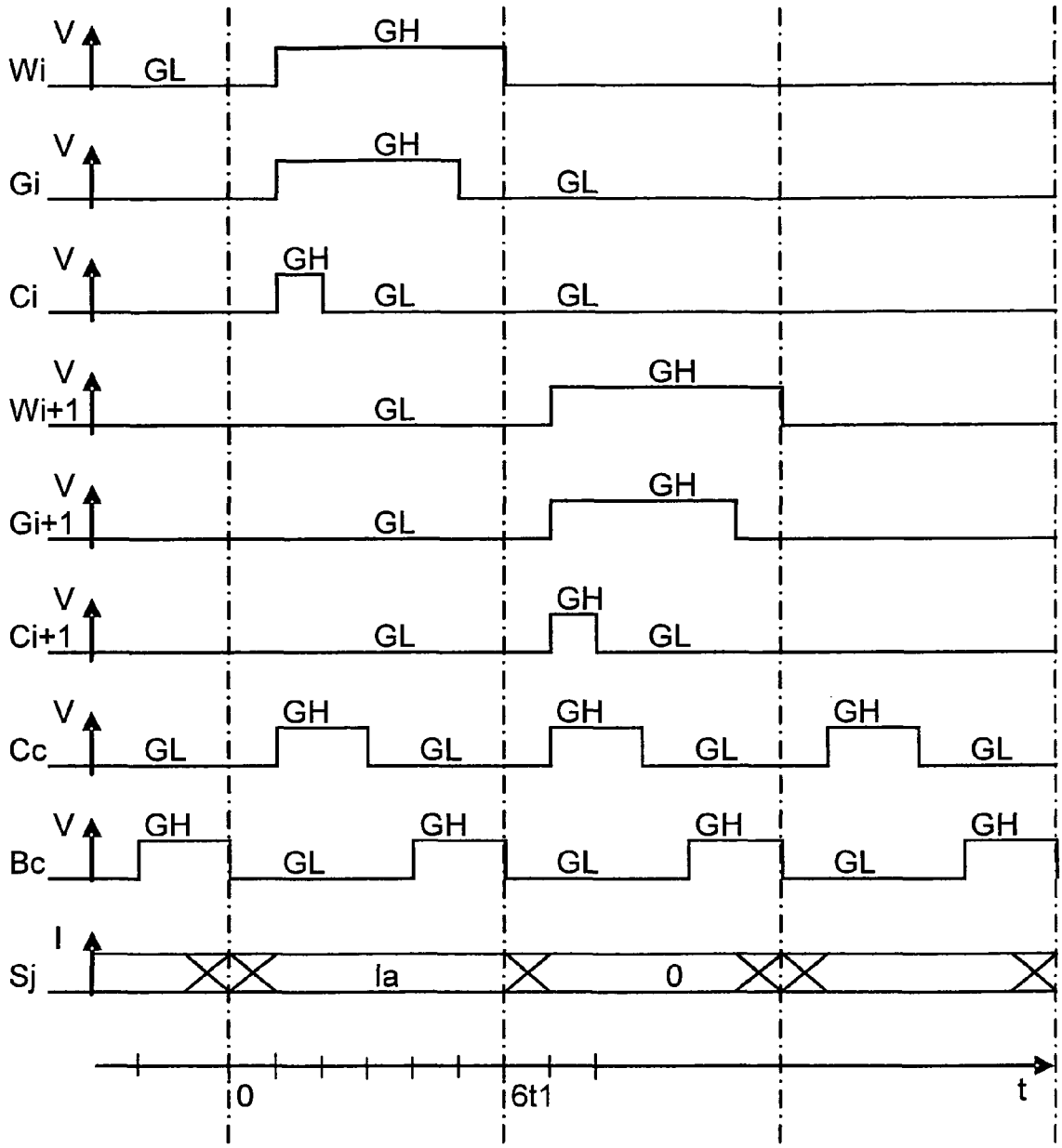
FIG. 32 is a wave form chart illustrating respective operation timings of control wires of the pixel circuit and the source driver circuit.

The following explains respective operations of the pixel circuit Aij and the output terminal circuit Dj in the display apparatus with reference to FIG. 32. FIG. 32 illustrates respective operation timings of the control wires Wi, Gi, Ci, Cc, Bc, and the source wire Sj.

In a driving method according to Embodiment 5, a period of time from t1 to 6*t*1 corresponds to a selection period of the pixel circuit Aij. During the period, a potential of the control wire Wi is set at High (GH) such that the switching TFT 46 is OFF and that switching TFT 47 is ON. Further, during a period of time from t1 to 5*t*1 a potential of the control wire Gi is set at High (GH) such that the switching TFT 43 is ON.

During a first period (time t1 to time 2*t*1) within the selection period of the pixel circuit Aij, a potential of the control wire Ci is set at High such that the switching TFT 42 is ON. This electrically connects the gate terminal of the driving TFT 41 to the source wire Sj. With this, the gate terminal of the driving TFT 41 is electrically connected to the drain terminal thereof via the switching TFTs 42 and 47. Accordingly, a current constantly flows from the power source wire Vs to the current output terminal Ij via the driving TFT 41, the switching TFT 47, and the source wire Sj.

Further, during a period of time t1 to 3*t*1, the potential of the control wire Cc of the output terminal circuit Dj is set at High such that the switching TFT 49 is ON. This connects the second terminal of the second capacitor 45 to the predetermined voltage line Va via the switching TFT 43, the signal line Tj, and the switching TFT 49.

Thereafter, the potential of the control wire Ci is set at Low such that the switching TFT 42 becomes OFF. This causes the first capacitor 44 and the second capacitor 45 to retain the potential that the source wire Sj has on this occasion.

The charge thus retained by the first capacitor 44 and the second capacitor 45 on this occasion causes the driving TFT 41 to have such a gate terminal potential that allows constant current supply as above (as the current supply, during the first period, from the source terminal of the driving TFT 41 to the drain terminal thereof), irrespective of the threshold voltage of the driving TFT 41 and the mobility thereof, while the second terminal of the second capacitor 45 has a potential Va. Thereafter, the control wire Cc is set at Low such that the switching TFT 49 becomes OFF.

Next, during a second period (time 4*t*1 to time 5*t*1), the potential of the control wire Bc is set at High such that the switching TFT 51 is ON. This connects the second terminal of the second capacitor 45 to the drain terminal of the driving TFT 41 via the switching TFTs 43, 51, and 47. With this, a desired current is supplied from the power source wire Vs to the current output terminal Ij via the driving TFT 41, the switching TFT 47, and the source wire Sj.

This allows a current to flow through the driving TFT 41 as above (as the current supply from the source terminal of the driving TFT 41 to the drain terminal thereof, during the first period) even during the second period, irrespective of the threshold voltage and the mobility of the driving TFT 41, while the source-drain potential of the driving TFT 41 is the potential Vs−Va. In other words, the supply of the desired current to the driving TFT 41 determines the gate-source potential of the driving TFT 41 on condition that the source-drain potential of the driving TFT 41 is substantially constant.

At the time 5*t*1 after this, the potential of the control wire Gi is set at Low such that the switching TFT 43 becomes OFF. With this, the source-gate potential of the driving TFT 41 during the second period is retained by the first capacitor 44 and the second capacitor 45.

At the time 6*t*1 after this, the potential of the control wire Bc is set at Low such that the switching TFT 51 becomes OFF. This disconnects the electric connection between the signal line Tj and the source wire Sj. Further, the potential of the control wire Wi is set at Low such that the switching TFT 47 becomes OFF, and that the switching TFT 46 becomes ON. With this, a current flows from the driving TFT 41 to the organic EL element 48.

Now, the selection period of the pixel circuit Aij is over, and a next pixel circuit A (i+1)j is selected.

A simulation was carried out to find a current flowing through the organic EL element 48, with the use of the pixel circuit structure (see FIG. 31) and the output terminal circuit structure (see FIG. 31) of the source driver circuit. A result of the simulation is shown in FIG. 33.

Figure 33:
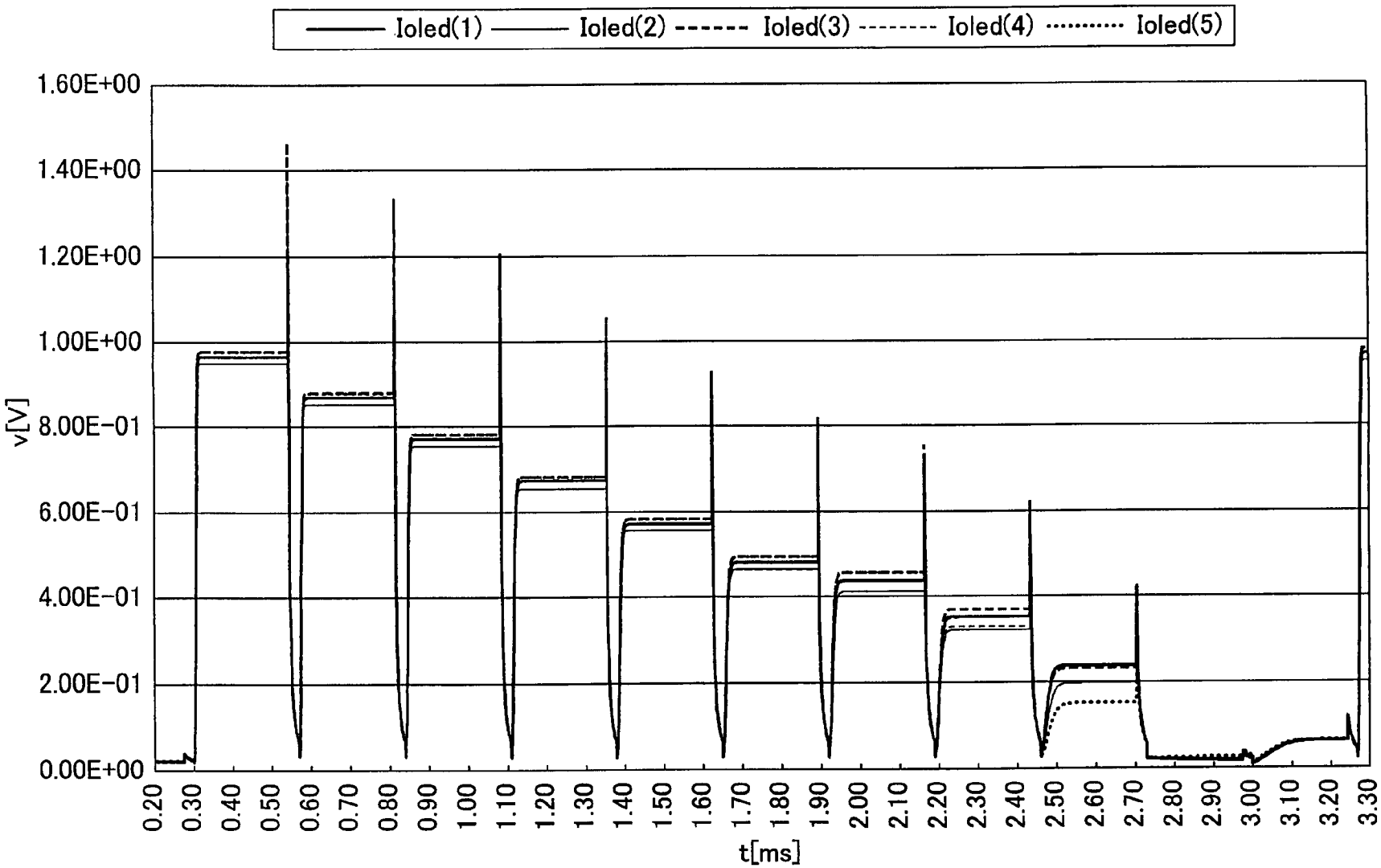
FIG. 33 is a graph illustrating a result of simulating a current flowing from the source terminal of the driving TFT to the drain terminal of the driving TFT, in the pixel circuit and the source driver circuit.

In the simulation of FIG. 33, the selection period came every 0.27 ms. During an initial period of time from 0.30 ms to 0.57 ms, a current of 0.9 μA was set to flow to the source wire Sj. Thereafter, the current was decreased by 0.1 μA every 0.27 ms until the current had a value of 0 μA. Then, the current was set at 0.9 μA again.

Here, a comparison is made between (i) the simulation result (especially, a result corresponding to a period of time from 0.30 ms to 1.9 ms) according to Embodiment 5 in which the second switching transistor and the third switching transistor are provided in the source driver output terminal circuit Dj, and (ii) the simulation result (see FIG. 25) of the conventional technique. The comparison clarifies that the structure of Embodiment 5 also makes it possible to reduce the adverse effect of the threshold voltage variation of the driving TFT 41 and the mobility variation thereof, and accordingly makes it possible to restrain the variation of the current flowing to the organic EL element 48 during the non-selection period.

Embodiment 6

Embodiment 6 will explain a case where the second characteristic structure according to the present invention is applied to a pixel circuit.

Figure 34:
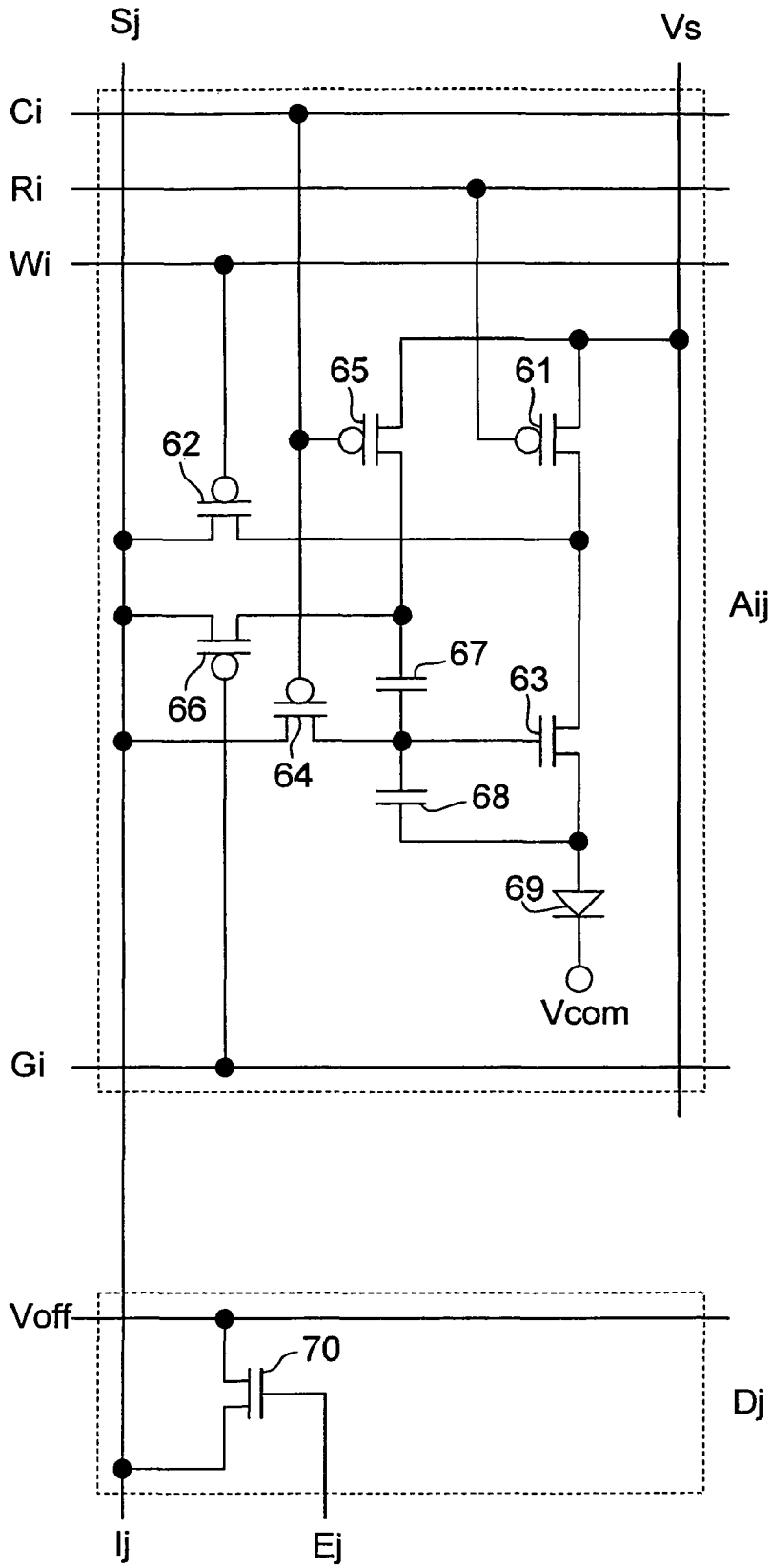
FIG. 34 is a circuit diagram illustrating (i) a structure of a pixel circuit, and (ii) a structure of a source driver circuit in a display apparatus according to Embodiment 6.

As shown in FIG. 34, in each pixel circuit Aij of a display apparatus according to Embodiment 6, a driving TFT 63 and an organic EL element 69 are provided in series between the power source wire Vs and a common wire Vcom. The driving TFT 63 serves as a driving transistor, and the organic EL element 69 serves as an electric optical element.

The driving TFT 63 has a gate terminal (current control terminal) connected to a source wire Sj via a switching TFT 64, which serves as the first switching transistor. Moreover, the gate terminal of the driving TFT 63 is connected to one terminal (hereinafter, referred to as "first terminal") of a first capacitor 68, and to one terminal (hereinafter, referred to as "first terminal") of a second capacitor 67. The other terminal (hereinafter, referred to as "second terminal") of the first capacitor 68 is connected to a drain terminal (current output terminal) of the driving TFT 63, and to an anode of the organic EL element 69. Moreover, the other terminal (hereinafter, referred to as "second terminal") of the second capacitor 67 is connected to a power source wire (predetermined voltage line) Vs via a switching TFT 65, and to the source wire Sj via a switching TFT 66. The switching TFT 65 serves as the third switching transistor, and the switching TFT 66 serves as the second switching transistor.

Respective gate terminals of the switching TFTs 64 and 65 are connected to a control wire Ci, and a gate terminal of the switching TFT 66 is connected to a control wire Gi.

A switching TFT 61 is provided between a source terminal (current input terminal) of the driving TFT 63, and the power source wire Vs. The switching TFT 61 has a gate terminal connected to a control wire Ri. A node of the driving TFT 63 and the switching TFT 61 is connected to the source wire Sj via a switching TFT 62. The switching TFT 62 has a gate terminal connected to the control wire Wi.

Note that any of the control wires Ci, Gi, and Wi may serve as a second wire (gate wire). Note also that any of the switching TFTs 62, 64, and 66 may serve as a selection TFT.

In the circuit structure, the gate terminal of the driving TFT 63 is connected to the source terminal of the driving TFT 63 via the switching TFT 64, the source wire Sj, and the switching TFT 62. Further, the second terminal of the second capacitor 67 is connected to the source terminal of the driving TFT 63 via the switching TFT 66, the source wire Sj, and the switching TFT 62.

Figure 35:
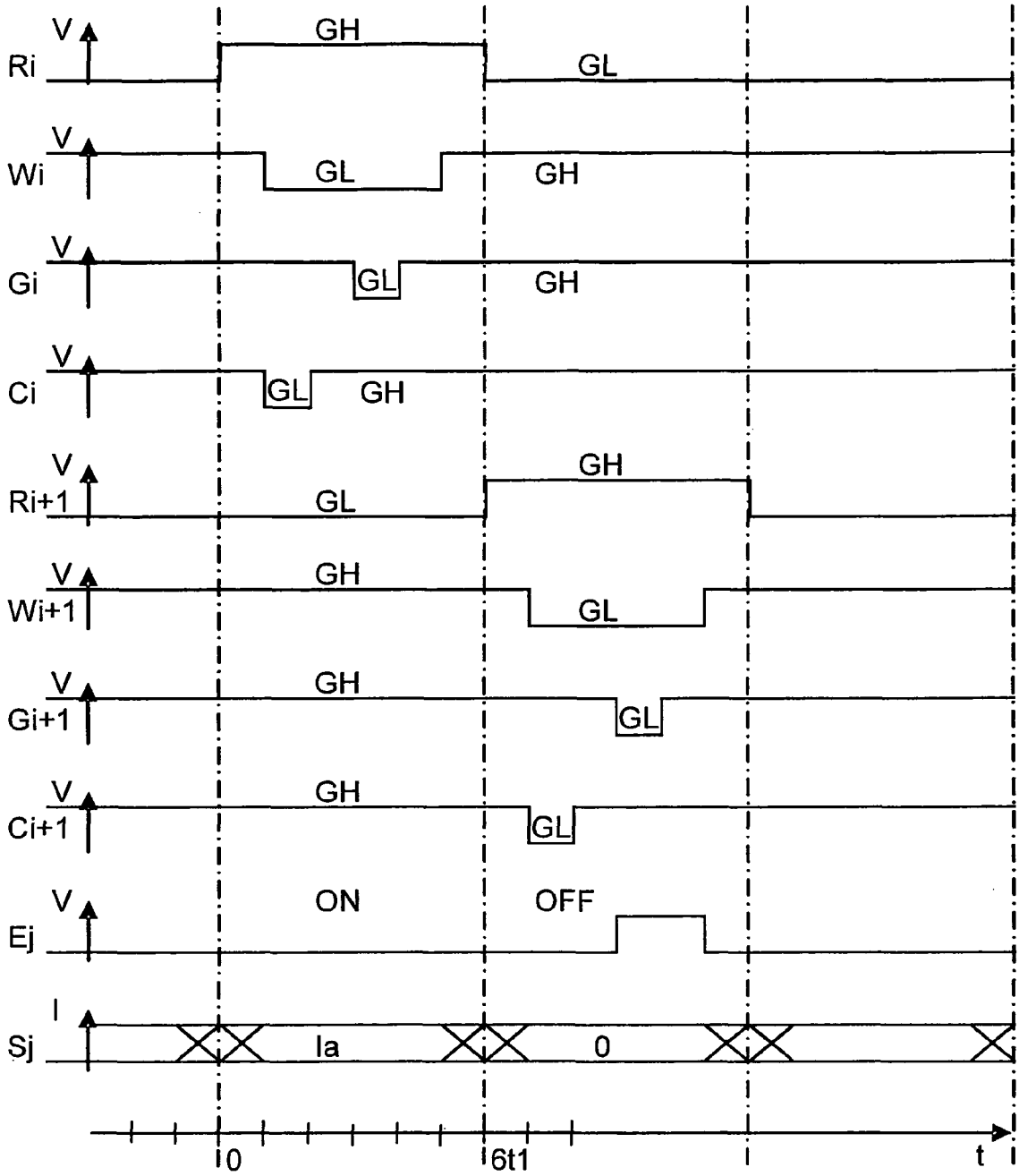
FIG. 35 is a wave form chart illustrating respective operation timings of control wires of the pixel circuit and the source driver circuit.

The following explains an operation of the pixel circuit Aij of the display apparatus with reference to FIG. 35. FIG. 35 illustrates respective operation timings of the control wires Ri, Wi, Ci, Gi, and the source wire Sj.

In a driving method according to Embodiment 6, the selection period corresponds to a period of time from 0 to 6*t*1. During the period, a potential of the control wire Ri is set at High (GH) such that the switching TFT 61 is OFF. Moreover, during a period of time from t1 to 5*t*1, a potential of the control wire Wi is set at Low (GL) such that the switching TFT 62 is ON.

During the first period (time t1 to 2*t*1), a potential of the control wire Ci is set at Low such that the switching TFTs 64 and 65 are ON. This connects the gate terminal of the driving TFT 63 to the source terminal thereof via the switching TFTs 64 and 62. This also connects the second terminal of the second capacitor 67 to the power source line (predetermined voltage line) Vs via the switching TFT 65. With this, a current flows constantly from a source driver circuit (not shown) to the organic EL element 69 via the source wire Sj, the switching TFT 62, and the driving TFT 63.

Thereafter (at the time 2*t*1), the potential of the control wire Ci is set at High such that the switching TFTs 64 and 65 become OFF. This causes the first capacitor 68 and the second capacitor 67 to retain the potential, determined during the first period, of the source wire Sj.

Next, during the second period (time 3*t*1 to 4*t*1), a potential of the control wire Gi is set at Low such that the switching TFT 66 is ON. This connects the second terminal of the second capacitor 67 to the source terminal of the driving TFT 63 via the switching TFTs 66 and 62. With this, a predetermined current flows from the source driver circuit (not shown) to the organic EL element 69 via the source wire Sj, the switching TFT 62, the driving TFT 63.

Thereafter (at the time 4*t*1), the potential of the control wire Gi is set at High such that the switching TFT 66 becomes OFF. This causes the first capacitor 68 and the second capacitor 67 to retain the drain-gate potential, determined during the second period, of the driving TFT 63.

Thereafter, the potential of the control wire Wi is set at High such that the switching TFT 62 becomes OFF, and the potential of the control wire Ri is set at Low such that the switching TFT 61 becomes ON.

Now, the selection period of the pixel circuit Aij is over, and a next pixel circuit A(i+1)j is selected.

Note that, in the source driver output terminal circuit Dj shown in FIG. 34, a switching TFT 70, serving as a fourth transistor, is provided between an OFF potential line Voff and the source wire Sj.

The switching TFT 70 has a gate terminal connected to a control wire Ej. In the case of supplying no current to the selected organic EL element 69, the control wire Ej is set at High during the second period (9*t*1 to 11*t*1) such that the switching TFT 70 is ON, as shown in FIG. 35. This allows an open connection between the source wire Sj and the current output circuit of the source driver. With this, an OFF potential is supplied from the OFF potential line Voff to the source wire.

The OFF potential is a potential equal to or lower than a potential of the common electrode Vcom. Therefore, when the OFF potential supplied via the switching TFT 62 becomes the source potential of the driving TFT 63, or when the OFF potential causes the switching TFT 62 to be OFF, the gate potential of the driving TFT 63 is discharged from the source terminal thereof. This decreases the gate potential of the driving TFT 63 to a potential lower than the potential that driving TFT 63 had during the first period, with the result that the driving TFT 63 becomes OFF.

A simulation was carried out to find a current flowing through the organic EL element 69, with the use of the pixel circuit structure (see FIG. 34) and the output terminal circuit structure (see FIG. 34) of the source driver circuit. A result of the simulation is shown in FIG. 36.

Figure 36:
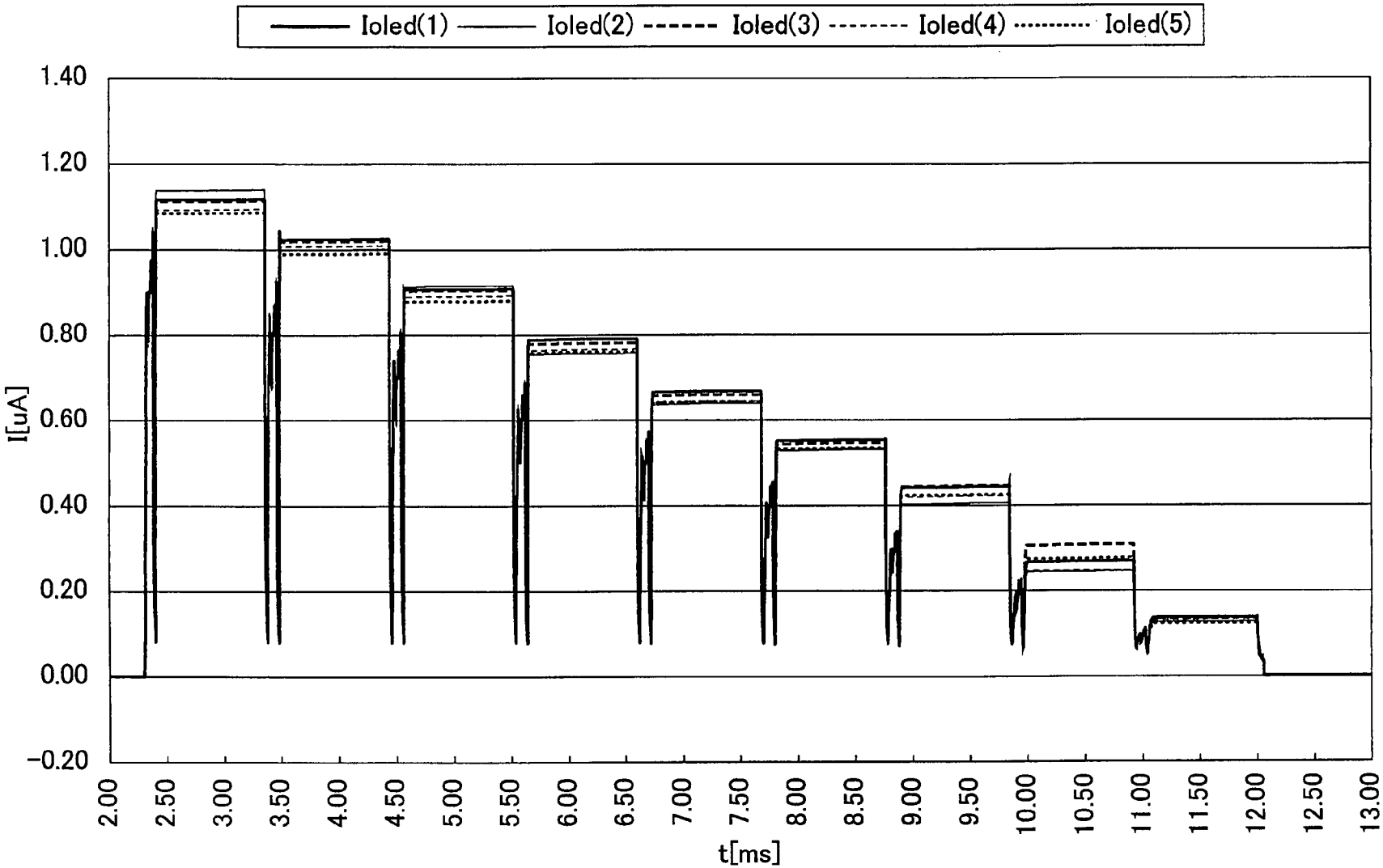
FIG. 36 is a graph illustrating a result of simulating a current flowing from a source of a driving TFT to a drain thereof in the pixel circuit and the source driver circuit.

In the simulation of FIG. 36, the selection period came every 1.08 ms. During an initial period of time from 2.30 ms to 3.38 ms, a current of 1.1 μA was set to flow to the source wire Sj. Thereafter, the current decreased by 0.12 μA every 1.08 ms until no current (a current of 0.1 μA) flowed. Then, the current of 1.1 μA was set to flow again.

Here, a comparison is made between (i) the simulation result according to Embodiment 6 employing a structure that controls the current control terminal of the driving transistor and the current input terminal thereof, and (ii) the simulation result (see FIG. 25) of the conventional technique. The comparison clarifies that the structure of Embodiment 6 also makes it possible to reduce the adverse effect of the threshold voltage variation and the mobility variation of the driving TFT 63, and accordingly makes it possible to restrain the variation of the current flowing to the organic EL element 69 during the non-selection period.

Note that there is provided, in the pixel circuit structure shown in FIG. 1, the power source wire Va for supplying the predetermined potential Va to the second terminal of the second capacitor 7. However, in the pixel circuit to which the second characteristic structure according to the present invention is applied, the predetermined potential wire and the power source wire Vs can be shared with each other. For this reason, no power source wire Va may be provided as shown in FIG. 34.

Figure 37:
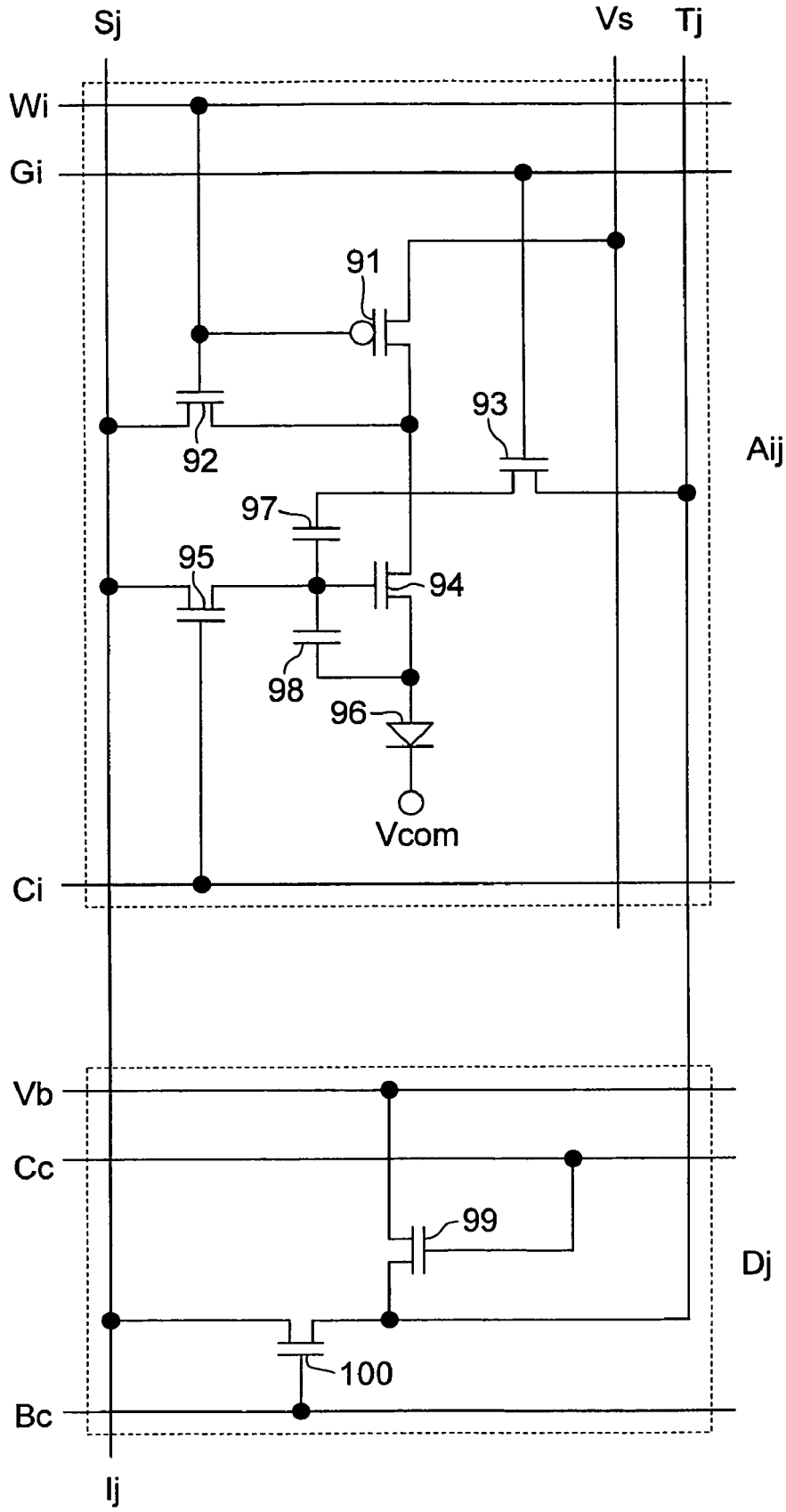
FIG. 37 is a circuit diagram illustrating respective structures of another pixel circuit and another source driver circuit in the display apparatus according to Embodiment 6.

Further, there may be provided, in the source driver circuit, a part of the components of the means of the present invention, i.e., one or more of the driving TFT, the first capacitor, the second capacitor, the first switching transistor, the second switching transistor, and the third switching transistor, as shown in FIG. 37.

Specifically, in a pixel circuit structure Aij shown in FIG. 37, a first capacitor 98 is provided between a gate of a driving TFT 94 and a drain thereof, a first switching TFT 95 is provided between a gate terminal of the driving TFT 94 and the source wire Sj, and a second capacitor 97 and a switching TFT 93 are provided in series between a gate terminal of the driving TFT 94 and a signal line Tj. An organic EL element 96 is provided between a drain terminal of the driving TFT 94 and a common electrode Vcom. Moreover, a switching TFT 91 is provided between a source terminal of the driving TFT 94 and a power source wire Vs. Further, a switching TFT 92 is provided between the source terminal of the driving TFT 94 and a source wire Sj.

Moreover, in a source driver output terminal circuit Dj, a switching TFT 100, serving as the second switching transistor, is provided between the signal line Tj and the source wire Sj. Provided between the signal Tj and the predetermined voltage line Vb is a switching TFT 99, which serves as the third switching transistor.

As is the case with the pixel circuit shown in FIG. 31, the timings shown in FIG. 32 also respectively correspond to timings of the driving operation using the pixel circuit Aij and the source driver output terminal circuit Dj. For this reason, explanation thereof is omitted here.

Embodiment 7

Embodiment 7 explains another example in which the second characteristic structure according to the present invention is applied to a pixel circuit and a source driver circuit.

A display apparatus according to Embodiment 7 also has such a structure in which the components of the characteristic structure of the present invention are separately provided in the pixel circuit and the source driver circuit. Therefore, the display apparatus has a structure shown in FIG. 7 as is the case with Embodiment 2, so that explanation thereof is omitted here.

Figure 38:
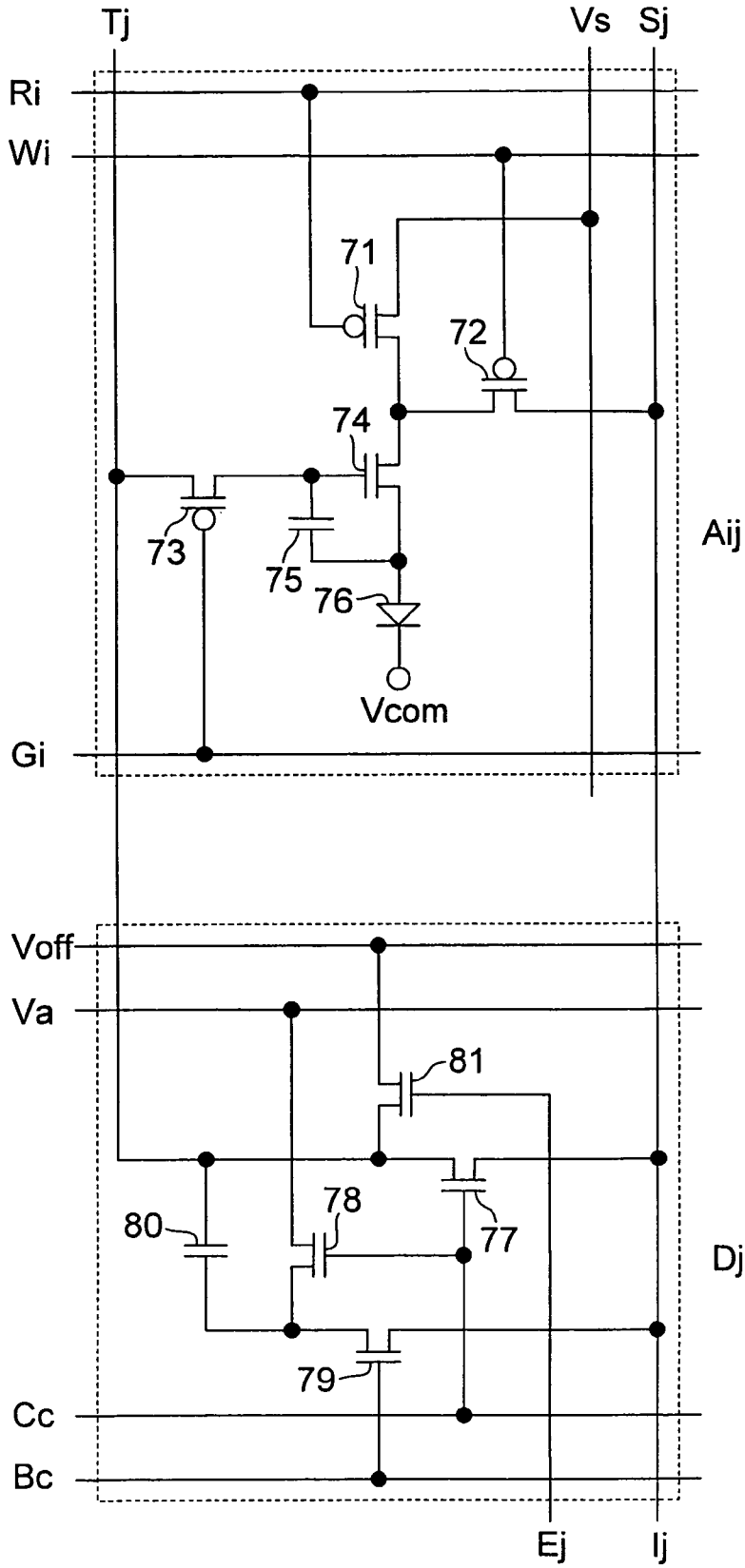
FIG. 38 is a circuit diagram illustrating respective structures of a pixel circuit and a source driver circuit in a display apparatus according to Embodiment 7.

FIG. 38 illustrates respective structures of the pixel circuit Aij and the source driver output terminal circuit Dj, which serves as an output stage of the source driver circuit 50. Each of the pixel circuit Aij and the source driver output terminal circuit Dj includes the components of the characteristic structure of the present invention.

As shown in FIG. 38, in the display apparatus according to Embodiment 7, each pixel circuit Aij is provided in a region in which a source wire Sj and a gate wire Gi intersect with each other. Provided in the pixel circuit Aij are a driving TFT 74, an organic EL element 76, and a first capacitor 75. The driving TFT 74 serves as an active element, and the organic EL element 76 serves as an electric optical element, and the driving TFT 74 and the organic EL element 76 are provided in series between a power source wire Vs and a common wire Vcom.

The driving TFT 74 has a gate terminal (current control terminal) connected to one terminal (hereinafter, referred to as "first terminal") of the first capacitor 75. The other terminal (hereinafter, referred to as "second terminal") of the first capacitor 75 is connected to a drain terminal (current output terminal) of the driving TFT 74, and to an anode of the organic EL element 76.

Further, in the pixel circuit structure, a signal line Tj, serving as the third wire, is provided in parallel with the source wire Sj, and is connected to the gate terminal of the driving TFT 74 via the switching TFT 73.

Further, a switching TFT 71 is provided between a source terminal (current input terminal) of the driving TFT 74, and the power wire Vs. A node of the driving TFT 74 and the switching TFT 71 is connected to the source wire Sj via a switching TFT 72.

These components of the pixel circuit Aij, i.e., the switching TFTs 73, 72, 71 have gate terminals connected to control wires Gi, Wi, and Ri, respectively.

In the source driver circuit 50, each output terminal circuit Dj is provided for a plurality of pixel circuits A1*j* through Anj. In the output terminal circuit Dj, the signal line Tj is connected to one terminal (hereinafter, referred to as "first terminal") of a second capacitor 80 as shown in FIG. 38. Moreover, provided between the signal line Tj and the source wire Sj is a switching TFT 77, which serves as the first switching transistor. Further, a switching TFT 78, serving as the third switching transistor, is provided between (i) the other terminal (hereinafter, referred to as "second terminal") of the second capacitor 80, and (ii) a predetermined voltage line Va. Provided between the second terminal of the second capacitor 80 and the source wire Sj is a switching TFT 79, which serves as the second switching transistor. Further, a switching TFT 81, serving as the fourth switching transistor, is provided between the signal line Tj and an OFF potential line Voff.

In the output terminal circuit Dj, the switching TFT 81 has a gate terminal connected to a control wire Ej, and the switching TFTs 77 and 78 each have gate terminals connected to a control wire Cc, and the switching TFT 79 has a gate terminal connected to a control wire Bc.

Figure 39:
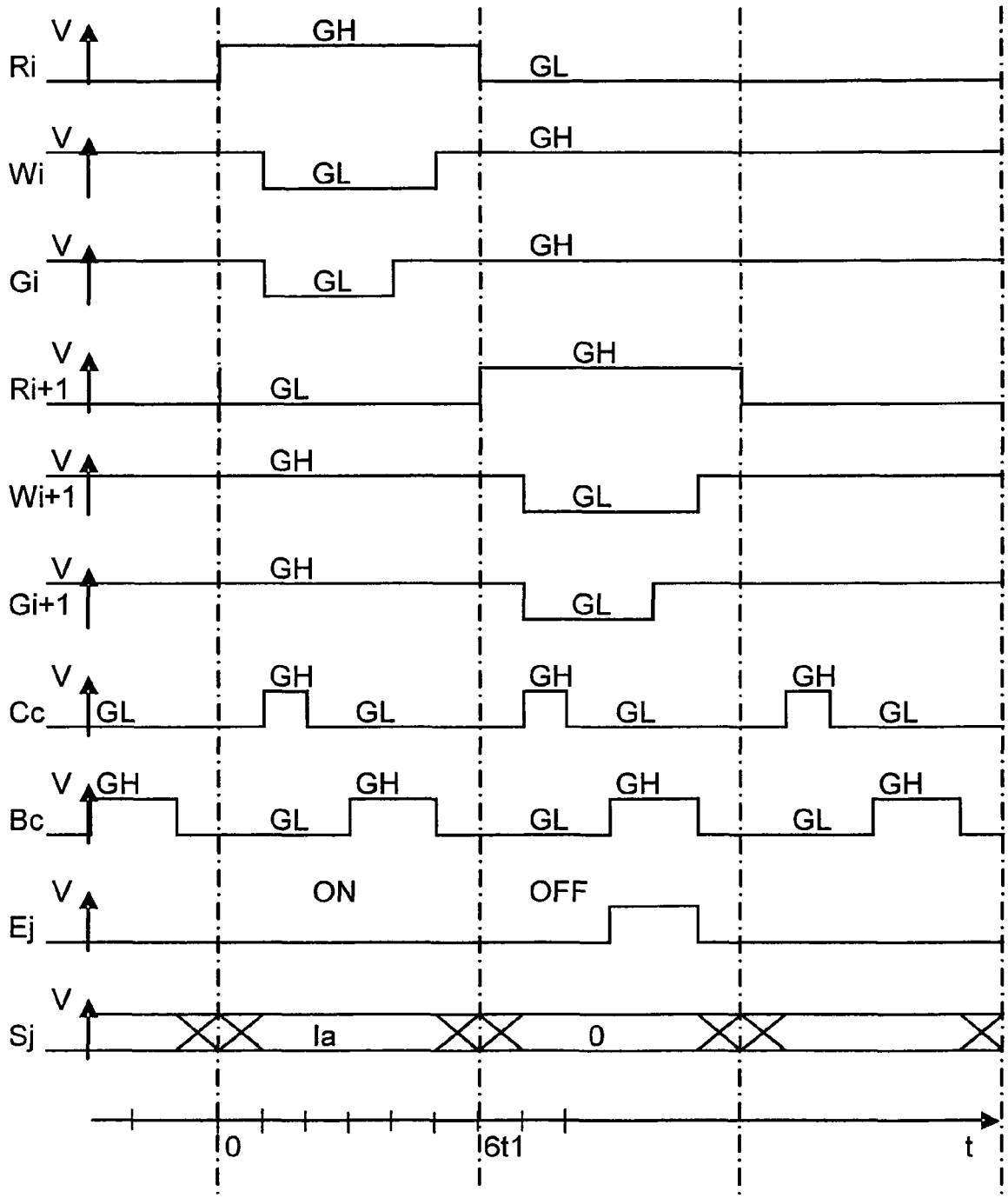
FIG. 39 is a wave form chart illustrating respective operation timings of control wires of the pixel circuit and the source driver circuit.

The following explains respective operations of the pixel circuit Aij and the output terminal circuit Dj in the display apparatus with reference to FIG. 39. FIG. 39 illustrates respective operation timings of the control wires Ri, Wi, Gi, Cc, Bc, Ej, and the source wire Sj.

In a driving method according to Embodiment 7, the selection period of the pixel circuit Aij corresponds to a period of time from 0 to 6*t*1. During the period, a potential of the control wire Ri is set at High (GH) such that the switching TFT 71 is OFF. Further, during a period of time from t1 to 5*t*1, a potential of the control wire Wi is set at Low (GL) such that the switching TFT 72 is ON. This connects the source terminal of the driving TFT 74 to the source wire Sj.

Further, in the pixel circuit Aij, during a period of time from t1 to 4*t*1, a potential of the control wire Gi is set at Low such that the switching TFT 73 is ON. This electrically connects the gate terminal of the driving TFT 74 to the signal line Tj. With this, the gate terminal of the driving TFT 74 is connected to the first capacitor 75 and the second capacitor 80.

Meanwhile, in the output terminal circuit Dj, during a first period (time t1 to time 2*t*1), a potential of the control wire Cc is set at High such that the switching TFTs 77 and 78 are ON. This electrically connects the gate terminal of the driving TFT 74 to the source terminal thereof via the switching TFTs 73, 77, and 72. This also connects the second terminal of the second capacitor 80 to the predetermined voltage line Va via the switching TFT 78. With this, a current constantly flows from the source driver circuit (not shown) to the organic EL element 76 via the source wire Sj, the switching TFT 72, and the driving TFT 74.

Thereafter, the potential of the control wire Cc is set at Low such that the switching TFTs 77 and 78 become OFF. This causes the first capacitor 75 and the second capacitor 80 to retain the potential that the signal wire Tj has on this occasion.

The charge thus stored by the first capacitor 75 and the second capacitor 80 on this occasion causes the driving TFT 74 to have a gate potential allowing constant current supply as above (as the aforesaid current supply, during the first period, from the source terminal of the driving TFT 74 to the drain terminal thereof), while the second terminal of the second capacitor 80 has a potential Va, irrespective of the threshold voltage of the driving TFT 74 and the mobility thereof.

Next, during a second period (time 3*t*1 to time 4*t*1), the potential of the control wire Bc is set at High such that the switching TFT 79 becomes ON. This connects the second terminal of the second capacitor 80 to the source terminal of the driving TFT 74 via the switching TFTs 79 and 72. With this, a desired current flows from the source driver circuit (not shown) to the organic EL element 76 via the source wire Sj, the switching TFT 72, and the driving TFT 74.

This allows a current to flow through the driving TFT 74 as above (as the current supply, during the first period, from the source of the driving TFT 74 to the drain thereof) even during the second period irrespective of the threshold voltage and the mobility of the driving TFT 74, while the source-drain potential of the driving TFT 74 is the potential Va−Vx (Vx indicates an anode potential that the organic EL element 76 has during the second period). In other words, the supply of the desired current to the driving TFT 74 can determine the gate-source potential of the driving TFT on condition that the source-drain potential of the driving TFT 74 is substantially constant.

At the time 4*t*1 after this, the potential of the control wire Gi is set at High such that the switching TFT 73 becomes OFF. This causes the first capacitor 75 to retain the drain-gate potential that the driving TFT 74 had during the second period.

At the time 5*t*1 after this, the potential of the control wire Bc is set at Low such that the switching TFT 79 becomes OFF. This disconnects the electric connection between the second capacitor 80 and the source wire Sj. Moreover, the potential of the control wire Wi is set at High such that the switching TFT 72 becomes OFF. This disconnects the electric connection between the source terminal of the driving TFT 74 and the source wire Sj. Further, at the time 6*t*1, the potential of the control wire Ri is set at Low such that the switching TFT 71 becomes ON. With this, a current flows from the driving TFT 74 to the organic EL element 76.

Now, the selection period of the pixel circuit Aij is over, and then a following pixel circuit A(i+1)j is selected.

Further, during a period of time from 9*t*1 to 11*t*1 in FIG. 39, the potential of the control wire Ej is set at High such that the switching TFT 81 becomes ON. This causes an OFF potential Voff to be supplied to the signal line Tj, with the result that the signal line Tj is caused to have the OFF potential. This allows substantially no current to flow into the organic EL element 76 during the non-selection period. Note that, during the period, the potential of the control wire Cc is Low, and the potential of the control wire Bc is High.

A simulation was carried out to find a current flowing through the organic EL element 76, with the use of the pixel circuit structure and the output terminal circuit structure of the source driver circuit. A result of the simulation was similar to the result of Embodiment 6.

Embodiment 8

Embodiment 8 will explain a characteristic operation of a driving method according to the present invention. The driving method of Embodiment 8 solves a problem that arises in Embodiment 2 in which the components of the characteristic structure of the present invention are provided separately in the pixel circuit and the source driver circuit. Firstly, this problem is explained.

In an actual display apparatus, stray capacitances exist in the source wire Sj and the signal wire Tj, which are provided across the pixel circuit Aij (see FIG. 8) and the source driver output terminal circuit Dj (see FIG. 8). Supposing that each stray capacitance is 5 pF, a simulation was carried out to examine respective changes of (i) a current Ip flowing through the driving TFT 11 of the pixel circuit Aij shown in FIG. 8, and (ii) the source-drain potential Vsd of the driving TFT 11. A result of the simulation is shown in FIG. 40.

Figure 40:
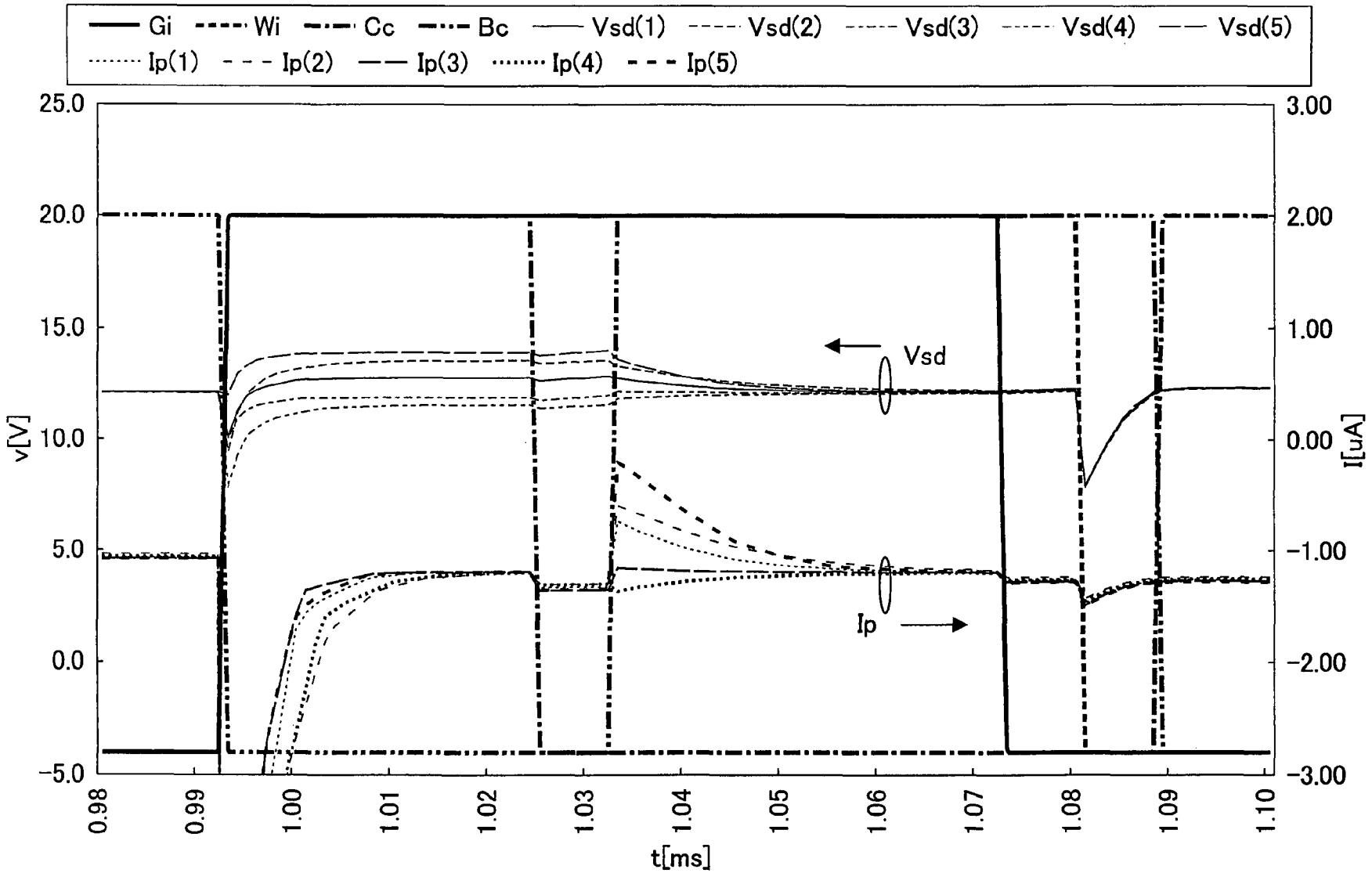
FIG. 40 is a graph illustrating a result of simulating respective changes in the source-gate potential and the source-drain potential of the driving TFT in the pixel circuit shown in FIG. 8 and the source driver circuit shown therein.

In FIG. 40, a period of time from 0.992 ms to 1.080 ms corresponds to the selection period. During the period, the control wire Ri was set at High such that the switching TFT 13 was OFF, and the control wire Wi was set at Low such that the switching TFT 14 was ON. Moreover, a period of time from 0.992 ms to 1.024 ms corresponds to the first period in the driving method of the present invention. During the period, the gate wire Gi was set at High such that the switching TFT 15 was ON, and the control wire Cj was set at High such that the switching TFTs 22 and 23 were ON.

This short-circuited the gate terminal of the driving TFT 11 and the drain terminal thereof, with the result that the gate terminal of the driving TFT 11 was connected to the capacitors 12 and 25, and that the second terminal of the capacitor 25 was connected to the predetermined voltage line Va. It took 20 μs until the gate-source potential Vsd of the driving TFT 11 became stable. Thereafter, the control wire Cj was set at Low such that the switching TFTs 22 and 23 became OFF. Now, the first period was finished.

Further, a period of time from 1.034 ms to 1.074 ms corresponds to the second period in the driving method of the present invention. During the period, the control wire Bj was set at High such that the switching TFT 24 was ON.

During the period, the potential of the second terminal of the second capacitor 25 approached to Va, so that the driving TFT 11 has a source-drain potential of substantially Vs−Va. On condition that the source-drain potential was substantially constant, the source-gate potential of the driving TFT 11 was determined. This allowed the current to constantly flow through the driving TFT 11, irrespective of the threshold voltage of the driving TFT 11 and the mobility property thereof. It took 30 μs until the current Ip stably flowed from the source to the drain. Thereafter, the gate wire Gi was set at Low such that the switching TFT 15 became OFF. Now, the selection period was over.

During the non-selection period coming after this (see a part corresponding to time at and after 1.096 ms), the source-drain potential Vsd of the driving TFT 11 was constant, and the current Ip constantly flowed from the source of the driving TFT 11 to the drain thereof.

Note that source-drain potentials Vsd(1) through Vsd(5), and source-drain currents Ip(1) through Ip(5) in FIG. 40 are results obtained by changing the threshold voltage of the driving TFT 11 and the mobility thereof in accordance with the conditions shown in Table 2.

As such, the use of the present driving method makes it possible to constantly supply a current to the organic EL element 16, irrespective of the threshold voltage variation and the mobility variation of the driving TFT 11. This allows acquirement of a uniform display.

Figure 22:
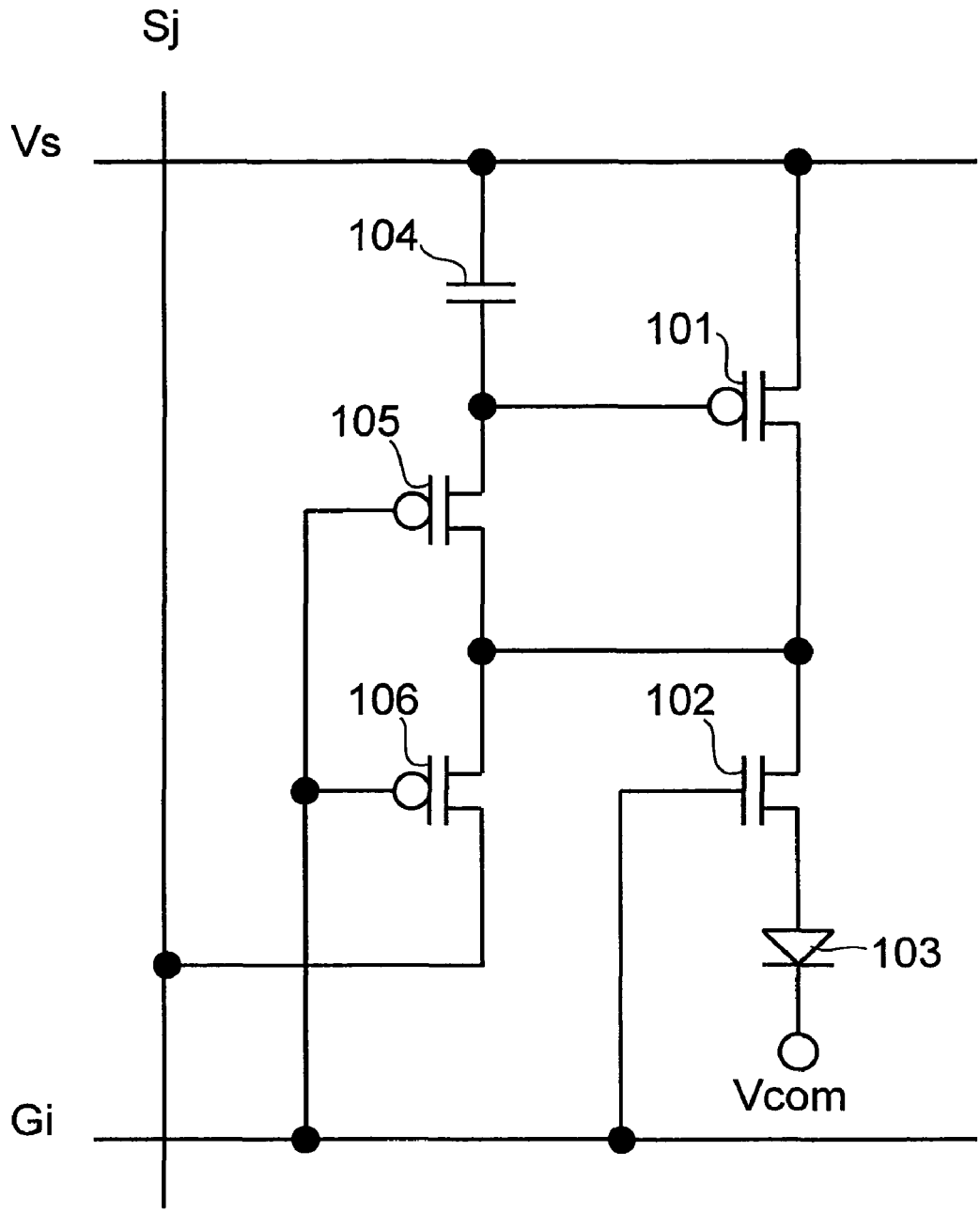
FIG. 22 is a circuit diagram illustrating a structure example of a pixel circuit of a conventional display apparatus.

However, for such acquirement, the selection period is required to be longer than the selection period of the conventional pixel circuit structure (see FIG. 22). Specifically, a period as long as the first period shown in FIG. 40 is sufficient for the selection period of the pixel circuit structure shown in FIG. 22, whereas the driving method of the present invention requires the first and second periods shown in FIG. 40 for the selection period. For shortening the selection period in the driving method of the present invention, the second period is required to be shorter.

Figure 41:
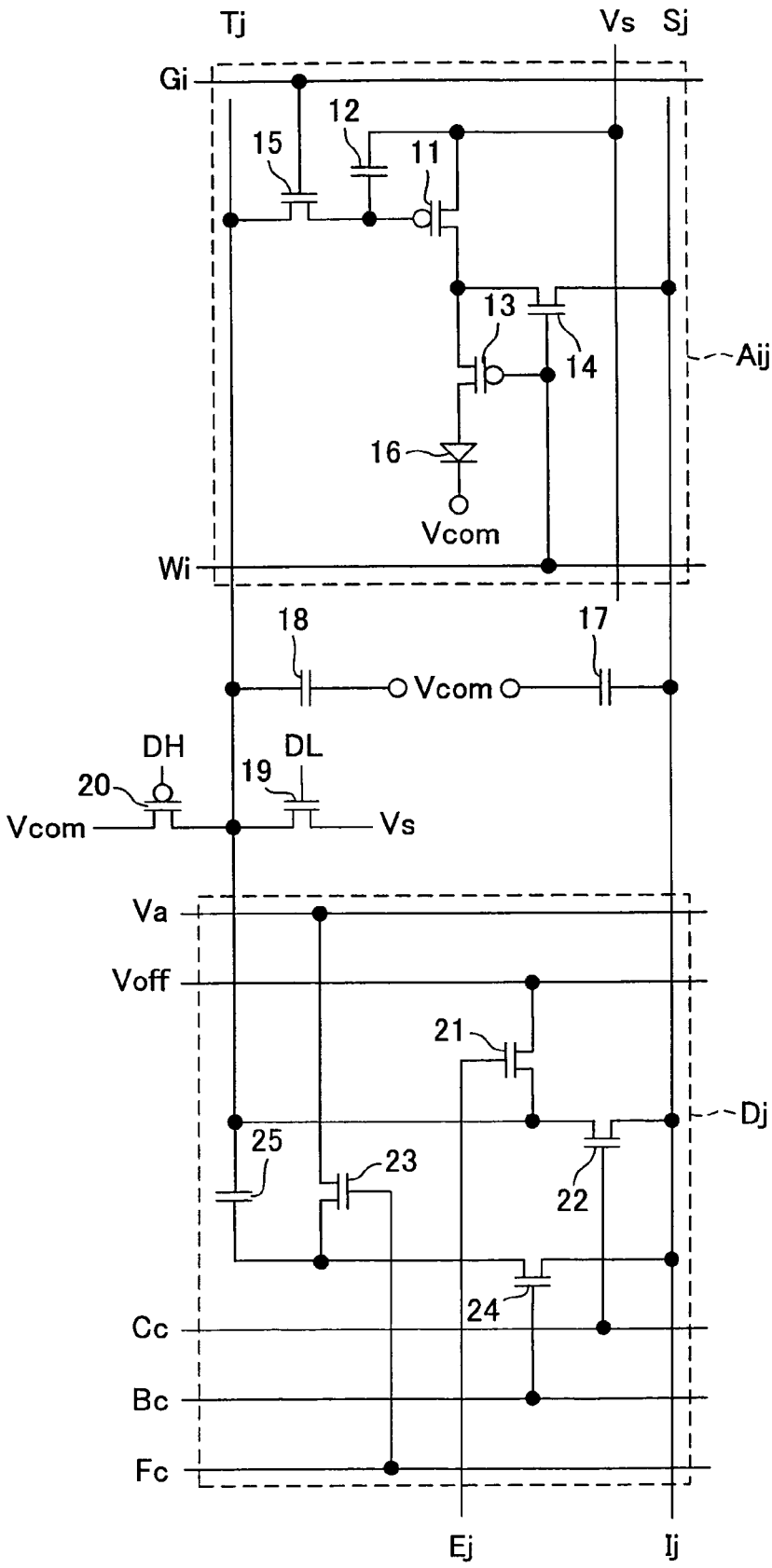
FIG. 41 illustrates a circuit diagram illustrating respective structures of a pixel circuit, a source driver circuit, and another circuit in a display apparatus according to Embodiment 8.

FIG. 41 illustrates a circuit structure for realizing such a driving method. The circuit structure shown in FIG. 41 has a structure in which the components of the first characteristic structure are separately provided in the pixel circuit Aij and the source driver output terminal circuit Dj, as is the case with the circuit structure shown in FIG. 8. In FIG. 41, capacitors, TFTs, and the like, each of which has the equivalent functions as each of those shown in FIG. 8, will be given the same reference symbols, and detailed explanation thereof will be omitted here.

Note that, in the circuit structure shown in FIG. 41, the stray capacitance of the source wire Sj is represented by a capacitor 17, and the stray capacitance of the signal wire Tj is represented by a capacitor 18. Note also that the signal line Tj is connected to a protection circuit made up of TFTs 19 and 20.

In the protection circuit, the n-type TFT 19 is provided between the signal line Tj and the power wire Vs, and the p-type TFT 20 is provided between the signal line Tj and the common wire Vcom. Further, a potential DL is supplied to a gate terminal of the TFT 19, and a potential DH is supplied to a gate terminal of the TFT 20.

With this, when the signal line Tj has a potential lower than DL (precisely, a potential obtained by subtracting a threshold potential of the TFT 19 from the potential DL), a current flows from the power source wire Vs to the signal line Tj. This protects the potential from further decreasing. On the contrary, when the signal line Tj has a potential higher than DH (precisely, a potential obtained by adding the potential DH to a threshold potential of the TFT 20), a current flows from the signal line Tj to the common wire Vcom. This protects the potential from further increasing.

Further, in the circuit structure shown in FIG. 41, the gate terminal of the switching TFT 22, which serves as the first switching element, is not wired to the gate terminal of the switching TFT 23, which serves as the third switching element. Instead, the gate terminal of the switching TFT 22 is wired (connected) to the control wire Cc, and the gate terminal of the switching TFT 23 is wired (connected) to the control wire Fc. Further, the signal wire Bj in FIG. 8 is replaced with the signal line Bc. This allows the signal wire Bj to be a common wire independent from the source wire Sj.

Figure 42:
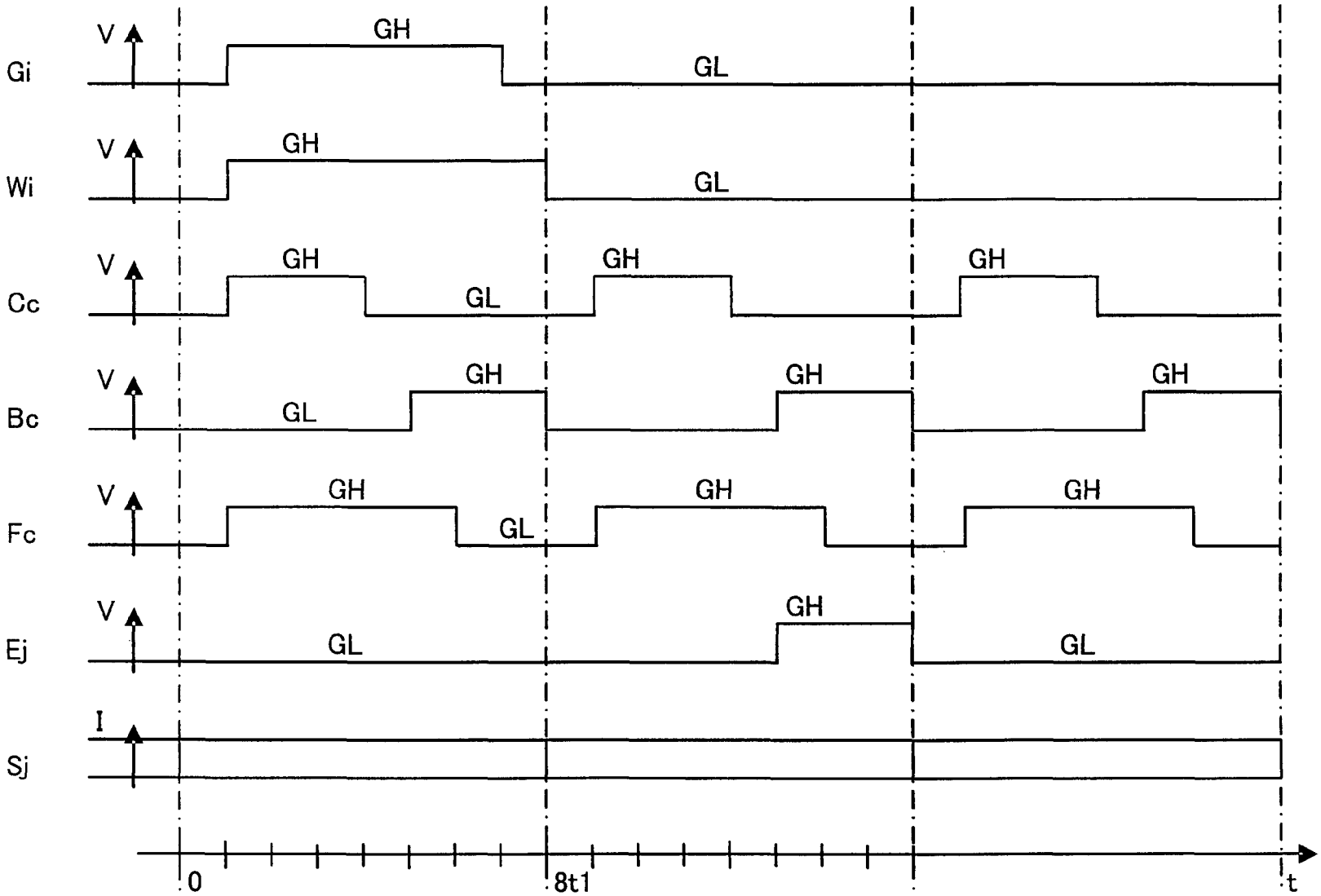
FIG. 42 is a wave form chart illustrating respective operation timings of control wires of the pixel circuit and the source driver circuit.

The following explains respective operations of the pixel circuit Aij (see FIG. 41) and the output terminal circuit Dj (see FIG. 41) with reference to FIG. 42. FIG. 42 illustrates respective operation timings of the control wires Gi, Wi, Cc, Bc, Fc, Ej, and the source wire Sj.

That is, during the selection period of the pixel circuit Aij, i.e., during a period of time from t1 to 8*t*1, the potential of the control wire Wi is set at High (GH) such that the switching TFT 13 is OFF, and that the switching TFT 14 is ON.

In the pixel circuit Aij, during the first period (time t1 to 4*t*1), the potential of the control wire Gi is set at High such that the switching TFT 15 is ON. This electrically connects the gate terminal of the driving TFT 11 to the signal line Tj. With this, the gate of the driving TFT 11 is connected to the first capacitor 12 and the second capacitor 25.

Meanwhile, during the period, in the output terminal circuit Dj, the potential of the control wire Cc is set at High such that the switching TFT 22 is ON, and the potential of the control wire Fc is set at High such that the switching TFT 23 is ON. This electrically connects the gate terminal of the driving TFT 11 to the drain terminal thereof via the switching TFTs 15, 22, 14. This also connects the second terminal of the second capacitor 25 to the predetermined voltage line Va via the switching TFT 23. With this, a current constantly flows from the power source wire Vs to the current output terminal Ij via the driving TFT 11, the switching TFT 14, and the source wire Sj.

At the time 4t1 after this, the potential of the control wire Cc is set at Low such that the switching TFT 22 becomes OFF. This causes the first capacitor 12 and the second capacitor 25 to retain the potential that the source wire Sj has on this occasion.

The first capacitor 12 and the second capacitor 25 thus retaining the potential on this occasion causes the driving TFT 11 to have a gate potential allowing constant current supply as above (as the aforesaid current supply, during the first period, from the source terminal of the driving TFT 11 to the drain terminal thereof) while the second terminal of the second capacitor 25 has a potential Va, irrespective of the threshold voltage and the mobility of the driving TFT 11.

Next, during a second period (time 5t1 to time 7t1), the potential of the control wire Bc is set at High such that the switching TFT 24 is ON. This connects the second terminal of the second capacitor 25 to the drain terminal of the driving TFT 11 via the switching TFTs 24 and 14. With this, a desired current flows from the power source wire Vs to the current output terminal Ij via the driving TFT 11, the switching TFT 14, and the source wire Sj.

However, in the present driving method shown in FIG. 42, the control wire Fc is High during a period of time from t1 to 6t1. That is, the switching TFT 23 is still ON even after the start of the second period. This allows a voltage to be supplied from the predetermined voltage line Va to the second terminal of the second capacitor 25 during a first part, continuing from 5t1 to 6t1, of the second period continuing from time 5t1 to time 7t1, unlike the driving method shown in FIG. 9. The current causes the source wire Sj to have the potential Va. (The driving TFT 11 is so set as to allow a current to constantly flow therethrough, so that the current thus constantly supplied flows between the power source wire Vs and the predetermined voltage line Va.)

As such, in the driving method shown in FIG. 42, the potential of the source wire Sj is set at Va in advance, and then the control wire Fc is set at Low such that the switching TFT 23 becomes OFF. During the rest of the second period, i.e., during the period of time from 6t1 to 7t1, the potential of the source wire Sj is changed in conformity with the threshold voltage and the mobility property of the driving TFT 11. With this, on condition that the source-drain potential of the driving TFT 11 is substantially constant, the gate-source potential of the driving TFT can be determined.

At the time 7t1 after this, the potential of the control wire Gi is set at Low such that the switching TFT 15 becomes OFF. This causes the first capacitor 12 to retain the source-gate potential that the driving TFT 11 has during the second period.

At time 8t1 after this, the potential of the control wire Bc is set at Low such that the switching TFT 24 becomes OFF. This disconnects the electric connection between the second capacitor 25 and the source wire Sj. Moreover, the potential of the control wire Wi is set at Low such that the switching TFT 14 becomes OFF, and that the switching TFT 13 becomes ON. This causes a current to flow from the driving TFT 11 to the organic EL element 16.

As such, in the driving method of FIG. 42, a voltage is supplied from the predetermined voltage line Va to the second terminal of the second capacitor 25 even during the first part, continuing from time 5t1 to 6t1, of the second period continuing from 5t1 to 7t1, unlike the driving method of FIG. 9. This allows the source-drain potential Vsd of the driving TFT 11 to be substantially constant from the beginning of the second period, and accordingly allows the current Ip, flowing between the source terminal and the drain terminal of the driving TFT 11, to be substantially constant from the beginning of the second period, as shown in a simulation result of FIG. 43.

Thereafter, the source-gate potential Vsg of the driving TFT 11 is changed so as to compensate the threshold voltage and the mobility property of the driving TFT 11 (the source-drain potential Vsd of the driving TFT 11 is also changed in response to the change of the source-gate potential Vsg). The potential thus changed is retained by the first capacitor 12, by setting the gate wire Gi at Low. This allows a current to be uniformly supplied to the organic EL element 16 during the non-selection period, irrespective of the threshold voltage variation and the mobility variation of the driving TFT 11.

Figure 43:
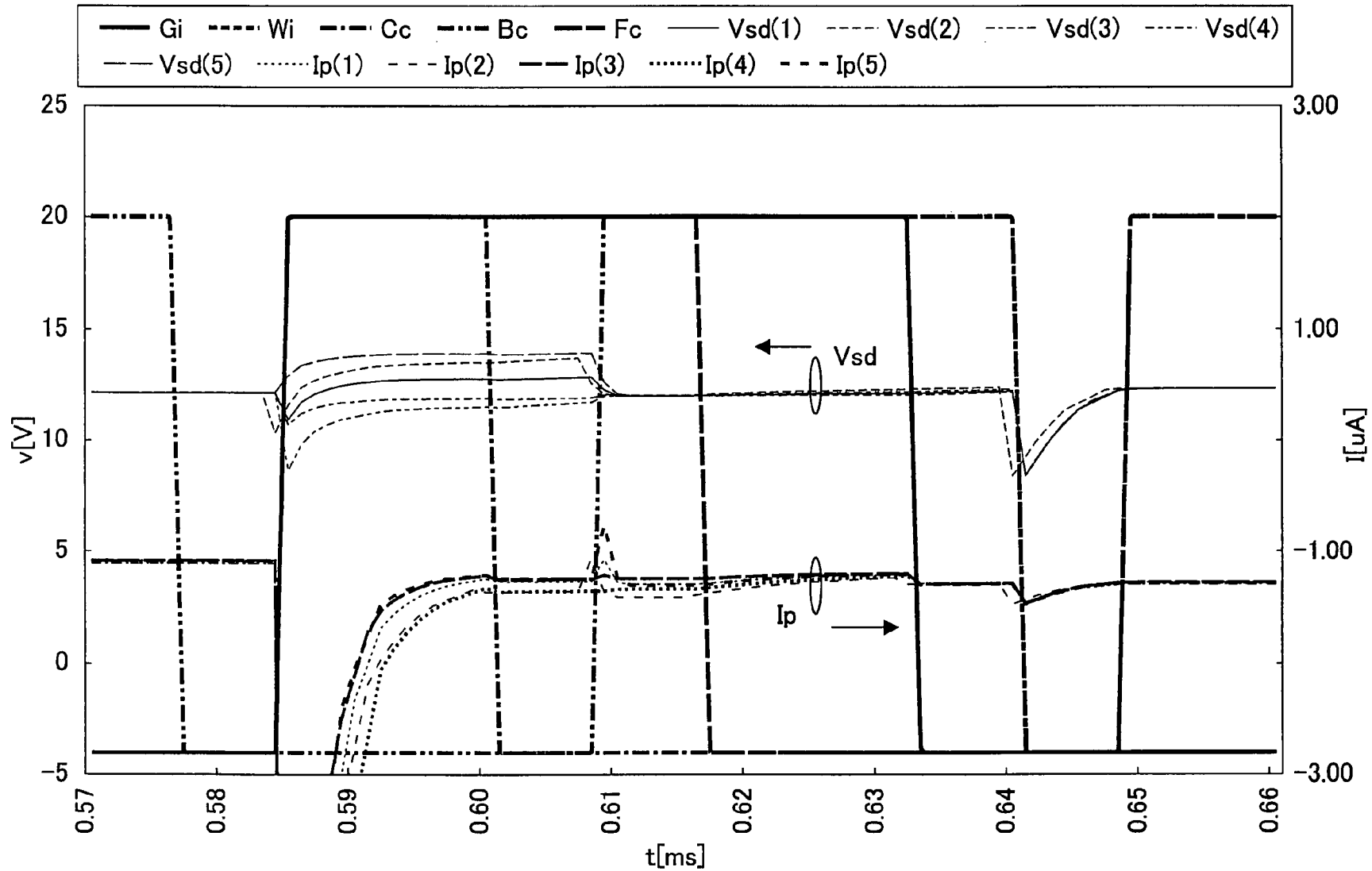
FIG. 43 is a graph illustrating a result of simulating respective changes in (i) a source-drain potential of the driving TFT and (ii) a current from the source of the driving TFT to the drain thereof, in the pixel circuit (see FIG. 41) and the source driver circuit (see FIG. 41).

In the simulation shown in FIG. 43, the second period corresponds to a period of time from 0.618 to 0.634, i.e., continues for 16 μs. Therefore, for 8 μs corresponding to the first part of the second period, the predetermined potential wire Va and the second terminal of the second capacitor 25 are short-circuited. In consideration of this, the driving method shown in FIG. 42 can shorten the second period as compared with the driving method shown in FIG. 9.

Further, in the driving method of the present invention, the first period is not required to continue until the gate-source potential Vsd of the driving TFT 11 becomes stable.

The reason for this is as follows. That is, expected variation upon the completion of the first period is substantially no different from the variation in the conventional pixel circuit structure shown in FIG. 22. Moreover, expected variation while the source wire Sj has the potential Va after the start of the second period is also substantially no different from the variation in the conventional pixel circuit structure shown in FIG. 22. However, during the rest of the second period, i.e., while changing the potential of the source wire Sj from Va, the variation is reduced as compared with the variation of the conventional pixel circuit structure shown in FIG. 22.

As such, even though the gate-source potential Vsd of the driving TFT 11 is varied to some extent upon the completion of the first period, the variation is compensated during the second period. This allows a current to be uniformly supplied to the organic EL element 16 during the non-selection period irrespective of the threshold voltage variation and the mobility variation of the driving TFT 11.

As such, the preferable driving example of the driving method of the present invention makes it possible to shorten the length of the second period, with the result that the required selection period is shorter. On this account, a larger number of the gate wires Gi can be driven, and a larger number of the pixels can be accordingly used for a display. As such, the preferable driving example is apparently beneficial.

Embodiment 9

There is another means for solving the aforesaid problem that the circuit structure shown in FIG. 8 causes the selection period to be longer. Specifically, it is effective that the second capacitor is provided close to a pixel circuit provided together with a source driver circuit. Note that the first characteristic structure according to the present invention is applied to each of the pixel circuit and the source driver circuit.

Figure 44:
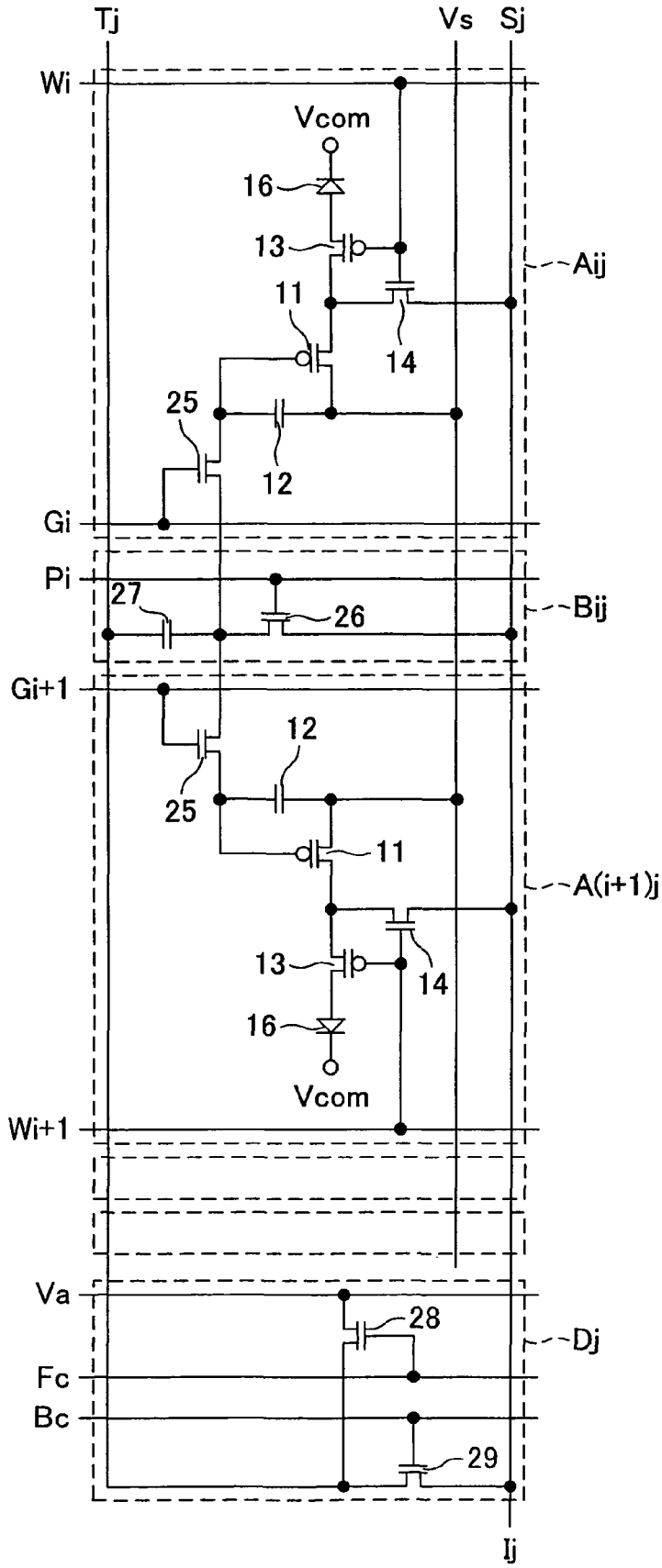
FIG. 44 is a circuit diagram illustrating a pixel circuit, a source driver circuit, and another circuit in a display apparatus according to Embodiment 9.

A specific example of such a circuit structure is a circuit structure (see FIG. 44) made up of a pixel circuit, a source driver output terminal circuit Dj, and another circuit Bij. In FIG. 44, capacitors and TFTs carrying out the equivalent operations as those shown in FIG. 8 are given the same reference symbols, and explanation thereof will be omitted here.

In the circuit structure shown in FIG. 44, the aforesaid another circuit Bij, made up of a second capacitor 27 and a switching TFT 26, is provided for every two pixel circuits Aij and A(i+1)j. Further, in each of the pixel circuit Aij and A(i+1)j, a switching TFT 25 is provided between a gate terminal of a driving TFT 11 and a first terminal of the second capacitor 27.

This shortens a length of a wire connecting the gate terminal of the driving TFT 11 to the second capacitor 27. Accordingly, a stray capacitance of the wire is restrained, so that even a second capacitor 27 having a small capacitance works sufficiently. Specifically, the second capacitor 25 shown in FIG. 41 has a capacitance of approximately 2 pF, whereas the second capacitor 27 shown in FIG. 44 has a capacitance of approximately 1 pF as is the case with the first capacitor 12.

Figure 45:
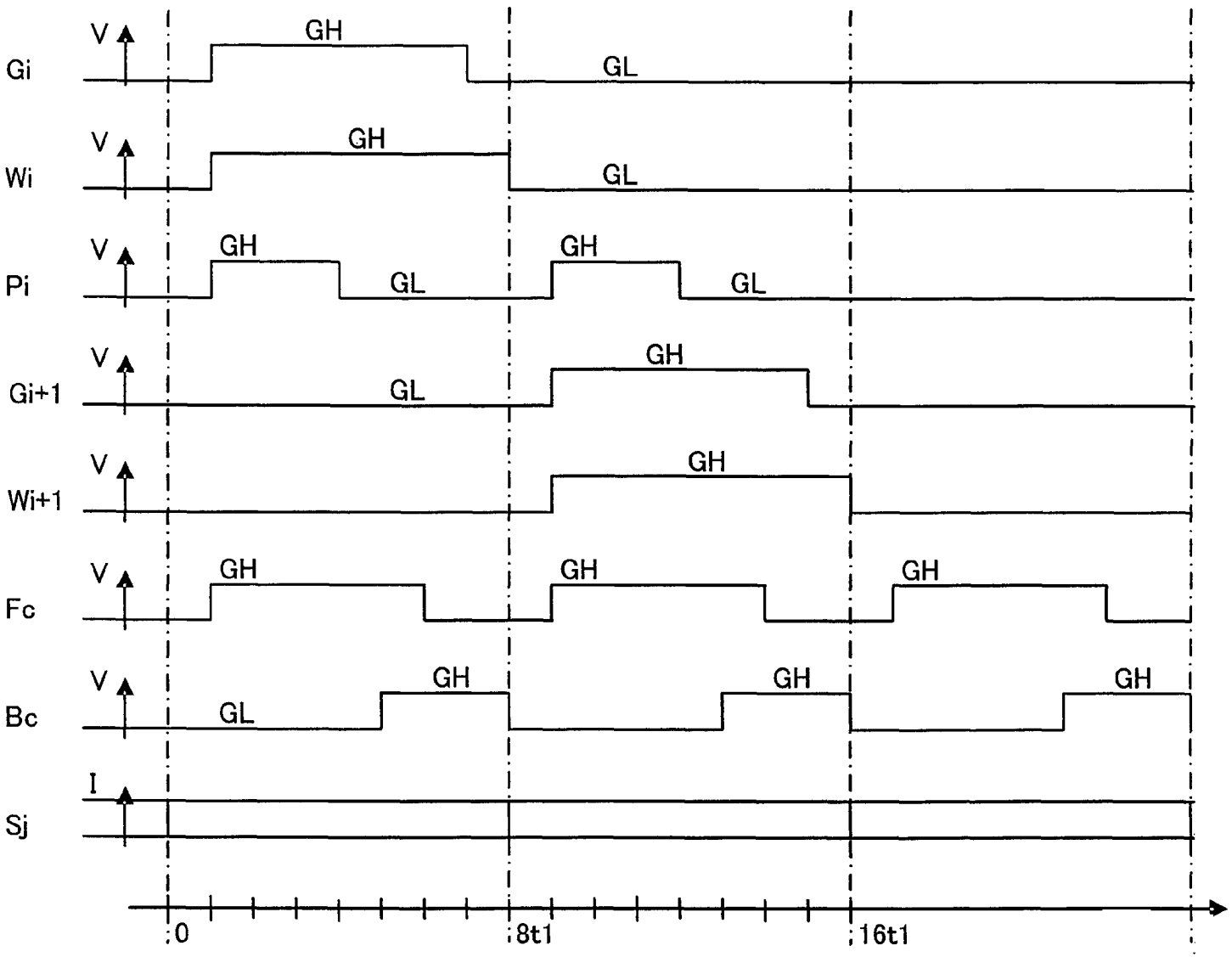
FIG. 45 is a wave form chart illustrating respective operation timings of control wires of the pixel circuit, the source driver circuit, and the aforesaid another circuit.

The following explains an operation of the pixel circuit shown in FIG. 44, with reference to FIG. 45. FIG. 45 illustrates respective operation timings of control wires Gi, Wi, Pi, Gi+1, Wi+1, Fc, Bc, and a source wire Sj.

That is, the selection period of the pixel circuit Aij corresponds to a period of time from t1 to 8*t*1 in the timings shown in FIG. 45. During the period, a potential of the control wire Wi is set at High (GH) such that a switching TFT 13 is OFF, and that a switching TFT 14 is ON.

During a first period (time t1 to 4*t*1), a potential of the control wire Gi is set at High such that the switching TFT 25 is ON, and a potential of the control wire Fc is set at High such that the switching TFT 28 in the source driver output terminal circuit Dj is ON, and a potential of the control wire Pi is set at High such that the switching TFT 26 is ON.

This electrically connects the gate terminal of the driving TFT 11 to the drain terminal thereof via the switching TFTs 25, 26, 14. This also connects the second terminal of the second capacitor 27 to a predetermined voltage line Va via a signal line Tj and a switching TFT 28. With this, a current is constantly supplied from a power source wire Vs to a current output terminal Ij via the driving TFT 11, the switching TFT 14, and the source wire Sj.

Thereafter (at the time 4*t*1), the potential of the control wire Pi is set at Low such that the switching TFT 26 becomes OFF. This causes the first capacitor 12 and the second capacitor 27 to retain the potential, determined during the first period, of the source wire Sj.

During the second period (time 5*t*1 to time 7*t*1), the potential of the control wire Bc is set at High such that a switching TFT 29 in the source driver output terminal circuit Dj is ON. Moreover, the control wire Fc is maintained to be High during the first part (time 5*t*1 to time 6*t*1) of the second period such that the source wire Sj has a predetermined potential Va.

During the rest (time 6*t*1 to 7*t*1) of the second period, the potential of the gate wire Gi is set at Low such that the switching TFT 27 is OFF, after the current Ip flowing between the source of the driving TFT 11 and the drain thereof becomes stable. Then, the potential of the control wire Bc is set at Low such that the switching TFT 29 becomes OFF. Then, the selection period of the pixel A(i+1)j starts.

That is, the selection period of the pixel circuit A(i+1)j corresponds to a period of time from 9*t*1 to 16*t*1 in the timings shown in FIG. 44. During the period, a potential of the control wire Wi+1 is set at High (GH) such that a switching TFT 13 is OFF, and that a switching TFT 14 is ON.

During a first period (time 9*t*1 to 12*t*1), a potential of the control wire Gi+1 is set at High such that the switching TFT 25 is ON, and the potential of the control wire Fc is set at High such that the switching TFT 28 is ON, and the potential of the control wire Pi is set at High such that the switching TFT 26 is ON.

This electrically connects the gate terminal of the driving TFT 11 to the drain terminal thereof via the switching TFTs 25, 26, and 14. This also connects the second terminal of the second capacitor 27 to the predetermined voltage line Va via the signal line Tj and the switching TFT 28. On this occasion, a current constantly flows from the power source wire Vs to the current output terminal Ij via the driving TFT 11, the switching TFT 14, and the source wire Sj.

Thereafter (at the time 12*t*1), the potential of the control wire Pi is set at Low such that the switching TFT 26 becomes OFF. This causes the first capacitor 12 and the second capacitor 27 to retain the potential, determined during the first period, of the source wire Sj.

During a second period (time 13*t*1 to time 15*t*1), the potential of the control wire Bc is set at High such that the switching TFT 29 is ON. Moreover, the control wire Fc is maintained to be High during a first part (time 13*t*1 to time 14*t*1) of the second period such that the source wire Sj has a predetermined potential Va.

During the rest (time 14*t*1 to 15*t*1) of the second period, the potential of the gate wire Gi is set at Low after the current Ip stably flows between the source of the driving TFT 11 and the drain thereof. With this, the switching TFT 27 is OFF.

By providing the aforesaid another circuit Bij for every two pixels Aij and A(i+1) in this way, the means of the present invention can be attained.

Further, each shorter wire between the gate terminal of each driving TFT 11 and the second capacitor 27 restrains the stray capacitance of the wire, so that even a second capacitor 27 having a small capacitance allows the effect of the means of the present invention. (The effect indicates that a current is constantly supplied from the driving TFT 11 to the organic EL 16, irrespective of the threshold voltage variation and the mobility property variation of the driving TFT 11.)

Moreover, as compared with the circuit structure shown in FIG. 1, the circuit structure allows reduction of the respective number of the second capacitor 27 and the switching TFT 26, each of which is required for every two pixels Aij and A(i+1)j. With this, an open area ratio can be increased.

Embodiments described above assume that each organic EL used therein is a polymer molecule organic EL. While a manufacture of an organic EL element made of a low molecular organic EL requires vapor deposition, a manufacture of an organic EL element made of a polymer molecule organic EL employs an ink jet process. In the latter case, a hydrophilic hole is formed, for each driving TFT, in a hydrophobic bank. However, the hole is not necessarily required to be formed per pixel, but may be shared by a plurality of RGB color pixels. Especially, it is preferable to form a stripe-shaped hole having droplet recipients on both ends, because a size of each droplet recipient can be determined irrespective of RGB pixel pitches.

INDUSTRIAL APPLICABILITY

The present invention is applicable to a display apparatus using a current driving element, such as an organic EL (Electro Luminescence) display and an FED (Field Emission Display). The present invention allows restraint of variation of a current flowing through the current driving element during the non-selection period, thereby improving display quality.

The invention claimed is:

1. A display apparatus including a current driving light emitting element and a driving transistor, the display apparatus comprising:

a first switching transistor for connecting (i) a current control terminal of the driving transistor to (ii) a current output terminal of the driving transistor;

a first capacitor, connected to the current control terminal of the driving transistor;

a second capacitor, having a first terminal connected to the current control terminal of the driving transistor;

a second switching transistor for connecting a second terminal of the second capacitor to the current output terminal of the driving transistor via a wire or a transistor, the second terminal being a terminal opposite to the first terminal; and a third switching transistor for connecting the second terminal of the second capacitor to a voltage line, wherein the second terminal of the second capacitor is connected to a node between the second and third switching transistors, the voltage line being set to a value which corresponds to an anode potential from a property of the current driving light emitting element.

2. The display apparatus as set forth in claim 1, wherein:

during a first period within a current writing period of the driving transistor, the first switching transistor connects the current control terminal to the current output terminal, the second switching transistor disconnects the second terminal and the current output terminal from each other, and the third switching transistor connects the second terminal to the voltage line;

during a second period within the current writing period, the first switching transistor disconnects the current control terminal from the current output terminal, and the third switching transistor disconnects the second terminal from the voltage line, and the second switching transistor connects the second terminal to the current output terminal, the second switching transistor operating in an opposite logic state from the third switching transistor in the first and second periods; and during a readout period of the driving transistor, the second switching transistor disconnects the second terminal from the current output terminal, and the driving transistor supplies a current to the current light emitting element.

3. The display apparatus as set forth in claim 2, wherein:

the first capacitor, the second capacitor, the first switching transistor, the second switching transistor, and the third switching transistor are provided in each pixel circuit or each source driver circuit of a plurality of source driver circuits.

4. The display apparatus as set forth in claim 2, wherein:

one or more of the first capacitor, the second capacitor, the first switching transistor, the second switching transistor, and the third switching transistor are provided in a pixel circuit, and the others are provided in a portion outside the pixel circuit, which portion includes a source driver circuit.

5. The display apparatus as set forth in claim 4, wherein:

the current driving light emitting element, the driving transistor, and the first capacitor are provided in the pixel circuit; and the second capacitor, the first switching transistor, the second switching transistor, and the third switching transistor are provided in the portion outside the pixel circuit, which portion includes the source driver circuit, said display apparatus, further comprising:

a connecting wire for connecting the current control terminal of the driving transistor to the first terminal of the second capacitor.

6. The display apparatus as set forth in claim 5, wherein:

the current driving light emitting element, the driving transistor, and the first capacitor are provided in the pixel circuit;

the second capacitor, the first switching transistor are provided outside the pixel circuit; and the second switching transistor and the third switching transistor are provided in the source driver circuit;

the display apparatus further comprising:

a connecting wire for connecting the second terminal of the second capacitor to the second switching transistor and the third switching transistor.

7. The display apparatus as set forth in claim 4, wherein:

the current driving light emitting element, the driving transistor, the first switching transistor, the first capacitor, and the second capacitor are provided in the pixel circuit; and the second switching transistor and the third switching transistor are provided in the source driver circuit or the portion outside the pixel circuit;

the display apparatus further comprising:

a connecting wire for connecting the second terminal of the second capacitor to (i) the current output terminal of the driving transistor, or (ii) the current input terminal of the driving transistor.

8. The display apparatus as set forth in claim 1, wherein:

the first capacitor, the second capacitor, the first switching transistor, the second switching transistor, and the third switching transistor are provided in each pixel circuit or each source driver circuit of a plurality of source driver circuits.

9. The display apparatus as set forth in claim 8, wherein:

each of the source driver circuits includes the first capacitor, the second capacitor, the first switching transistor, the second switching transistor, and the third switching transistor; and each of the pixel circuits includes a transistor for controlling a current that is to be supplied to the current driving light emitting element.

10. A display apparatus including a current driving light emitting element and a driving transistor, the display apparatus comprising:

a first switching transistor for connecting (i) a current control terminal of the driving transistor to (ii) a current input terminal of the driving transistor;

a first capacitor, connected to the current control terminal of the driving transistor;

a second capacitor, having a first terminal connected to the current control terminal of the driving transistor;

a second switching transistor for connecting a second terminal of the second capacitor to the current input terminal of the driving transistor via a wire and a transistor, the second terminal being a terminal opposite to the first terminal; and a third switching transistor for connecting the second terminal of the second capacitor to a voltage line, wherein the second terminal of the second capacitor is connected to a node between the second and third switching transistors, the voltage line being set to a value which corresponds to an anode potential from a property of the current driving light emitting element.

11. The display apparatus as set forth in claim 10, wherein:

during a first period within a current writing period of the driving transistor, the first switching transistor connects the current control terminal to the current input terminal, the second switching transistor disconnects the second terminal and the current output terminal from each other, and the third switching transistor connects the second terminal to the voltage line;

during a second period within the current writing period, the first switching transistor disconnects the current control terminal from the current input terminal, and the third switching transistor disconnects the second terminal from the voltage line, and the second switching transistor connects the second terminal to the current input terminal, the second switching transistor operating in an opposite logic state from the third switching transistor in the first and second periods; and during a readout period of the driving transistor, the second switching transistor disconnects the second terminal from the current input terminal, and the driving transistor supplies a current to the current light emitting element.

12. The display apparatus as set forth in claim 11, wherein:

the first capacitor, the second capacitor, the first switching transistor, the second switching transistor, and the third switching transistor are provided in each pixel circuit or each source driver circuit of a plurality of source driver circuits.

13. The display apparatus as set forth in claim 11, wherein:

one or more of the first capacitor, the second capacitor, the first switching transistor, the second switching transistor, and the third switching transistor are provided in a pixel circuit, and the others are provided in a portion outside the pixel circuit, which portion includes a source driver circuit.

14. The display apparatus as set forth in claim 13, wherein:

the current driving light emitting element, the driving transistor, and the first capacitor are provided in the pixel circuit; and the second capacitor, the first switching transistor, the second switching transistor, and the third switching transistor are provided in the portion outside the pixel circuit, which portion includes the source driver circuit, said display apparatus, further comprising:

a connecting wire for connecting the current control terminal of the driving transistor to the first terminal of the second capacitor.

15. The display apparatus as set forth in claim 14, wherein:

the current driving light emitting element, the driving transistor, and the first capacitor are provided in the pixel circuit;

the second capacitor, the first switching transistor are provided outside the pixel circuit; and the second switching transistor and the third switching transistor are provided in the source driver;

the display apparatus further comprising:

a connecting wire for connecting the second terminal of the second capacitor to the second switching transistor and the third switching transistor.

16. The display apparatus as set forth in claim 13, wherein:

the current driving light emitting element, the driving transistor, the first switching transistor, the first capacitor, and the second capacitor are provided in the pixel circuit; and the second switching transistor and the third switching transistor are provided in the source driver circuit or the portion outside the pixel circuit;

the display apparatus further comprising:

a connecting wire for connecting the second terminal of the second capacitor to (i) the current output terminal of the driving transistor, or (ii) the current input terminal of the driving transistor.

17. The display apparatus as set forth in claim 10, wherein:

the first capacitor, the second capacitor, the first switching transistor, the second switching transistor, and the third switching transistor are provided in each pixel circuit or each source driver circuit of a plurality of source driver circuits.

18. The display apparatus as set forth in claim 17, wherein:

each of the source driver circuits includes the first capacitor, the second capacitor, the first switching transistor, the second switching transistor, and the third switching transistor; and each of the pixel circuits includes a transistor for controlling a current that is to be supplied to the current driving light emitting element.

19. A method for driving a display apparatus including a current driving light emitting element and a driving transistor, the method comprising the steps of:

electrically connecting a current control terminal of the driving transistor to a first terminal of a first capacitor;

electrically connecting, during a current writing period of the driving transistor, the first terminal of the first capacitor to a first terminal of a second capacitor;

during a first period, (i) electrically connecting a second terminal of the second capacitor to a voltage line by a third switching transistor, and (ii) electrically connecting the current control terminal of the driving transistor to a current output terminal of the driving transistor by a second switching transistor, and (iii) causing the first capacitor and the second capacitor to retain a current control terminal potential that the driving transistor has on this occasion, the second terminal being a terminal opposite to the first terminal, wherein the second terminal of the second capacitor is connected to a node between the second and third switching transistors, the voltage line being set to a value which corresponds to an anode potential from a property of the current driving light emitting element;

during a second period, (i) correcting the current control terminal potential by disconnecting the current control terminal of the driving transistor from the current output terminal of the driving transistor by a first switching transistor, and by changing electric connection of the second terminal of the second capacitor from the voltage line to the current output terminal of the driving transistor by the second and third transistor, and (ii) causing the first capacitor to retain the current control terminal potential that the driving transistor has on this occasion; and controlling, during a current readout period of the driving transistor, an output current of the driving transistor with the use of the current control terminal potential, retained by the first capacitor, of the driving transistor.

20. The driving method as set forth in claim 19, wherein:

during the second period, the electric connecting of the second terminal of the second capacitor to the current output terminal of the driving transistor is carried out before disconnecting the voltage line from the second terminal of the second capacitor.

* * * * *